US005167558A

United States Patent [19]

Duchek et al.

[11] Patent Number: 5,167,558

[45] Date of Patent: Dec. 1, 1992

[54] SYSTEM FOR REGISTERING AND ASSEMBLING TENSION MASKS AND CRT FACEPLATES

[75] Inventors: Richard J. Duchek, Schaumburg; Johann Steiner, Des Plaines; Paul Strauss, Chicago, all of Ill.

[73] Assignee: Zenith Electronics Corporation

[21] Appl. No.: 710,738

[22] Filed: May 29, 1991

Related U.S. Application Data

[60] Continuation-in-part of Ser. No. 562,523, Aug. 3, 1990, Pat. No. 5,059,147, which is a division of Ser. No. 370,204, Jun. 22, 1989, Pat. No. 4,973,280, which is a continuation-in-part of Ser. No. 223,475, Jul. 22, 1988, Pat. No. 4,902,257.

[51] Int. Cl.[5] ..... H01J 9/00; H01J 29/07

[52] U.S. Cl. ..... 445/64; 445/30; 445/68

[58] Field of Search ..... 445/3, 4, 30, 52, 68, 445/64; 313/402, 407, 408

[56] References Cited

U.S. PATENT DOCUMENTS

| | | | |
|---|---|---|---|
| 3,982,979 | 9/1976 | Hentz et al. | 228/105 X |
| 4,069,567 | 1/1978 | Schwartz | 445/30 |
| 4,776,822 | 10/1988 | Dougherty et al. | 445/30 |
| 4,790,786 | 12/1988 | Stauss | 445/68 |
| 4,902,257 | 2/1990 | Adler et al. | 445/30 |
| 4,973,280 | 11/1990 | Adler et al. | 445/3 |
| 4,988,901 | 3/1991 | Adler et al. | 445/3 |
| 5,059,147 | 10/1991 | Adler et al. | 445/4 |

FOREIGN PATENT DOCUMENTS

| | | | |
|---|---|---|---|
| 20345 | 1/1986 | Japan | 228/105 |

*Primary Examiner*—Kenneth J. Ramsey

[57] ABSTRACT

A production system is disclosed for registering flat tension masks to screen bearing face panels in the manufacture of cathode ray tubes. Both the panel and mask are supported in modules with identical registration features at loading stations and alternately conveyed to an assembly station with a top mounted laser welder for welding the mask to panel rails. A lift assembly up loads the modules into the assembly station where they are registered with the same registration elements. Screen location on the panel is interrogated by panel module associated cameras that view spaced fiducial marks on the panel previously located with respect to the screen. Mask interrogation is also accomplished by a camera array. Early screen interrogation enables the mask to be preliminarily positioned very close to final positioning.

26 Claims, 31 Drawing Sheets

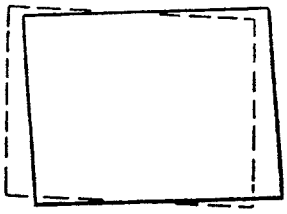
FIG. 14a
FIG. 14
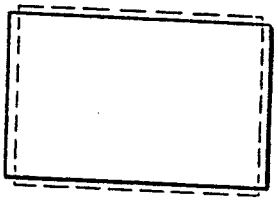
FIG. 14b
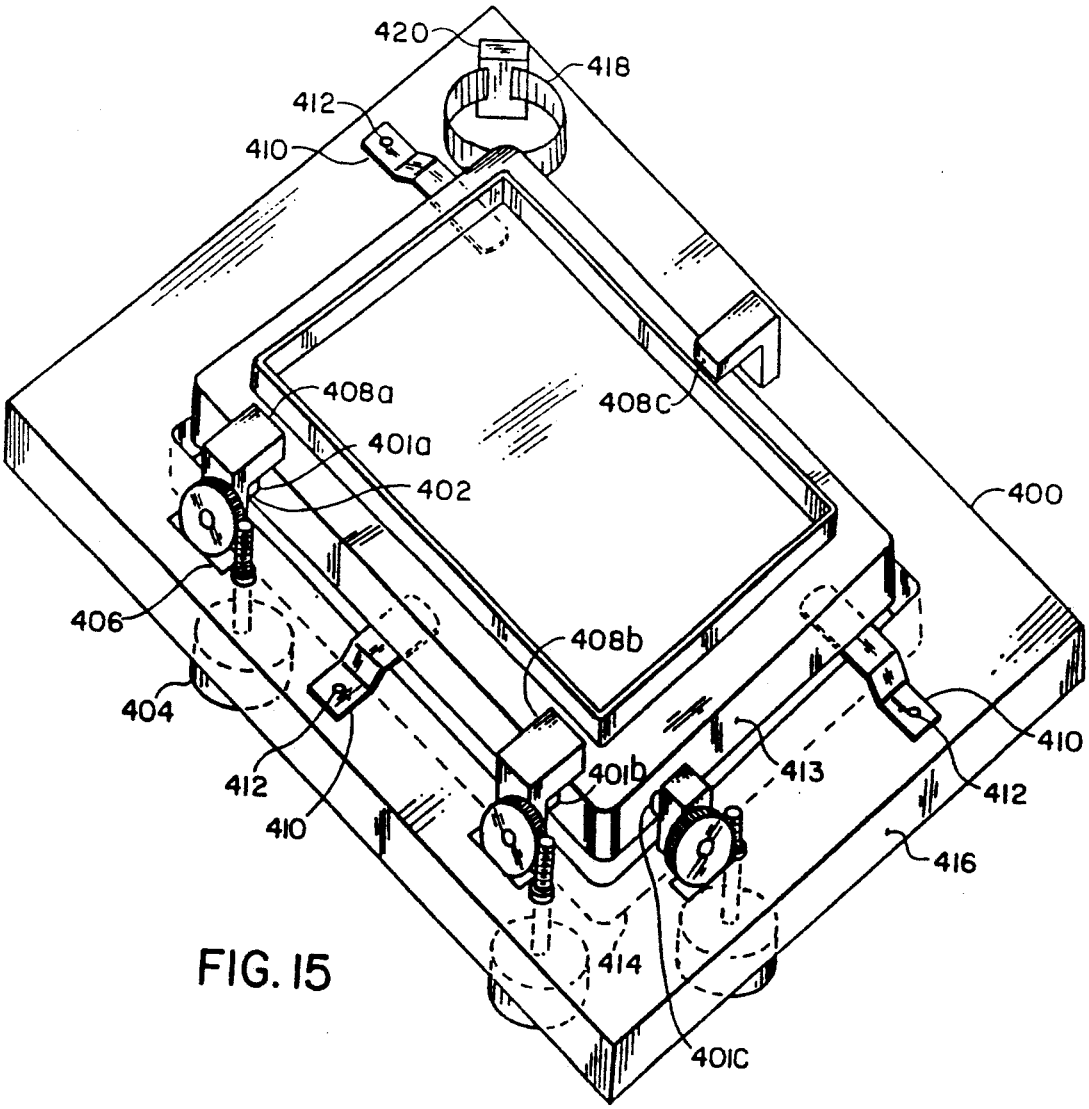
FIG. 15

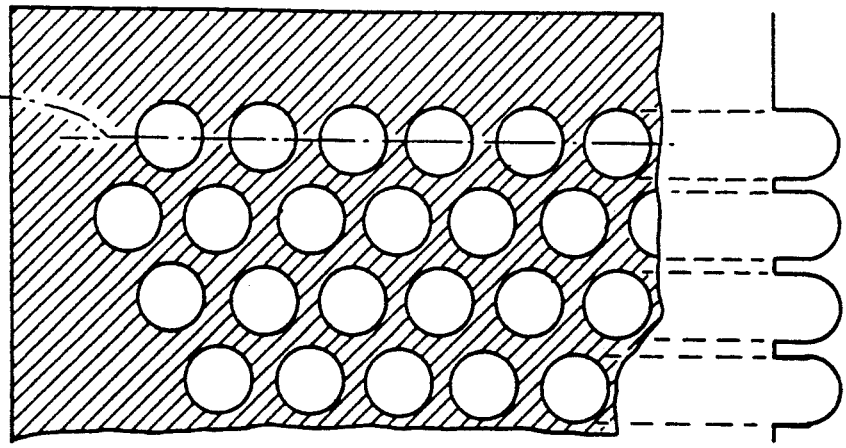
FIG.18a
FIG.18c
FIG. 18
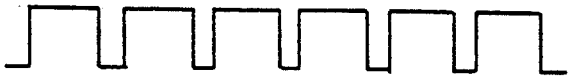
FIG. 18b
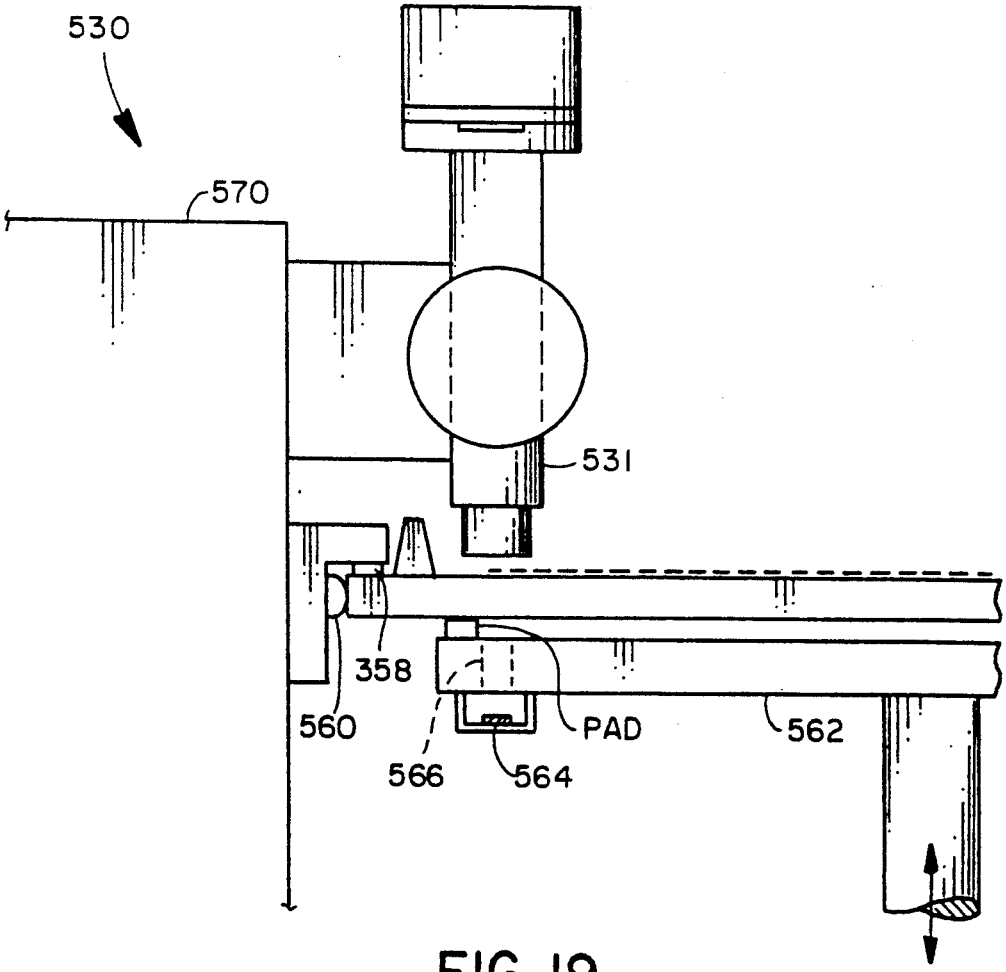
FIG. 19

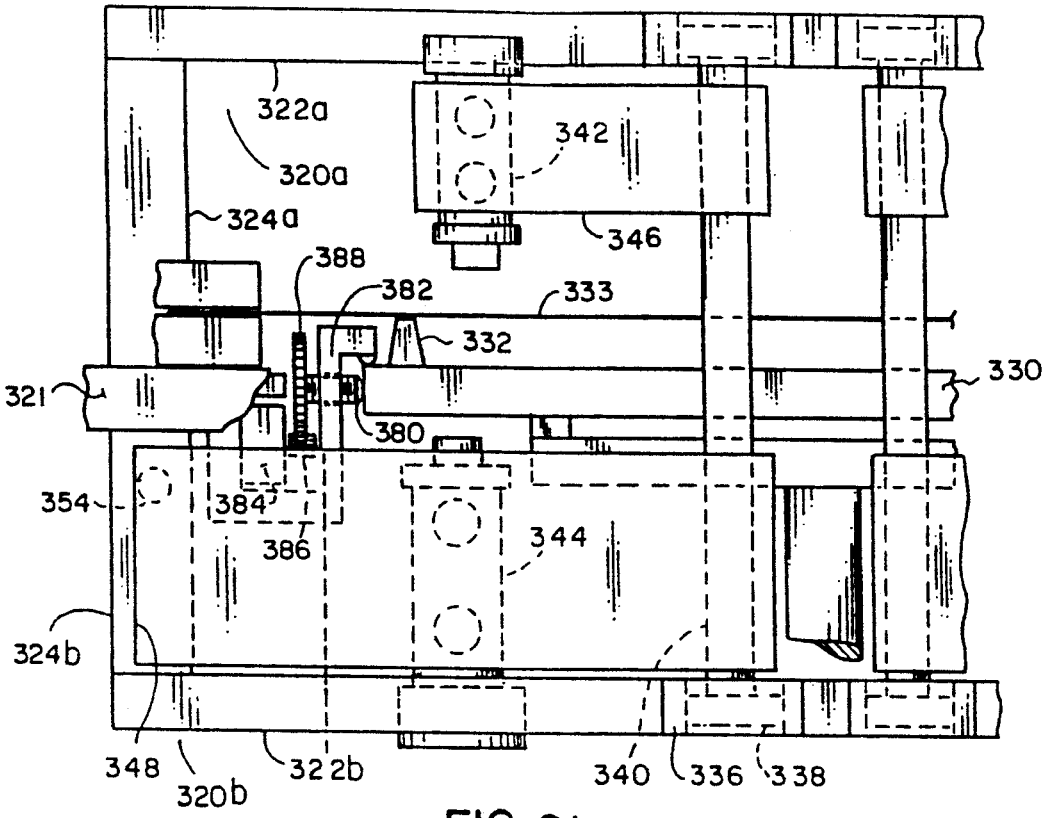
FIG. 21a
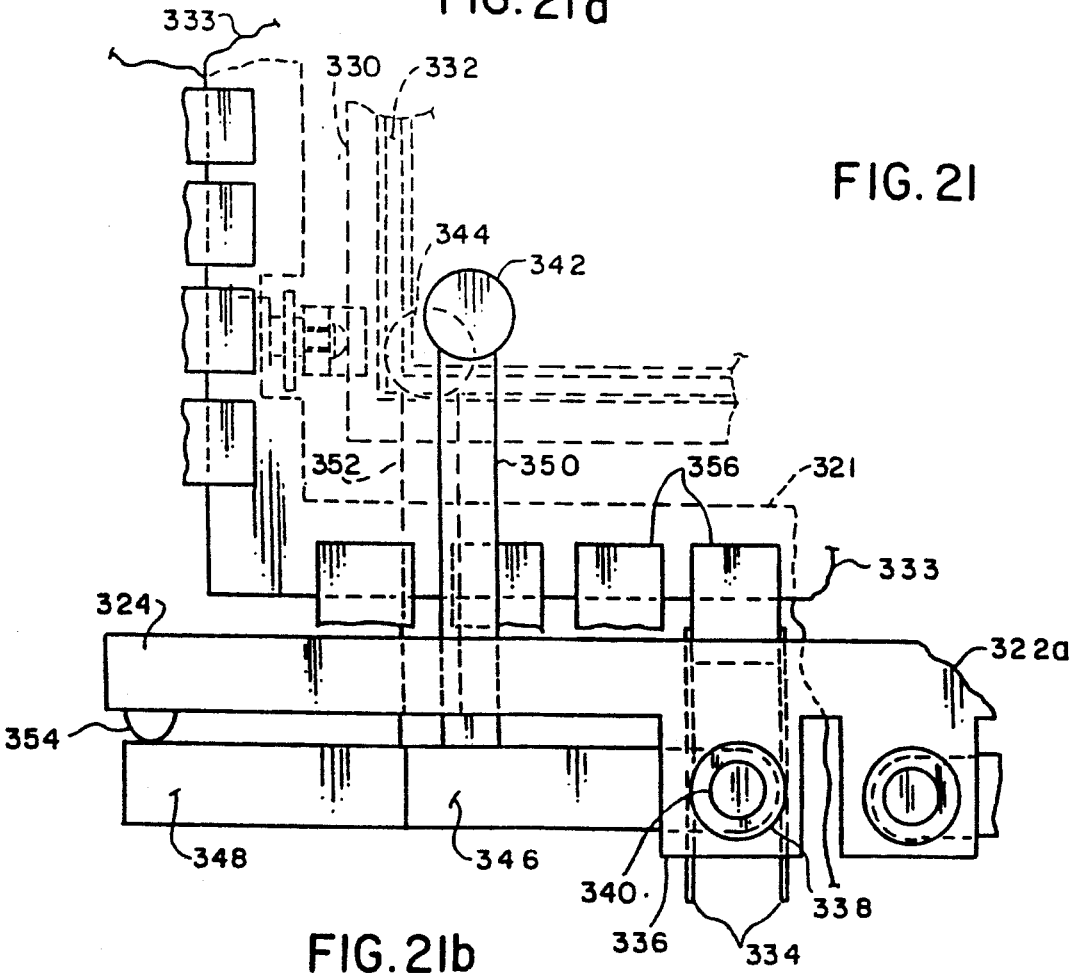
FIG. 21
FIG. 21b

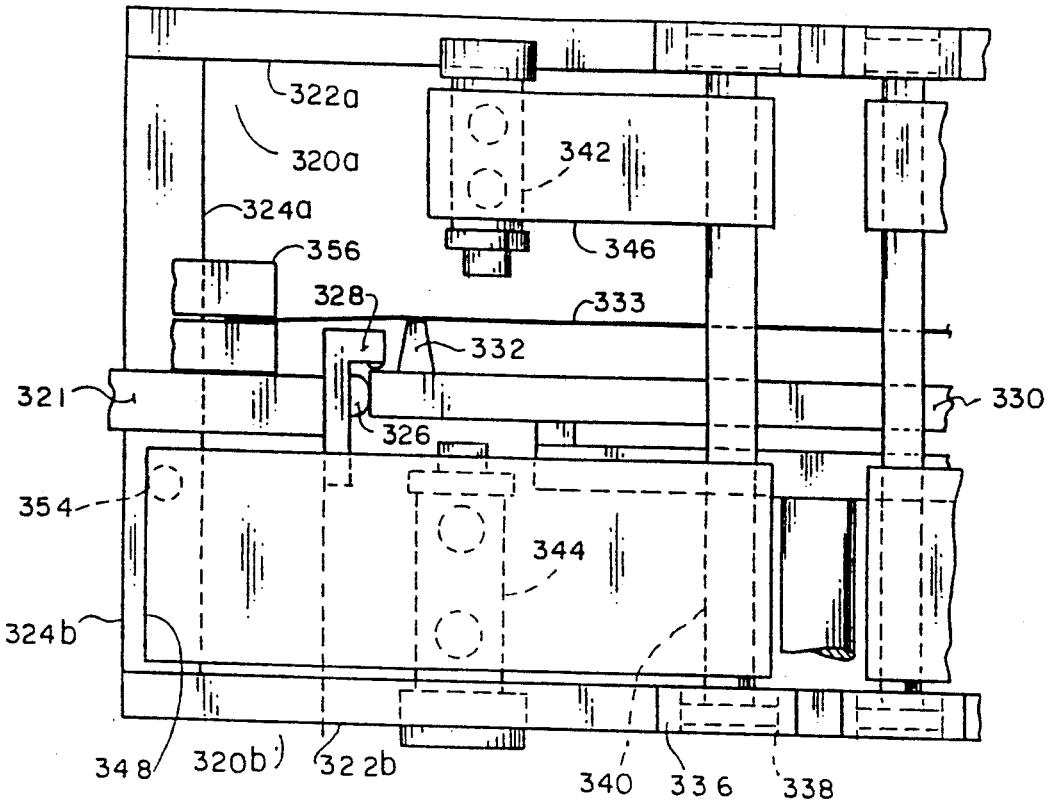
FIG. 23a
FIG. 23
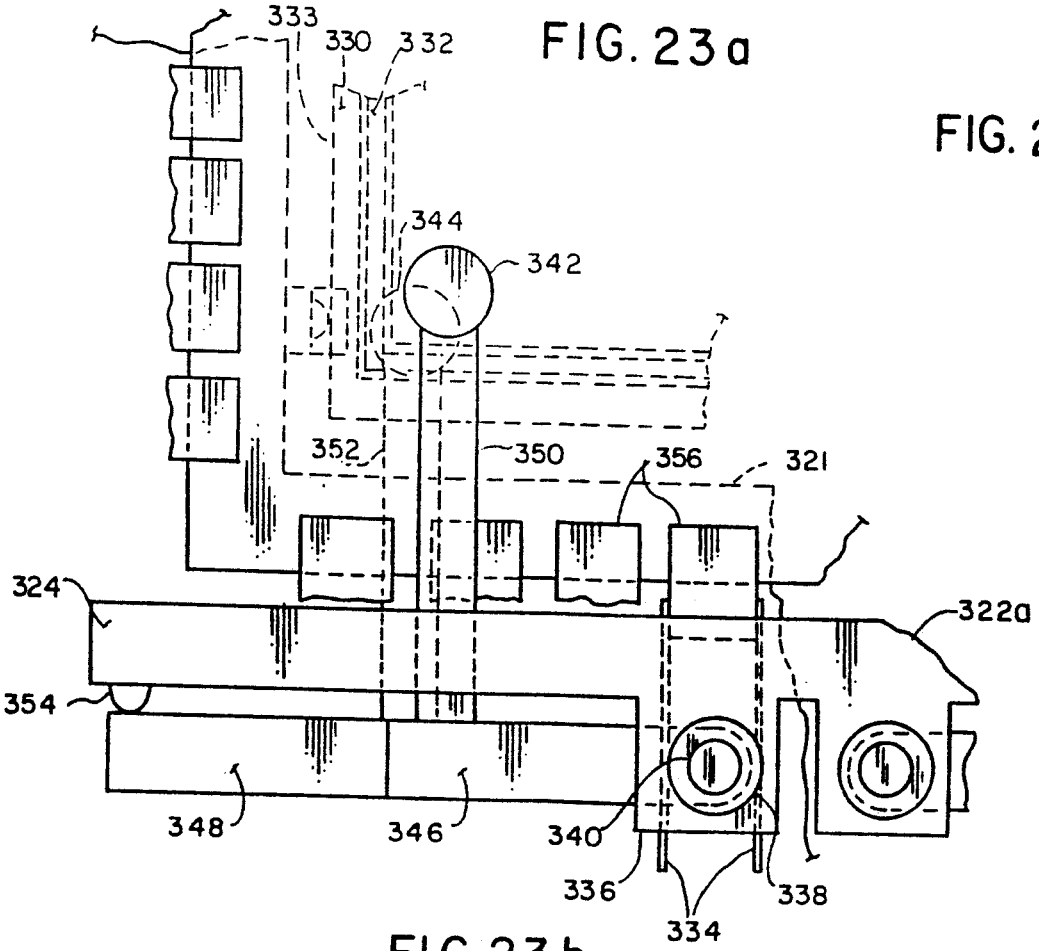
FIG. 23b

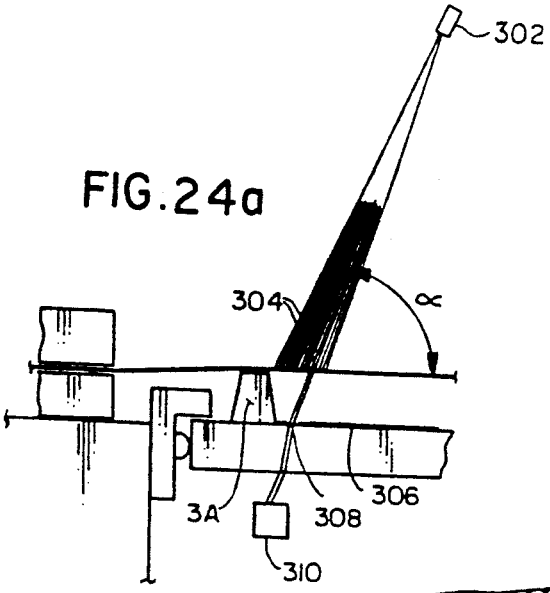
FIG.24a
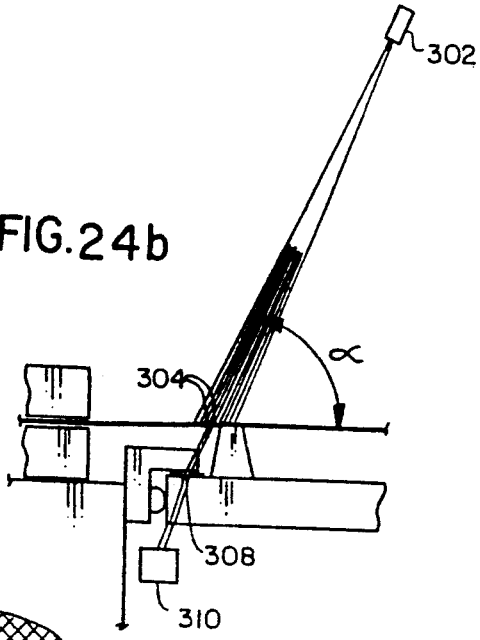
FIG.24b
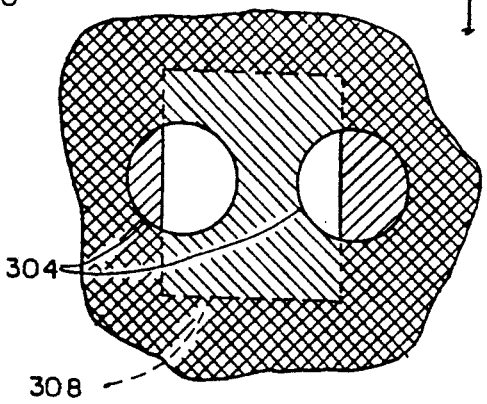
FIG.24c
FIG. 24
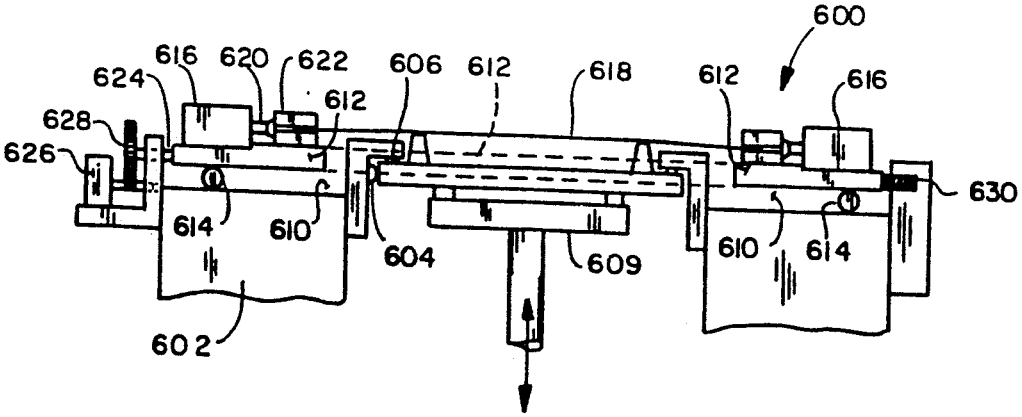
FIG. 25

SYSTEM FOR REGISTERING AND ASSEMBLING TENSION MASKS AND CRT FACEPLATES

RELATED APPLICATIONS

This application is a continuation-in-part of our U.S. Ser. No. 562,523 filed on Aug. 3, 1990, entitled "METHOD AND APPARATUS FOR MAKING FLAT TENSION MASK COLOR CATHODE RAY TUBES", now U.S. Pat. No. 5,059,147, which is a divisional application of our U.S. patent application Ser. No. 370,204, filed Jun. 22, 1989, now U.S. Pat. No. 4,973,280; which in turn is a continuation-in-part of our U.S. patent application, U.S. Ser. No. 223,475 filed on Jul. 22, 1988, now U.S. Pat. No. 4,902,257 issued Feb. 20, 1990. This application is also related to our co-pending U.S. patent application, Ser. No. 799,590, filed Nov. 27, 1991, entitled "OPTICAL INSPECTION OF INTERCHANGEABLE TENSION MASKS AND FACEPLATES FOR CATHODE RAY TUBES". All these applications are assigned to the assignee of the present invention.

BACKGROUND OF THE INVENTION

The invention applies to the manufacture of flat tension mask color cathode ray tubes. More specifically, the invention provides means for achieving registration of the aperture patterns of flat tension shadow masks and related cathodoluminescent screens.

In particular, the invention relates to a portion of the process steps employed in the manufacture of the front glass panel assembly of a flat tension mask color cathode ray tube. The front glass panel assembly includes a glass front panel, a support structure on the inner surface of the front glass panel and a tensed foil shadow mask affixed to the support structure.

In this specification, the terms "grille" and "screen" are used, and apply generally to the pattern on the inner surface of the front panel. The grille, also known as the black surround, or black matrix, is widely used to enhance contrast. It is applied to the panel first. It comprises a dark coating on the panel in which holes are formed to permit passage of light, and over which the respective colored-light-emitting phosphors are deposited to form the screen.

The holes in the grille must register with the columns of electrons passed by the holes or slots in the shadow mask. This is the primary registration requirement in a grille-equipped tube; the phosphor deposits may overlap the grille holes, hence their registration requirements are less precise.

In tubes without a grille, on the other hand, it is the phosphor deposits which must register with the columns of electrons. The word "screen", when used in the context of registration, therefor includes the grille where a grille is employed, as well as the phosphor deposits when there is no grille.

Historically, color cathode ray tubes have been manufactured by requiring that a shadow mask dedicated to a particular panel follow the panel through various states of the manufacturing process. Such a procedure is more complex than might be obvious; a complex conveyor system is needed to maintain the marriage of each mask assembly to its associated panel throughout the manufacturing process. In several stages of the process the panel must be separated from the mask, and the mating shadow mask cataloged for later reunion with its panel mate.

With the recent commercial introduction of the flat tension mask cathode ray tube, many process problems related to the curvature of the mask and panel have been alleviated or reduced. Necessarily, however, initial production of flat tension mask tubes has been based on continued use of the proven technology of mating a dedicated mask to a specific front glass panel throughout the manufacturing process. However, because the flat tension mask requires tension forces during the manufacturing process as well as after installation in a tube, somewhat cumbersome in-process support frames become necessary. These introduce complexity and expense in the manufacture of color cathode ray tubes of the tension mask type.

Thus the desirability of simplifying the conventional production process remains as great as ever in the manufacture of cathode ray tubes of the flat tension mask type.

It has been recognized that color tube manufacture would be simplified if any mask could be registered with any screen (commonly termed an "interchangeable" mask), so that masks and screens would no longer have to be individually mated. Yet to this day, no commercially viable approach suitable for achieving such component interchangeability has been implemented or disclosed.

| Known Prior Art | |
|---|---|
| 2,625,734 | Law |
| 2,733,366 | Grimm |
| 3,437,482 | Yamada, et al. |
| 3,451,812 | Tamura |
| 3,494,267 | Schwartz |
| 3,563,737 | Jonkers |
| 3,638,063 | Tachikawa |
| 3,676,914 | Fiore |
| 3,768,385 | Noquchi |
| 3,889,329 | Fazlin |
| 3,894,321 | Moore |
| 3,983,613 | Palac |
| 3,989,524 | Palac |
| 4,593,224 | Palac |
| 4,692,660 | Adler |
| 4,695,761 | Fendley |
| FR1,477,706 | Gobain |
| GB2,052,148 | Sony |
| 20853/65 | Japanese |

Article "Improvements in the RCA Three Beam Shadow-Mask Color Kinescope", Grimes, 1954, Proceedings of the IRE, January, 1954, pgs. 315-326.

According to the parent applications, a manufacturing apparatus and process for color cathode ray tubes of the flat tension mask type is described wherein shadow masks and front panels are respectively interchangeable during front panel assembly.

This method achieves practical interchangeability of shadow masks in the manufacture of flat tension mask color cathode ray tubes by providing automatic means for adjusting the postion size and/or shape of a mask such that its aperture pattern is brought into registration with a standard pattern.

More specifically, a method and associated apparatus is shown for changing a geometrical parameter of the mask pattern to achieve coincidence with a standard pattern which bears a fixed geometrical relationship to a predetermined screen pattern.

A position sensing means and a feedback control system is also shown and described in the parent application for applying controlled forces at a plurality of locations about the periphery of the mask for the purpose of moving the mask to a desired position and stretching it to a desired size and shape.

In both the parent applications an apparatus is schematically disclosed for changing the geometric configuration of the mask to achieve coincidence with a standard pattern that includes a stretching device consisting of clamps and links that applies a distribution of forces according to predetermined ratios around the periphery of the mask. It has been found that reduction rolling of the metal coils from which the masks are made, and particularly the rolling direction, appears to cause horizontal skewing during the initial stretching manipulation. The mask blank strain relieving process also appears to vary the position of the reference apertures in the mask from one mask to another.

It is an object of this invention to provide manufacturing apparatus for color cathode ray tubes of the flat tension mask type wherein shadow masks and front panels are respectively interchangeable during front panel assembly.

It is also an object of the invention to provide a system for achieving practical interchangeability of shadow masks in the manufacture of flat tension mask color cathode ray tubes by providing automatic means for adjusting the position size and/or shape of a mask such that its aperture pattern is brought into registration with a screen pattern.

It is a further object to provide such a system which compensates for screen position and geometry errors.

It is an object of this invention to provide, in a manufacturing process for color cathode ray tubes of the flat tension mask type wherein shadow masks and front panels are respectively interchangeable during front panel assembly, an apparatus for changing a geometrical parameter of the mask pattern to achieve coincidence with a screen pattern.

It is a principal object of the present invention to provide a completely automated system that includes an assembly system for flat tension masks and faceplates including a transport shuttle for conveying a face panel module and a mask module altenately to an assembly station where the mask and panel are registered to one another and joined, with a minimum of part movement.

It is also an object of the present invention to provide a complete assembly system for flat tension masks and panels with a transporting system that includes identical faceplate and mask modules that convey the masks and faceplates to an assembly station, where the modules are designed to facilitate registration at the assembly station.

It is a still further object of the present invention to provide a complete assembly system for flat tension masks and faceplates where the faceplate is interrogated at a faceplate loading station to determine the position of the faceplate bearing screen with respect to the faceplate module to eliminate the need to accomplish this task at the assembly station.

It is another object of the present invention to provide a complete assembly system for flat tension masks and faceplates where all of the optical interrogating devices are carried on mask and panel modules to eliminate swing frames for these optical devices at the assembly station.

It is still another objection of the present invention to provide a complete assembly system for flat tension masks and faceplates where fiducial marks are provided on the viewer side or the opposite side of the faceplate outside the perimeter of the faceplate screen to identify the location of the screen on the faceplate, and an optical system for sensing these fiducial marks.

BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

FIG. 14 consists of two plan views of a cathode ray tube screen showing two undesired screen conditions, including:

FIG. 14*a*, which is a simplified plan view illustrating a screen pattern position as translated and/or rotated with respect to its nominal position;

FIG. 14*b*, which illustrates a condition in which the screen pattern geometry is distorted, i.e., the size and/or shape of the pattern is distorted;

FIG. 15 is a perspective view of a panel holding fixture which makes possible adjustment of the position of the contained panel;

FIG. 18 depicts a grille aperture pattern as seen by a video camera and resulting pulse outputs, and comprises:

FIG. 18*a*, which is a plan view, greatly enlarged, of one corner of a grille;

FIG. 18*b*, which is a waveform indicating the horizontal output signal from a specific scan line; and FIG. 18*c*, a waveform indicating a vertical output signal;

FIG. 19 is a view in elevation of a representative section of a screen inspection machine designed specifically to accept a faceplate;

FIG. 21 is a partial view of an assembly machine providing for screen inspection and adjustment; and is composed of FIG. 21*a*, which is a view in elevation of representative section of the machine, and FIG. 21*b*, which is a view from the top of the machine;

FIG. 23 depicts a simplified version of the assembly machine of FIG. 21, and is composed of FIG. 23*a* which is a view in elevation of a representative section of the machine, and FIG. 23*b* which is a view from the top of the machine;

FIG. 24 depicts diagrammatically means for developing error signals which indicate directly the position differences between a shadow mask and a grille, and includes FIGS. 24*a* and 24*b*, which are views in elevation indicating the illumination of two specific apertures, and FIG. 24*c*, which is a greatly magnified plan view of the illuminated apertures;

FIG. 25 is an additional view of an assembly machine in which servo motors are mounted on a movable carrier;

DESCRIPTION OF THE PREFERRED EMBODIMENTS

General System Description

Figure 1:
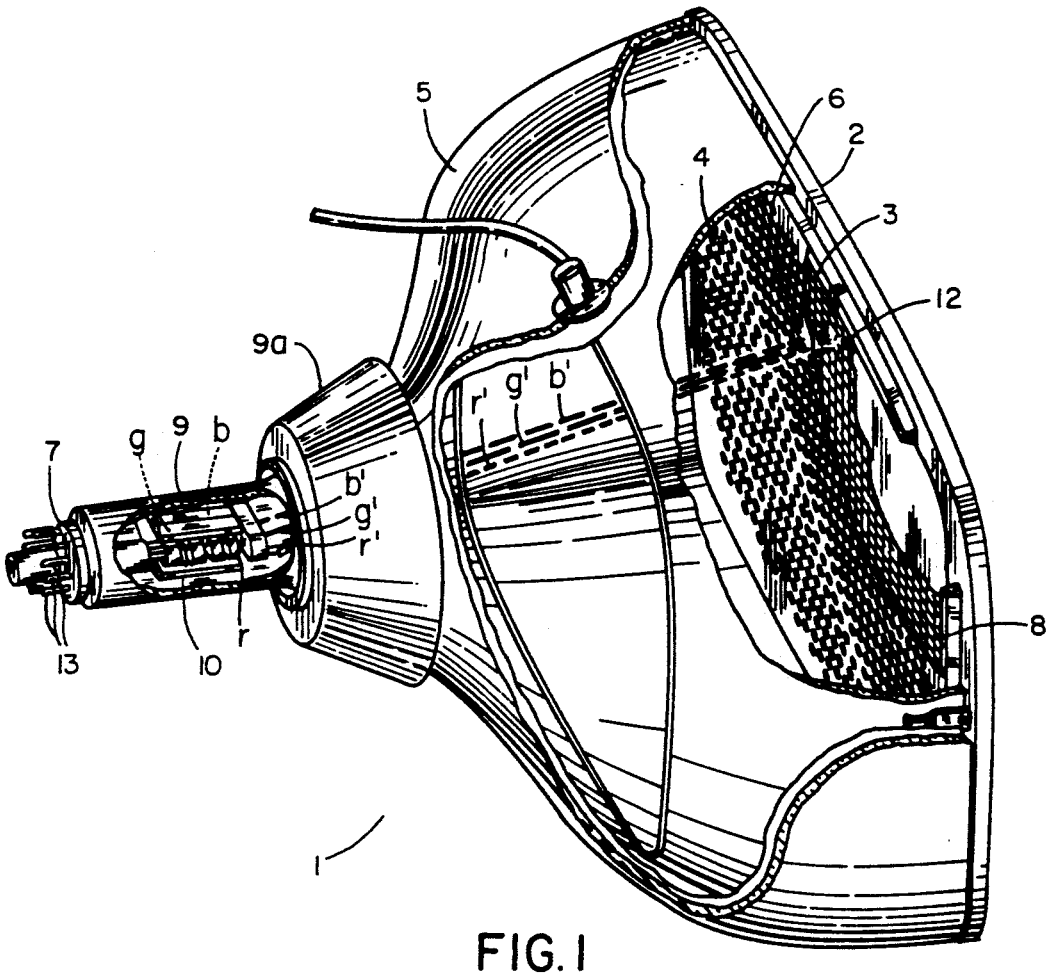
FIG. 1 illustrates a flat tension mask tube of the type with which this invention may be employed.

In our parent application, U.S. Ser. No. 223,475, filed Jul. 22, 1988, now U.S. Pat. No. 4,902,257; and its continuation-in-part, U.S. Ser. No. 370,204, filed Jun. 22, 1989, now U.S. Pat. No. 4,973,280; we describe and illustrate a variety of methods and apparati for registering a flat tension mask to a faceplate mounted screen with technology particularly adapted to achieve registration of interchangeable masks and faceplates.

The present invention follows many of the principles disclosed in these parent applications and proceeds further bringing these technologies to commercial production. According to the present invention a complete manufacturing system is disclosed for mating an undedicated flat tension mask to a face panel mounted screen, including: a) faceplate and mask loading, b) automatic shuttling of face panel and mask modules which carry the panel and mask alternately to a location beneath the assembly station, c) automatic lifting of faceplate and mask modules from the shuttle upwardly into the assembly station where they are registered with production accuracies, d) screen position interrogation with respect to the panel module, e) mask interrogation, and f) comparison of the tensed mask with respect to the panel module so that the location of the aperture array in the mask can be determined with respect to the actual location of the screen on the face panel in order to achieve true production registration consistency.

The term "registration" as used in this application ultimately is used to describe the alignment of apertures in the mask with phosphor spots on the faceplate carried screen, but to achieve that end it is necessary to properly align the panels and masks both with respect to their transport modules and the assembly station and the definition of registration herein, when indicated, encompasses these preliminary alignments as well.

Toward these ends, the transport system for the mask and panel modules in the present interchangeable panel-mask system loads them into the assembly station from below. That is, the loading shuttle brings the panel and mask modules to a position immediately below and generally aligned with the assembly station, and a lift assembly raises the modules to the station where they are automatically registered with appropriate registration features at the station.

The Shuttle

A simple two position shuttle is provided for transferring both the mask module and panel module from their loading stations to the lift assembly with an absolute minimum of movement thereby optimizing machine cycle time. Toward this end, the shuttle moves linearly on tracks and has a mask module support at one end and a panel module support at the other. The length of the shuttle dictates that when its panel module support is at the panel loading station, its mask module support is under the assembly station, and conversely, when the mask module support is at the mask loading station, the panel module support is under the assembly station and over the lift assembly. With this arrangement, the panel module and mask module are transported from their loading stations to the assembly station by a common shuttle without sacrificing cycle time.

Furthermore, because the shuttle is located underneath the assembly station, it is conveniently close to the building floor thereby providing increased rigidity to the shuttle over top loading systems without any incremental increase in cost of supporting structure.

Mask And Panel Interrogation

In order to achieve production accuracies in an interchangeable panel-mask system, it is necessary to interrogate screen and mask locations for verification and registration control. According to one embodiment these interrogation functions are provided by camera arrays carried on the mask and panel modules. The camera arrays thus travel with the modules from their respective loading stations to the assembly station. Alternatively, the interrogation camera arrays may be physically separate from the modules and moved into position, as needed, by transport means. The camera arrays must then be provided with positioning means to assure their constant placement. In the embodiments disclosed in this application, the interrogation functions are provided by micro-television-type cameras, but it should be understood that at least in some cases these cameras could be replaced by other optical detecting devices such as quadrant detectors.

Camera Placement & Position Reference

When all the optical sensors, or cameras, are carried by the two modules, the mask and panel and their respective interrogation sensors are all referenced to the modules. This technique minimizes possible error resulting from the repeated, or cyclic, positioning of camera arrays which are physically separate from the modules. The modules when carrying the camera arrays then only need to be alternately registered to the assembly station frame. However, the present invention does not demand the cameras be mounted or carried by the modules. Adequate registration of all elements may be achieved with mechanical positioning of the cameras referenced to the panel module and assembly station frames.

Module Registration Maintenance at the Assembly Station

In a first embodiment, FIGS. 26–48, both the modules are provided with a pair of spaced gauging cameras that view a pair of fixed targets at the assembly station. These cameras are mounted at the same locations on each of the modules so the same two targets on the assembly station frame are viewed by the gauging cameras on both modules. In the event the registration features on the modules and the assembly station become worn or defective, these gauging cameras provide an appropriate indication thereof. While the gauging cameras primarily serve a monitoring function, it is also within the scope of the present invention that they be utilized with screen position sensors to convey screen location information to the control system to be utilized in registering the mask array to screen.

Mask Aperture Interrogation

The mask module also carries nine mask array cameras mounted immediately below its mask holding platform. These cameras examine nine apertures in the array and transmit position information to a control microprocessor to control a stretching system for stretching of the mask aperture array to a predetermined reference configuration which corresponds to the optical axes of the nine cameras. As previously mentioned, the cameras may also be located external to the module.

Panel/Screen Interrogation

The panel module carries, in one embodiment, screen interrogating cameras that examine spaced fiducial marks which are referenced to the position of the screen or grille located on the panel. When the fiducial marks are applied to the panel independently of the screen, e.g. the fiducial marks are applied to the viewer side of the panel, the location of the screen with respect to these fiducial marks is determined by a separate screen interrogation instrument. Alternatively, incorporation of the fiducial marks into master images used to photo-print the screen on the panel will result in a fixed relationship between the screen and the fiducial marks. The marks, which will be located on the screen side of the panel, may then be interrogated and the relationship of the screen thereto is already known. This screen-to-mark location data is transferred to, or stored, in a control microprocessor separately from the fiducial marks locator information provided by the panel module cameras, so the present system assumes the integrity of the stored information which relates fiducial marks to screen location.

Initial Mask-To-Panel Positioning

After the mask has been initially loaded in the assembly station the mask is gripped and stretched to an initial reference utilizing the above-described nine aperture array cameras as array sensors. This initial "stretch" may include in gross movements of the mask by moving the entire stretcher platform, and preferably occurs before the panel reaches the assembly station.

To do this, the panel fiducial mark cameras examine the fiducial marks after panel loading and while still at the panel station, and transmit that information to the control microprocessor, to be combined with the previously stored screen-to-mark relationship information. This interrogation yields sufficient information for preliminary in-gross movements of the stretcher platform to register the mask array to the screen even though the panel is not yet in the assembly station. This results in a saving in cycle time since otherwise these movements would have to await final positioning of the panel in the assembly station. Alternatively, of course, the panel may be suitably moved in-gross to align the screen axes thereon with the mask axes fixed in the mask stretching apparatus.

Final Registration Interrogation

One embodiment of the present system, however, does not assume that the preliminary interrogation of the panel fiducial marks and initial mask positioning are sufficiently precise to then join the panel to the mask. Rather, another pair of panel module cameras referred to herein as "moment-of-truth cameras" examine targets on the underside of the mask platform when the panel module is finally positioned at the assembly station.

The panel fiducial marks information, i.e., screen location, has been transmitted to the microprocessor. The moment-of-truth cameras then provide the location for closed loop motions of the mask platform with respect to the panel module. The mask location is compared by the microprocessor with the screen/panel module location, to verify registration or provide the final positioning control.

Assembly Station Lift and Registration

The identical registration of the mask and panel modules at the assembly station is another important aspect of the present invention.

In one embodiment, the lift assembly includes three vertical screw posts that engage the underside of the modules and raise them into engagement with the common registration features at the assembly station. These registration features include three radially disposed, downwardly facing "V"-grooves that cooperate with three similar ball-carrying "V" grooves on the top of the mask and panel modules. Each ball is retained in place by a small U-shaped leaf spring. After the lift assembly posts have raised the module registration balls near engagement, another set of balls are extended from each of the lift posts permitting the module to float horizontally as registration is completed to obtain a far superior registration repeatability than in earlier faceplate registration systems. An alternative embodiment includes a first stage gross lifting of the modules and a second stage fine lifting by a module carried lifter. Each module carries identical positioning means designed to aid in the movement and exact placement of the module against the assembly station frame.

Other objects and advantages of the present invention will appear more clearly from the following more detailed description.

Embodiments In Parent Applications

Returning to the more general description in our parent applications, this apparatus is for use in the manufacture of a color cathode ray tube having a shadow mask with a central pattern of apertures mounted in tension on a transparent flat front panel. The mask aperture pattern is in registration with a corresponding cathodoluminescent screen pattern on an inner surface of the panel. The front panel has mask support means secured to the screen-bearing inner surface of the panel along opposed edges of the screen pattern. The shadow masks and front panels are respectively interchangeable, according to the invention.

FIGS. 1 to 13 illustrate apparatus and method according to the parent application Ser. No. 223,475 now, U.S. Pat. No. 4,902,257, in which interregistry of a screen pattern with a tension mask aperture pattern is achieved by stretching or otherwise expanding the mask to a predetermined standard. FIGS. 14 to 25 illustrate method and apparatus also according to the parent application Ser. No. 370,204 filed Jun. 22, 1989 now, U.S. Pat. No. 4,973,280, principally focused on loading and shifting the mask relative to the screen in response to positive errors.

The apparatus essentially comprises optical screen reference means associated with a screen pattern on a front panel and indicative of the size, shape or position of the screen pattern. Optical mask reference means are associated with a mask aperture pattern on a shadow mask and indicative of the size or shape of the mask pattern. Means are provided for altering the size or shape of one of the patterns relative to the other. Control means including a feedback system is responsive to the mask reference means and the screen reference means and thus the size or shape relationship of said screen pattern and said mask pattern. The control means provides for controlling the expansion so that the mask reference means attains optical alignment with the screen reference means indicative of correspondence in size or shape between the mask and screen patterns in the geometric parameter. The apparatus includes means for securing the mask to the mask support means on the front panel with the mask and screen patterns in registration.

According to one embodiment of the present invention, an improved apparatus is provided for tensioning a metal foil shadow mask for a CRT that includes six to eight clamps along each side of the mask and an interrelated lated pyramidal or in-line ("wiffle tree") linkage assembly for each side that distributes the forces among the clamps according to predetermined ratios.

By applying a programmed ratio of forces among the clamping elements, the strain throughout the mask during tensioning or stretching is substantially equal. This facilitates the registration of "reference" apertures in the mask with corresponding reference positions.

It has been found that production consistency in mask registration can be achieved by aligning only a few, on the order of four to nine apertures in the mask with reference positions stored in memory. With this technique every aperture in the mask will be aligned with its associated grille aperture within 0.35 mils.

Registration is achieved by alternately stretching the mask and shifting the mask in gross relation to the faceplate (or visa-versa) to which it is to be attached.

Initial tensioning of the mask is provided by the present clamping apparatus to 25 to 26 newtons/cm. in both x and y directions utilizing apertures in the mask array as references. Additional array holes can be used as further references such as the mid-holes along each border row and the array central hole. These holes are viewed with video microscope assemblies and its video signals are processed and utilized by a microprocessor that compares the position of these reference holes in the mask to pre-stored reference values.

If the apertures are not all "captured" when compared to the reference values, which may also be displayed on adjustable cross hair monitors, a carriage for the stretcher and mask on the faceplate is shifted in three coordinates i.e. x, y and angular, until two or more apertures are brought to coincidence with a reference. This capturing or orienting rigid body motion is called installation error. It constitutes by far the largest motion component in the registration process.

At this stage in the alignment process, the maximum deviation of the remaining apertures from the reference values is on the order of 1 mil. This "size" deviation appears to be a strong function of variations in the mask blank strain relieving process.

After the "capturing" and "orienting" motions are performed, the mask is stretched differentially in x and y directions, in response to the extent of deviation of the remaining apertures from their corresponding desired reference positions stored in a microprocessor. This procedure eliminates "size" and "skewing" deviations such that an overstretch is made equal to an understretch.

Thereafter, position "optimizing" is effected by slight shifting of the mask carriage in toto or as a rigid body again in the three coordinate directions. This positioning is continued until the deviations of the reference apertures from the x and y coordinates of the corresponding reference positions are all about the same magnitude.

In the stretching assembly, articulation of the clamping assemblies on each side is accommodated through the "wiffle tree" linkage to control the shape of the force profile on each side. The linkage geometry provides (when eight clamps are provided on a side) equal pulling force to the four middle clamping assemblies on each side, approximately 1.3 times that value to the next adjacent outer clamping assemblies, and approximately 1.7 times that value to the outermost clamping assemblies at the corners of the mask. This force profile minimizes tears originating at the array corners of the mask which can be tensed to levels on the order of 30 newtons/cm. High array corner stresses are associated with the density difference between the mask array and its surrounding solid border.

FIG. 1 depicts a flat tension mask color cathode ray tube 1 including a glass front panel 2 hermetically sealed to an evacuated envelope 5 extending to a neck 9 and terminating in a connection plug 7 having a plurality of stem pins 13.

Internal parts include a mask support structure 3 permanently attached to the inner surface 8 of the panel 2 which supports a tension shadow mask 4. The mask support structure 3 is machine ground to provide a planar surface at a fixed "Q" distance from the plane of the inner surface 8. On the inner surface 8 of the panel 2 is deposited a screen 12 comprising a black grille and a pattern of colored light emitting phosphors distributed across the expanse of the inner surface 8 within the inner boundaries of the support structure 3. The phosphors, when excited by the impingement of an electron beam, emit one of red, green and blue colored lights.

The shadow mask 4 has a large number of beampassing apertures 6 and is permanently affixed, as by laser welding, to the ground surface of the support structure 3.

In the neck 9 of the tube 1 is installed a cluster 10 of three electron guns identified as r, g and b. The electron guns emit three separate electron beams designated as r', g' and b' directed toward the mask 4. The electron beams are electronically modulated in accordance with color picture signal information. Deflected by magnetic fields produced by a yoke 9*a* external to the tube, the electron beams r', g' and b' are caused to scan horizontally and vertically such that the entire surface of the mask 4 is swept in a periodic fashion to form an image extending over substantially the entire area of the screen 12 within the inner boundaries of the mask support structure 3.

At positions on the mask 4 where there is an aperture 6, each of the three electron beam passes through the mask and impinges on the screen 12. Thus, the position of the mask 4 with its pattern of apertures 6, the positions of the electron guns r', g' and b' at 10, and the height of the support structure 3 control the locations where the electron beams r', g' and b' impinge on the screen 12.

For proper operation of the tube 1, there must be on the screen 12, a light emitting phosphor deposit of the proper color characteristic corresponding to the color information of the impinging electron beam r', g' or b'. Further, for proper operation, the center of the area of impingement of the electron beam must coincide within a narrow tolerance with the center of the associated phosphor deposit.

When these conditions are met over the entire surface of the screen, then mask and screen are said to be registered.

The rectangular area within which images are displayed, i.e. the area covered by the electron beams on the screen, is larger than the corresponding area on the mask through which those electron beams pass; the linear magnification from mask to screen is on the order of a few percent. Detailed studies have shown that this magnification varies slightly across the screen. Therefore, when a phrase such as "registration between mask and screen patterns" or "registration between the apertures pattern of the mask and the screen pattern" is used in this specification, it does not mean that the two patterns are congruent like a photographic negative and its contact print. Rather, it means that the two patterns are related to each other as required in a color tube of the flat construction described, using a support structure of predetermined height and having a predetermined spacing from mask to screen. Such registration of mask and screen is with respect to the electron beam center of deflection.

In a flat tension mask tube, the tension mask is typically made of steel foil about 0.001 inch thick. The mask is under substantial mechanical tension; the stress may be between 30,000 and 50,000 pounds per square inch. The mask is therefore stretched to a significant degree, the elastic deformation exceeding one part in one thousand, e.g. the conventional flat tension mask manufacturing method puts each mask into an elastically deformed condition before producing, by photolithography, the screen which will be used with that mask.

The embodiments call for all screens to be made from a common master so that they are interchangeable. They also recognize that the unstretched masks, as mentioned earlier, are very nearly alike, and it takes advantage of the elastic deformation of a mask that occurs when a mask is stretched. By applying controlled forces to a plurality of clamps gripping peripheral portions of the mask, each mask may be stretched in such a manner that its size and shape conform to a predetermined standard. If desired, the required forces may be substantially reduced by heating the mask during the stretching process.

Figure 2:
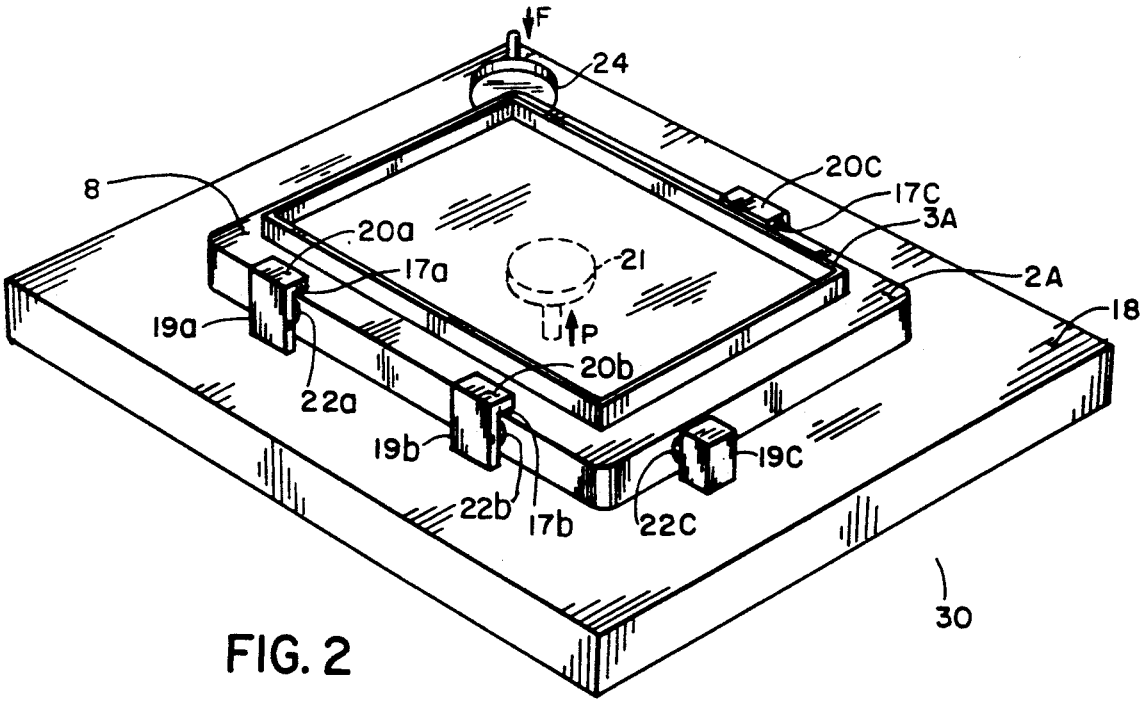
FIG. 2 illustrates a universal holding fixture.

FIG. 2 describes a six-point universal holding fixture 30 for glass front panel assemblies to be used during all manufacturing processes requiring reproducible positioning of a panel 2A in reference to an established set of datum coordinates. Panel 2A, carrying mask support structure 3A, is shown on a fixture plate 18 using a holding method comprising three half-ball locators 22*a*, 22*b*, 22*c*, attached to posts designated as 19*a*, 19*b* and 19*c*, to control lateral position, while three vertical stops 20*a*, 20*b* and 20*c* control vertical postion. Vertical stops 20*a*, 20*b* and 20*c* are provided with firm but relatively soft contact surfaces 17 made of a material such as Delrin (TM) to protect the inner surface of panel 2A. A pressure device 21, shown in phantom lines below panel 2A, exerts an upward vertical force P to assure firm contact between the inner surface and three vertical stops 20*a*, 20*b* and 20*c*. A second pressure device 24, exerting a horizontal force force F in the direction toward the corner between posts 19*b* and 19*c*, assures firm contact between the panel 2A and the three half-balls, 22*a*, 22*b*, 22*c*.

Vertical stops 20*a* and 20*b* are co-located with posts 19*a* and 19*b*, but the third vertical stop 20*c* is completely separated from post 19*c*.

Figure 3:
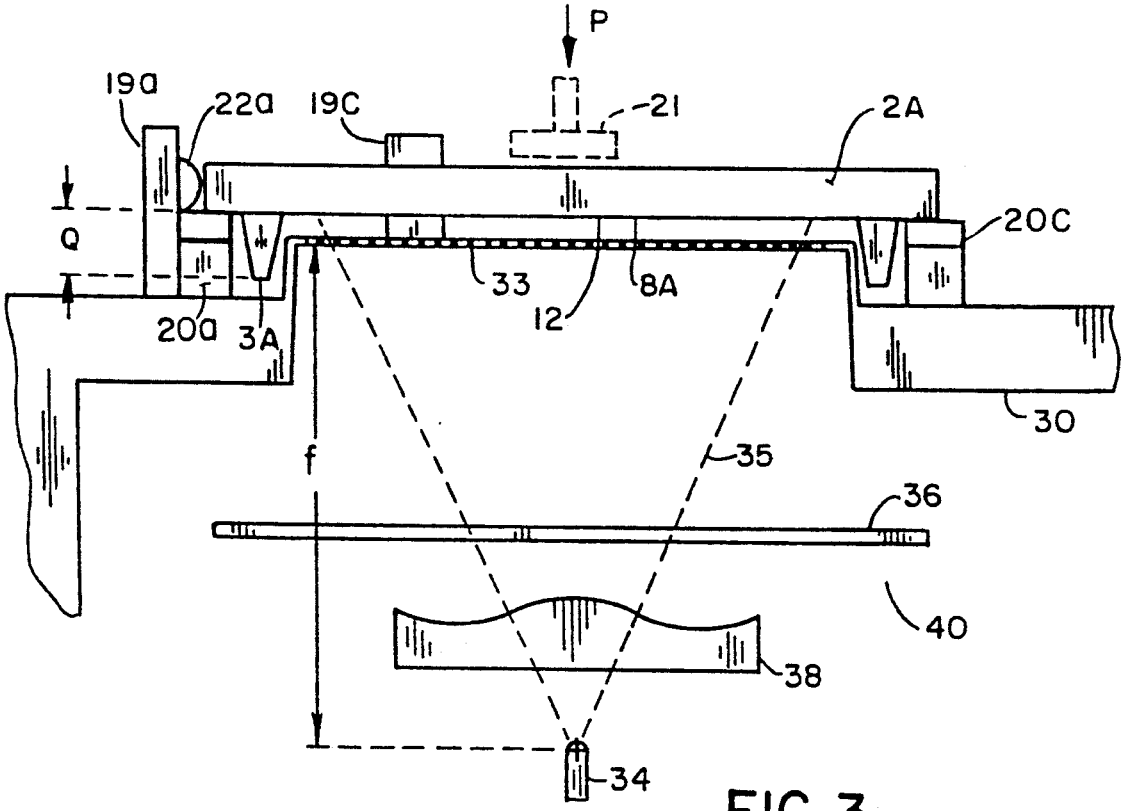
FIG. 3 is a modified version of the universal holding fixture depicted in FIG. 2, adapted for use with a lighthouse.

By controlling within close limits the position of the three half-ball locators 22*a*, 22*b*, 22*c*, as well as the plane defined by the three vertical stops 20*a*, 20*b*, 20*c* in different work stations in the manufacturing process, the position of a given panel in each of such work stations may be accurately duplicated. FIG. 3 illustrates a modification of the universal holding fixture 30 adapted to a lighthouse 40. It will be noted that panel 2A and vertical stops, two of which are depicted (20*a* and 20*c*) have been inverted while posts, two of which are depicted at 19*a* and 19*c*, remain upright to allow insertion of panel 2A from above. Pressure device 21 is optional in this modification, since the weight of panel 2A may suffice to ensure proper seating on the vertical stops.

As is well known in the art of manufacturing color cathode ray tubes, a lighthouse is used for photoexposing light-sensitive materials applied to the inner surface 8 of a panel 2A. Four separate exposures in four different lighthouses are needed to produce the black background pattern and the three separate colored light emitting phosphor patterns which comprise the screen 12. Photoexposure master 33 is permanently installed in lighthouse 40, with the image-carrying layer facing upward and spaced a very small distance (0.010", e.g.) from the inner surface of panel 2A. At a fixed distance "f" from the plane of the photoexposure master 33 is placed an ultraviolet light source 34 which emits light rays 35 which stimulate the electron beam paths in a completed tube.

A shader plate 36 modifies the light intensity over the surface of the mask so as to compensate for the variation of distance from the light source and for the variation of the angle of incidence, thereby achieving the desired exposure in all regions. Lens 38 provides for correction of the paths of the light rays so as to simulate more perfectly the trajectories of the electron beams during tube operation.

Experience has indicated that screen patterns produced by following the procedures just described are sufficiently accurate for use in high resolution tubes, provided that the Q height of support structure 3, measured from the inner surface 8A of panel 2A to the machine ground top surface of the support structure, is held to a very close tolerance.

Figure 4:
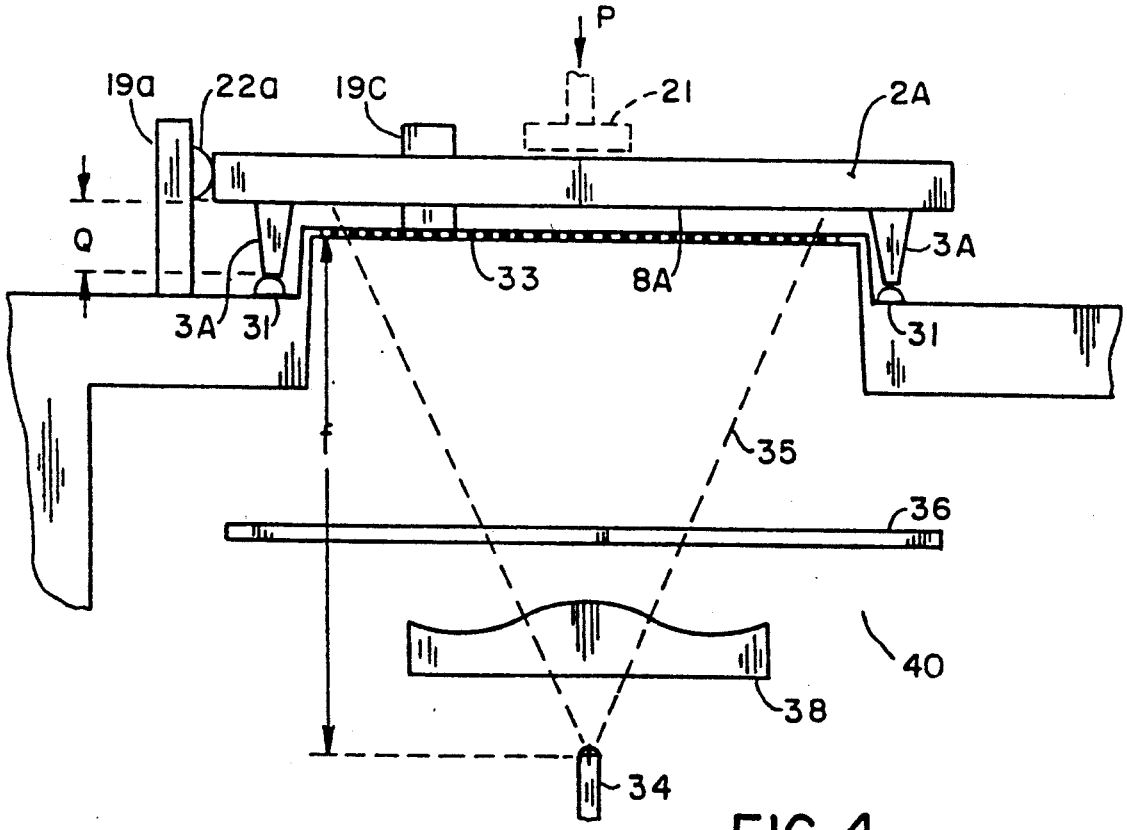
FIG. 4 is a modification of the apparatus depicted in FIG. 3 which accommodates a wider tolerance in the Q height of the mask support structure.

A modification of FIG. 3, depicted in FIG. 4, accommodates a wider tolerance in the Q height of the mask support structure. Here the vertical stops are replaced by half-balls 31, and the panel 2A rests, not on its inner surface, but on the ground top surface of support structure 3A. If, for example, that structure on a given panel is 0.002" too high, that panel sits that much higher during exposure, and the light pattern recorded on it is larger than normal. This is exactly what is required; when a mask is eventually affixed to this support structure, it will be 0.002" farther away from the panel, causing the electron beams also to form a larger pattern and thus compensate for excess vertical height Q. In effect, then, an interchangeable screen is produced in spite of the 0.002" error in support structure height Q.

The process for producing the screen pattern described in connection with FIGS. 3 and 4 differs from the conventional process in that for each of the four photo exposures, a permanent master is used rather than an individual mask uniquely associated with a particular screen. However, because this invention makes it unnecessary to match each screen to a particular mask, other more economical processes may be used to manufacture the screen pattern. Well known printing processes such as, for example, offset printing are particularly well adapted to producing the required precise screen pattern on flat glass plates. The important aspect of using offset printing is that four separate processes of photo exposure, development and drying, followed by coating for the next process, are no longer required. In effect, offset printing offers the possibility of inexpensively producing an interchangeable screen pattern as required by this invention.

If offset printing or similar process is employed, the height Q of support structure 3A must be controlled to an accuracy appropriate to the special requirements of this application.

Figure 5:
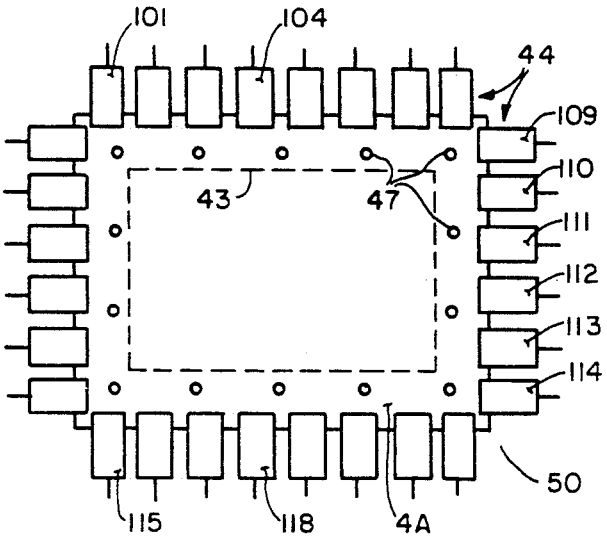
FIG. 5 schematically illustrates a machine for adjusting the size, position, and/or shape of a shadow mask in accordance with the principles of this invention.

FIG. 5 depicts schematically a machine 50 for applying controlled forces to a plurality of clamps gripping peripheral portions of the mask, capable of moving and elastically deforming the mask until its position, size and shape conform to a predetermined standard. The machine is also equipped to move a screened panel into a specified position adjacent to the mask and to weld the mask to the support structure; these features, not shown in FIG. 5, will be described in detail later.

FIG. 5 depicts a rectangular, in-process shadow mask 4A having a wide peripheral portion. This is the form in which the mask emerges from the photoetching process. The central apertured region of the mask is bounded by rectangle 43. Outside this rectangle and surrounding it there is a row of widely spaced position sensing apertures 47. Optical markers attached to machine 50, to be described in detail later, serve as position references and present in this embodiment, the aforediscussed predetermined standard. It is the task of machine 50 to apply a distribution of forces to the mask such as to bring all apertures 47 into coincidence with their corresponding optical markers.

Located around the periphery of mask 4A is an array of clamps 44 which may each comprise a pair of actuatable jaws. For purposes of illustration, twenty eight clamps are depicted. The reason for having a plurality of clamps on each side is that the individual clamps must be free to move apart as needed when the mask is stretched. The same plurality also permits application of a desired distribution of forces about the periphery of mask 4A.

It must be kept in mind that the apertured central region of the mask inside rectangle 43 has an average elastic stiffness considerably smaller than that of the solid peripheral portion. Since it is desirable in the stretching process to essentially maintain the rectangular configuration of the central apertured region, stretching forces must be graded, with the magnitude of each force related to the local elastic stiffness encountered at each clamp 44. For example, the opposing clamps 101 and 115 act on solid material at one end of the mask; they therefore require considerably greater force than opposing clamps 104 and 118 which act on a portion containing largely apertured material.

Figure 6:
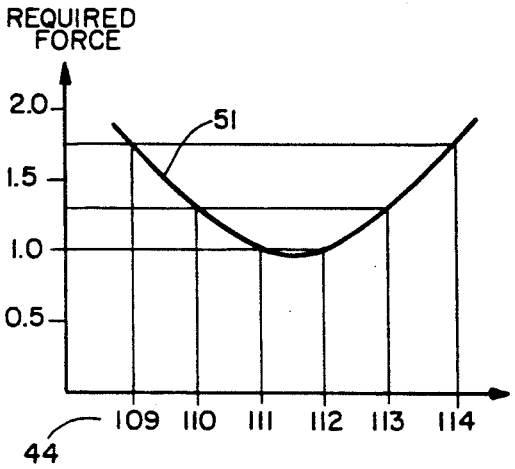
FIG. 6 is a curve representing the distribution of required forces along one edge of a shadow mask.

FIG. 6 depicts a curve 51 representing the distribution of required force along one edge of mask 4A. It is seen that the force required near the corners is about 70% higher than near the center.

Figure 7:
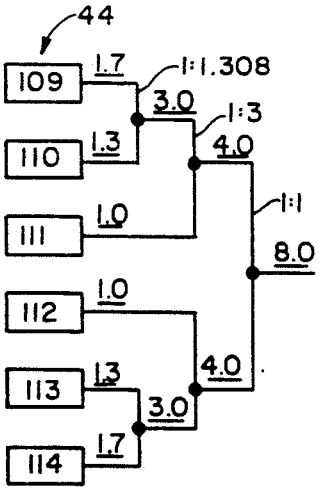
FIG. 7 illustrates the use of levers to distribute forces along edges of a mask.

FIG. 7 illustrates the use of levers to distribute forces according to predetermined ratios. The figure shows six clamps labeled 109–114, assumed to be attached to one of the short edges of the mask. The desired ratio of force are, in this example: 1.7, 1.3, 1, 1, 1.3, 1.7. Forces along the pull rods are underlined in the figure; the figures associated with the levers indicate lever ratios. It is seen that any desired ratio of forces for any desired number of clamps along one edge can be so generated.

Figure 8A:
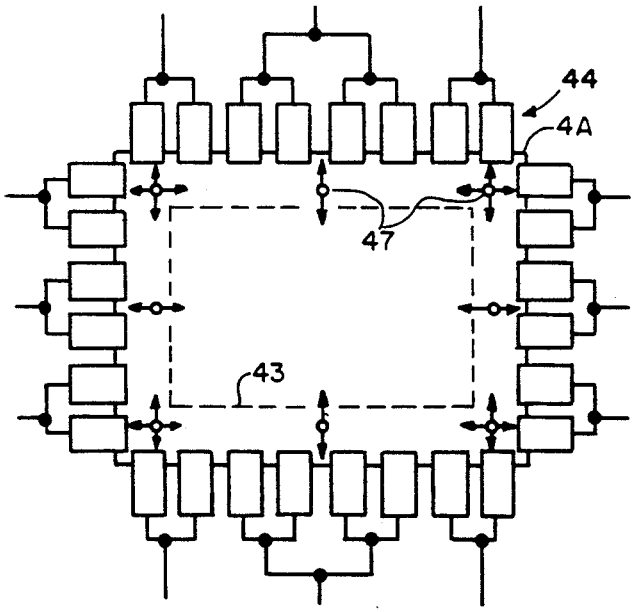
FIG. 8*a* depicts a modification of a FIG. 5 apparatus having a reduced number of independently variable applied forces.
Figure 8B:
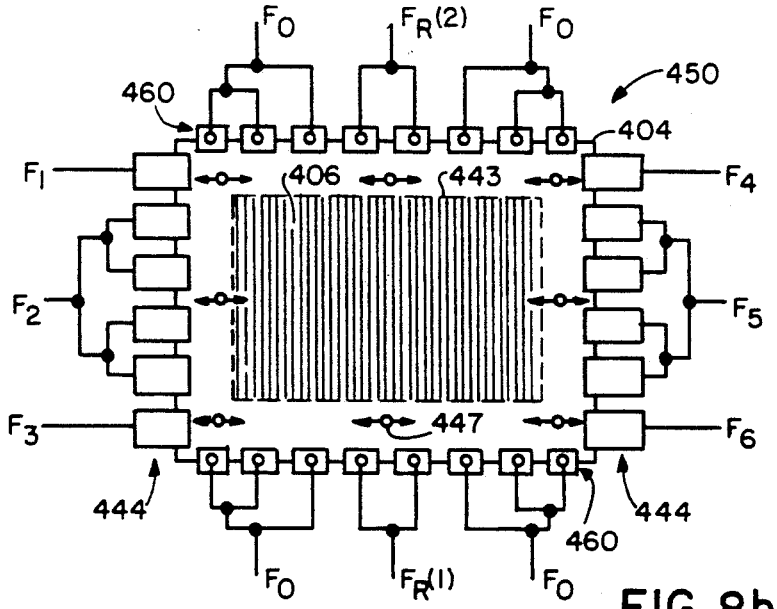
FIGS. 8*b* and 8*c* depict a variant of the FIG. 8*a* embodiment which has provision for the application of tangential forces to the edge of a mask.

FIG. 8A illustrates a modification of FIG. 5, where there are still twenty-eight clamps but only eight position sensing apertures 47, and a total of twelve independently variable forces. Adjacent clamps are interconnected by levers as just explained, with the result that there are just three independent forces along each side. The four position sensing apertures located in the corners are designed to detect position errors along both the x and y axes; those four apertures positioned near the center of each side respond only to radial, i.e. inward or outward displacements. Thus the total number of position error signals is twelve, equal to the number of independently controllable forces.

In addition to applying forces which act at right angles to the edges of the mask, it may sometimes be desirable to apply tangential forces in a direction parallel to an edge. FIG. **8*b* illustrates such an arrangement, using as an example a tension mask in which apertures 406 within boundary 443** are parallel slots rather than round holes. Slotted masks are commonly used in color cathode ray tubes intended for television receivers. The slots conventionally run along the vertical (y) direction; they are not continuous from top to bottom, but are bridged at regular intervals by tie-bars to increase the mechanical stability of the mask.

In a color cathode ray tube of the flat tension mask type, a similar pattern of apertures, i.e. slots parallel to the y-axis, bridged at regular intervals, may be used. Only the x-coordinate of the mask pattern need register with the screen pattern, assuming the phosphorstripes are continuous. Parallel to the slots, along the y-axis, high mechanical tension is applied; the amount of this tension is not critical so long as the elastic limit of the mask material is not exceeded. Along the x-axis, a carefully controlled amount of tension is applied; because the mechanical stiffness of the delicate bridges (not shown) is rather small, the tension in this direction must also be low.

Machine 450 in FIG. **8*b* is designed to apply controlled forces, including tangential forces, to a slotted mask 404. Along the two vertical edges, clamps 444** are pulled outwardly by forces acting at right angles to those edges. The four clamps located near the middle of each edge are interconnected by levers. Six independently controllable forces $F_1$ through $F_6$ are applied to these two edges.

Turning now to the two horizontal edges, predetermined forces $F_O$ which need not be controlled by feedback are applied at right angles to these edges near the four corners of the mask. However, the two middle clamps on each horizontal edge are pulled generally outward by forces $F_R(1)$, $F_R(2)$ which are not perpendicular to the edge but have a controllable tangential component.

FIG. **8*c* shows how such a force may be generated. Two stepper motors 424*a* and 424*b* are mounted on frame 432 of machine 450 under angles of plus and minus 45 degrees, as indicated. The motors carry reduction gears 428*a*, 428*b*, terminating in pull rods 431*a* and 431*b*, respectively. A third pull rod 430, linked to the first two pull rods by springs 425*a*, 425*b*, connects to the lever which drives the two middle clamps. Clamps 460 along the horizontal edges are constructed somewhat differently from clamps 444**. They are pivoted as shown so as to permit the application of tangential force components without producing local moments at the edge of the mask.

In operation, the two motors are caused to advance their respective pull rods **431*a*, 431*b*, until a predetermined force $F_O$ is generated on pull rod 430**. This force acts at right angles to the edge, and its exact value is not critical.

Figure 8C:
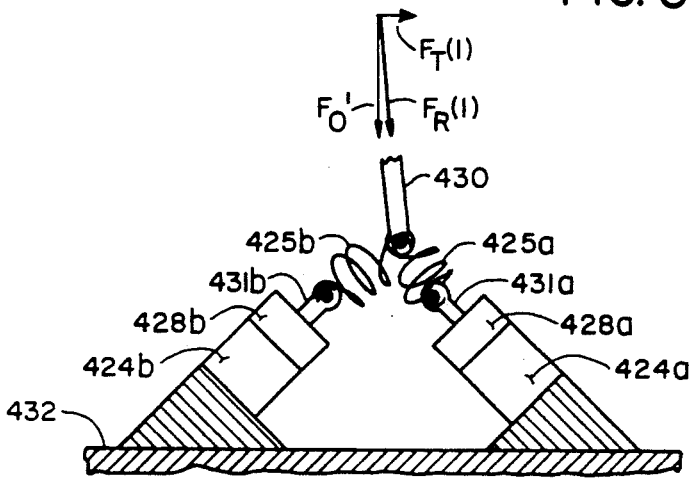

Assume now that to compensate for a variation in mask thickness, the center portion of the mask needs to be pulled to the right as illustrated by $F_R(1)$ shown in FIG. **8*b*. To this end, stepper motor 424*a* is advanced so that its pull rod 431*a* is pulled closer to the frame. At the same time, motor 424*b* is backed up so that pull rod 431*b* is extended beyond its normal position. As a consequence, the lower end of pull rod 430 moves to the right, and a tangential force component $F_T(1)$ is generated. This, together with the perpendicular component $F_O$, produces the desired resultant force $F_R(1)$. Eight position sensors (not depicted) using position sensing apertures 447 are designed to respond solely to positioning errors in x. There are also eight independently controllable forces: $F_1$ through $F_6$, and the two tangential components $F_T(1)$ and $F_T(2)$, of which only the first is shown in FIG. 8*c***.

Figure 9:
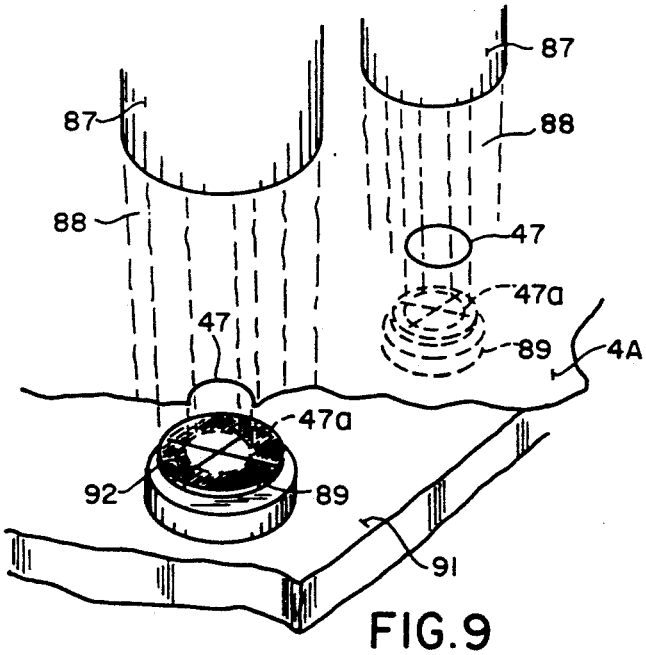
FIGS. 9 and 10 illustrate a quadrant detector optical sensing system for sensing the location of sensing holes in a mask under tension, relative to reference points independent of the mask.

FIG. 9 illustrates the principle of operation of a commercially available quadrant detector optical sensor 89 which may be used in machine 50 to generate the needed positioning error signals. Such a sensor is sold by United Detector Technology of California and consists of a semi-conductor chip having a photosensitive region in the shape of a circular disc which is divided into four 90 degree sectors. The photocurrent from each sector is separately available externally.

In FIG. 9, mask 4A is assumed to be in the correct state of tension with the position sensing apertures 47 in registration with optical detection light sensors 89. Each aperture 47 is fully illuminated by a light source 87 emitting a light beam 88. Light beam 88 may be produced by a laser or by a more conventional optical source.

A plurality of quadrant detector light sensors 89 is mounted on a plate 91 whose position with reference to the frame of machine 50 is precisely defined, as described in detail later in connection with FIG. 13. The active area 92 of the quadrant detector light sensor is in vertical alignment with the desired position of position sensing aperture 47. The illuminated area 47*a* represents the image of aperture hole 47 projected on active surface 92 of quadrant detector light sensor 89.

The diameter of light beam 88 is larger than the diameter of the active area 92 of quadrant detector light sensor 89, while the diameter of position sensing aperture 47 is substantially smaller. If a position sensing aperture is in exact concentric alignment with the active area 92 of its quadrant detector light sensor 89, all four sectors produce the same photocurrent; a matrixing circuit well known in the art, designed to indicate any unbalance between the sector currents, will then indicate zero position error in both x and y coordinates. More specifically, the matrixing circuit provides two outputs. The first indicates the difference between the sum of the two left sector currents and the sum of the two right sector currents; this indicates an error in the x coordinate. The second output indicates the difference between the sum of the two upper sector currents and the sum of the two lower sector currents, thereby signaling an error in the y coordinate.

Figure 10:
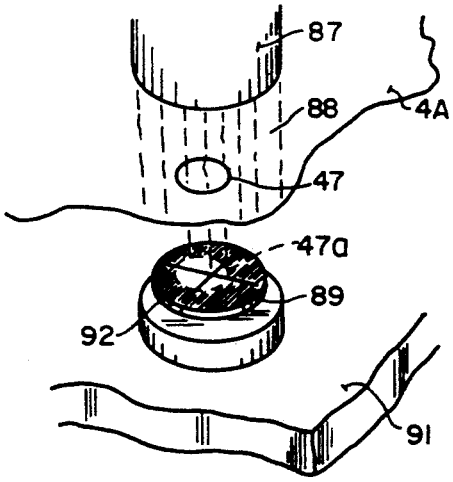

FIG. 10 illustrates a condition where a position sensing aperture 47 is not aligned with the active area 92 of quadrant detector sensor 89; therefore, the projected image 47*a* is not aligned, the four sectors are unequally illuminated, and a non-zero output signal is generated. In the specific case, the sum of the left sector currents is larger than that of the right sector currents, producing an output in the x coordinate indicating that aperture 47 is too far to the left.

Figure 11:
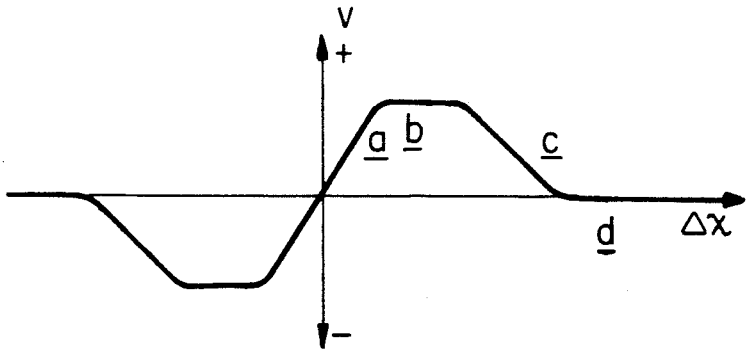
FIG. 11 is a curve showing the output voltage from a matrixing circuit forming part of the quadrant detector optical sensing system.

FIG. 11 indicates the output voltage V from a matrixing circuit of the type described, plotted against the displacement delta x of the aperture. The steep center portion a corresponds to displacements smaller than the radius of position sensing aperture 47. For larger displacements, the output becomes constant (shown at b). Further displacement causes the image of position sensing aperture 47 to cross the edge of active area 92; the output, shown at c, decreases and reaches zero d as the image of aperture 47 leaves the active area. The distance between point d and the center of the plot indicates the maximum positioning error which this particular sensor and position sensing aperture combination can read.

Optical detection is by no means the only way of determining position errors. For example, very precise position measurements can be made using a combination of air nozzles, mask apertures and flow or pressure gauges.

The position error signals are utilized, as previously explained, to correct any errors in mask position and orientation, to stretch the mask and to adjust its shape. Some of these operations may require certain clamps 44 to back up, i.e. to provide slack so that other clamps can move outward without increasing mask tension. However, the force exerted by each clamp always remains directed outward; backup is achieved by reducing the force exerted by one clamp momentarily below the force of the opposing clamp or clamps.

The required pulling forces may be produced by hydraulic, pneumatic or electric drives. For example, as depicted herein, electric stepper motors, geared down so as to produce large force with small displacement, are well adapted to be driven by computer controlled pulses. To produce an adjustable force rather than a controlled displacement, a spring may be inserted between motor and clamp.

It should be remembered that in practice, one motor may drive a plurality of clamps through a force distributor such as the one depicted in FIG. 7.

According to the invention, computer means are provided for adjusting the force produced by each motor or other force generator. If there were only one motor and one error-sensing means, the feedback loop would be a simple servo and no computation would be needed. The same would be true if each motor influenced only the positioning error of one coordinate in one particular sensor location; a separate loop would then be required for each motor-sensor pair, but there would be no interaction between pairs.

In practice, the situation is more complex; each motor causes displacements at most or all sensor locations. These displacements are largest close to the clamp driven by the particular motor, and much smaller elsewhere but if there are several or many independent motors, these contributions add up. Each such contribution can be characterized by a matrix coefficient, and for a given configuration of motors, clamps and sensor locations, these coefficients can be determined once and for all, and stored in computer memory. The problem of determining the values of the N forces required to reduce N position errors to zero is then merely that of solving N simultaneous linear equations, a task easily and rapidly performed by a computer.

The clamps used to transmit the controlled forces to the periphery of the mask must be capable of withstanding a pulling force of the order of 30 pounds per inch of width, with a sufficient safety margin. Uncoated steel jaws may be used, in which case clamping forces of several hundred pounds are needed for clamps about one inch wide; elastomeric coatings greatly reduce this requirement but may introduce an element of wear. Hydraulic drives are well adapted to produce the large static force required upon closure. The jaws are preferably held open by relatively weak springs when hydraulic pressure is not applied. During normal operation of machine 50, jaw pressure is applied or released in all clamps at the same time, so that only a single valve is required to apply or remove hydraulic pressure.

Figure 12:
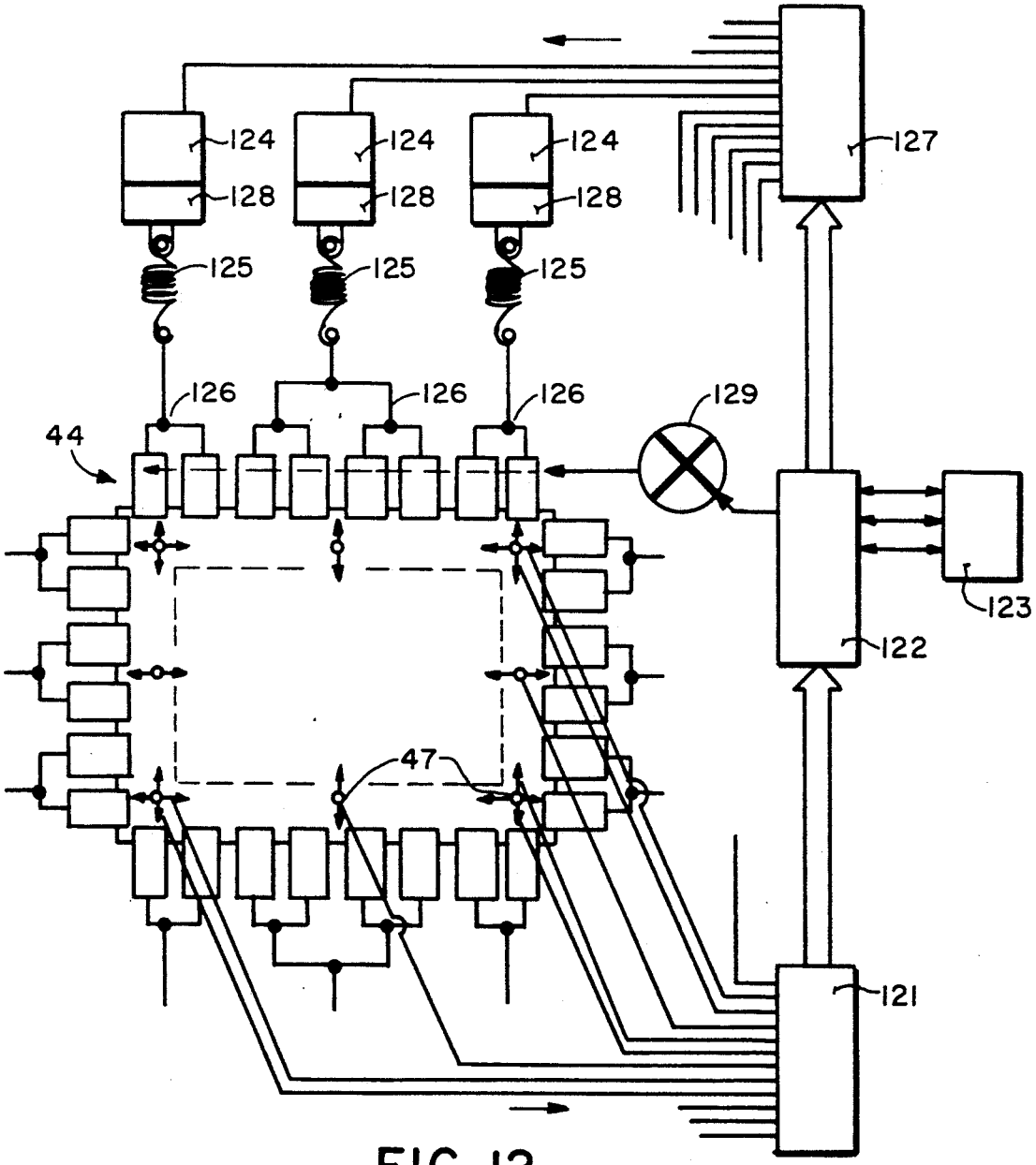
FIG. 12 is a schematic representation of a system including multiple feedback loops.

FIG. 12 is a schematic representation of the multiple feedback loops above-described. Position error signals from position sensing apertures 47 and quadrant detector light sensors 89 are analog signals; they are converted to digital signals in analog/digital converter 121 and are then sent to computer 122. The computer, having the appropriate matrix coefficients stored in its memory 123, calculates the forces to be generated by stepper motors 124 and, based on the known constants of springs 125 and of the force distribution system 126 which transmits the force generated by each motor to several clamps 44, computes the number of steps by which each motor should be advanced or retarded. It also generates the appropriate number and type (forward or backward) of pulses. These pulses are amplified in power amplifiers 127 and applied to the motors 124 which are equipped with reduction gears 128.

The computer also controls the opening and closing of hydraulic valve 129 which applies hydraulic pressure to clamps 44, forcing the jaws to close when the mask is to be clamped and allowing them to open when the mask is to be released.

Figure 13A:
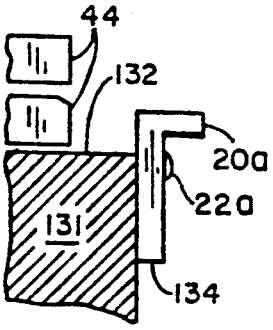
FIGS. 13*a*–13*f* illustrate an apparatus and method for carrying out a mask mounting process.
Figure 13B:
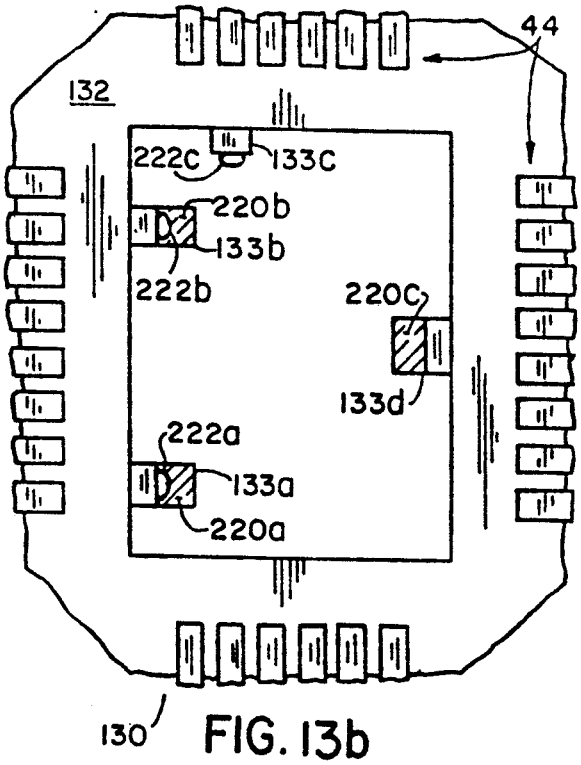

The arrangement described in connection with FIG. 12 lends itself to the process of bringing the mask into registration with a predetermined standard pattern. FIGS. 13*a* and 13*f* illustrate an environment in which this arrangement is used to manufacture mask-panel assemblies for flat tension mask color cathode ray tubes. It is to be understood that the machine 130 depicted in FIGS. 13*a*–13*f* comprises, or operates in connection with, the elements of FIG. 12.

The most important element of machine 130 is a rugged frame 131. One side of this frame is depicted in vertical section in FIG. 13*a*, and a view of the entire inside portion of the frame as seen from below is depicted in FIG. 13*b*. The top of the frame is a flat machined surface 132 on which clamps 44 can slide. The frame forms a window-like opening, somewhat smaller (for example, by one inch about both x and y) than the mask in its original, uncut form.

Four indexing stops 133*a*, 133*b*, 133*c* and 133*d* are shown as being attached to the inside of the frame. The stops 133*a* and 133*b*, placed symmetrically along a common edge, carry half balls 222*a*, 222*b*, as well as vertical stops 220*a*, 220*b*. The half-ball 222*c* is positioned around the corner from 222*b*, but the third vertical stop 220*c* is in the center of the edge opposite the 133*a* and 133*b* stops.

These six indexing elements, together with means (not shown) for pushing a panel upward and sideways to maintain contact at all six points, constitute a form of the six-point universal holding fixture 30 previously described.

Figure 13C:
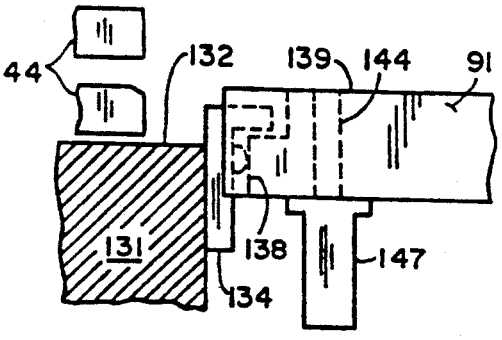
Figure 13D:
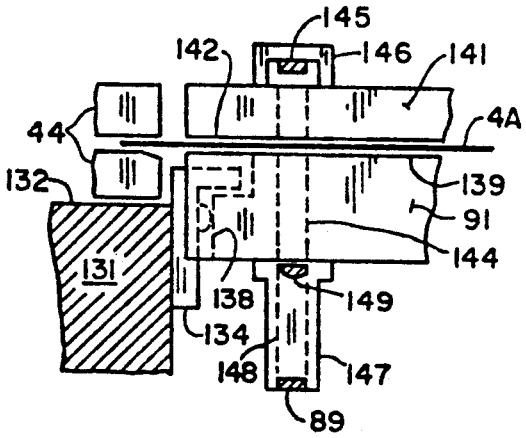

A bottom plate 91, seen in section in FIGS. 13*c* and 13*d*, can also be pushed against the same indexing elements. It is large enough to nearly fill the window in frame 131, leaving just a narrow slit all around. It has four cut-out portions 138 to accommodate the six indexing elements, so that bottom plate 91 can be precisely seated. When plate 91 is so seated, its flat top surface 139 is horizontal, parallel to the machined top surface 132 of the frame 131, and coplanar with the top surface of the lower jaws of clamps 44 which rest on surface 132.

There is also a top plate 141 with a flat horizontal bottom surface 142 which can be brought down from above to set itself against the top surface 139 of bottom plate 91. Both bottom and top plates are equipped with optical devices to be described later.

Instead of the top plate, the welding head 143 of a high powered laser (see FIG. 13*f*) may be brought down to where its focal point lies in a plane just above the machined top surface 139 of the bottom plate.

In the starting condition of machine 130 shown in FIGS. 13*c*, bottom plate 91 is seated against the six indexing elements. Two retractable locating pins (not shown) protrude from top surface 139. Clamps 44 are retracted. A mask 4A is now placed on surface 139, with appropriate pre-etched apertures to fit the two locating pins.

Next, top plate 141 is lowered until it seats itself against mask 4A. The two protruding locating pins slip into clearance holes (not shown) in the top plate. Clamps 44 are advanced until they overlap the mask enough to allow clamping; they are then closed (FIG. 13*d*). Thereupon, the top plate is lifted by a small amount to free the mask, and the two locating pins are retracted.

Corresponding to every position sensing aperture 47 in the mask (not shown in FIGS. 13*a*–13*f*) there is a cylindrical hole 144 in the top and bottom plates. Top plate 141 carries a lamp 145 in a small housing 146 over hole 144. Bottom plate 91, which remains in contact with the mask, carries an optical system 147 consisting of a quadrant detector light sensor 89 at the end of a tube 148, and a lens 149, which serves to focus an image of the mask position sensing aperture 47 upon the quadrant detector light sensor 89. The optical system 147 attached to the bottom of the bottom plate 91 is designed to allow small lateral mechanical adjustments so as to set its position with great accuracy.

Returning now to the operating sequence of machine 130, the feedback system for positioning, stretching and shaping the mask is energized next. Preferably this is done gradually, so as to avoid undesirable mechanical transients. Once all positioning errors are within tolerance, the clamp positions are frozen; for example, if stepper motors are used to pull the clamps, these motors are electrically locked in position.

Figure 13E:
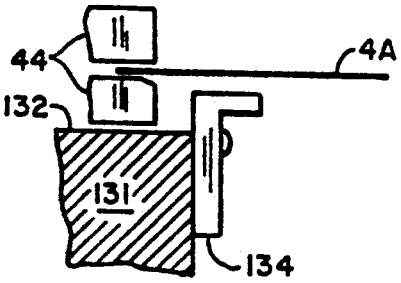
Figure 13F:
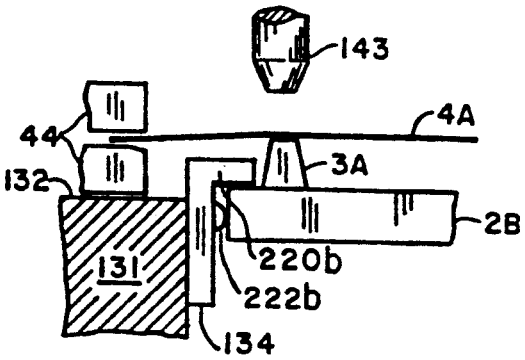

Top and bottom plates are then both withdrawn and moved out of the way (see FIG. 13*e*). A screened panel 2B is inserted into the machine and lifted up against the mask 4A until it is seated against the six indexing elements. At this point, the ground top surface of mask support structure 3A touches the underside of the stretched mask and, preferably, lifts it a few thousandths of an inch. Welding head 143 is now lowered (FIG. 13*f*) and the mask is welded to the support structure. While other ways are available, this may be done in accordance with copending application Ser. No. 058,095 filed Jun. 4, 1987 and assigned to the assignee of this invention now, U.S. Pat. No. 4,828,523.

Next, the peripheral portion of the mask is cut off, preferably using the same laser, and the welding head 143 is lifted and moved out of the way. The clamps 44 are opened and retracted, leaving the cut-off peripheral portion of the mask to be discarded. Finally, the completed assembly of panel 2B, and mask 4A—the latter now welded to mask support structure 3A—is lowered and removed from the machine. The two locating pins are once again extended, and the machine is ready for another cycle.

The process described in the preceding part of this specification is based on the assumption that when faceplate 2A is pressed against half-balls 22*a*, 22*b* and 22*c*, and the vertical stops 20*a*, 20*b* and 20*c*, the screen pattern is located precisely where it should be. But in practice, there are sometimes departures from the ideal situation. These departures fall into two categories:

(1) The entire screen pattern may be translated and/or rotated with respect to its nominal position, as indicated in FIG. 14*a*; note that there is not change in the geometry (i.e., size and shape) of the pattern;

(2) The screen pattern geometry may be distorted. The pattern may, for example, be stretched or narrowed in one or both dimensions, as indicated in FIG. 14*b*.

Screen distortion may also occur in combination with pattern translation and/or rotation.

A certain measure of departure from the ideal must be expected in any production process. However, in this case, opportunities exist for eliminating or at least reducing the effect of such departures. These opportunities will now be reviewed.

Adjusting Faceplate Position To Correct For Translation And/Or Rotation Of The Screen Pattern If the screen is applied to the faceplate by offset printing or a similar process, it is probable that the predominant error will be a positioning error along one axis, i.e., x or y, caused by imperfect indexing of the translatory motion of the faceplate with the rotary motion of the printing cylinder. Other position errors resulting from a lateral displacement or slight rotation of the faceplate with respect to its nominal position in the printing press are also possible. On the other hand, there may be no significant distortion of the screen pattern geometry, so that repositioning the faceplate in the assembly machine would be all that is required.

Conceptually, the simplest approach is to follow the assembly procedure previously described in connection with FIG. 13, but to correct for any positioning errors of the screen pattern, i.e., translation or rotation with respect to its standard position, by adjusting the position of the panel before inserting it into the assembly machine, or at least before the mask is welded to support structure 3A. Methods for doing so are described in the following.

One method employs a modified form of the universal holding fixture 30 previously described in connection with FIG. 2. The modified fixture 400 is shown in FIG. 15 and defines a receptacle for receiving a faceplate (front panel). The fixed half-balls 22*a*, 22*b* and 22*c* of FIG. 2 are replaced in fixture 400 by adjustable half-balls 401*a*, 401*b* and 401*c*. Each of these half-balls is shown as being mounted at the end of a micrometer screw 402 which may be rotated by an individual stepper motor 404 through worm gears 406. By selectively adjusting the positions of the three half-balls, a contained faceplate may be moved with respect to fixture plate 416 so as to bring the screen pattern into a predetermined position with reference to the fixture plate.

The procedure based on this approach is to load a faceplate into holding fixture 400, insert the loaded fixture into a screen-inspection machine (to be described in connection with FIG. 16), have that machine adjust the three half-ball settings so that the screen is correctly positioned, and then insert the loaded fixture into the assembly machine where the mask is positioned and stretched to conform to a standard pattern in position and geometry; the mask is then welded to the support structure. This assembly machine is essentially the same as the one depicted by FIG. 13, except for such modifications are required to accept and precisely locate fixture plate 416 instead of a faceplate.

To ensure stable and precise seating of each faceplate within fixture 400, the fixture comprises vertical stops 408*a*, 408*b* and 408*c*, and three leaf springs 410 to press the plate against the vertical stops. Leaf springs 410 may be rotated about pivots 412 to permit insertion of the faceplate 413 from below through rectangular opening 414 on the fixture plate 416. To ensure that the faceplate makes contact with all three half-balls, O-shaped leaf spring 418, mounted on post 420, presses against one corner.

Figure 16:
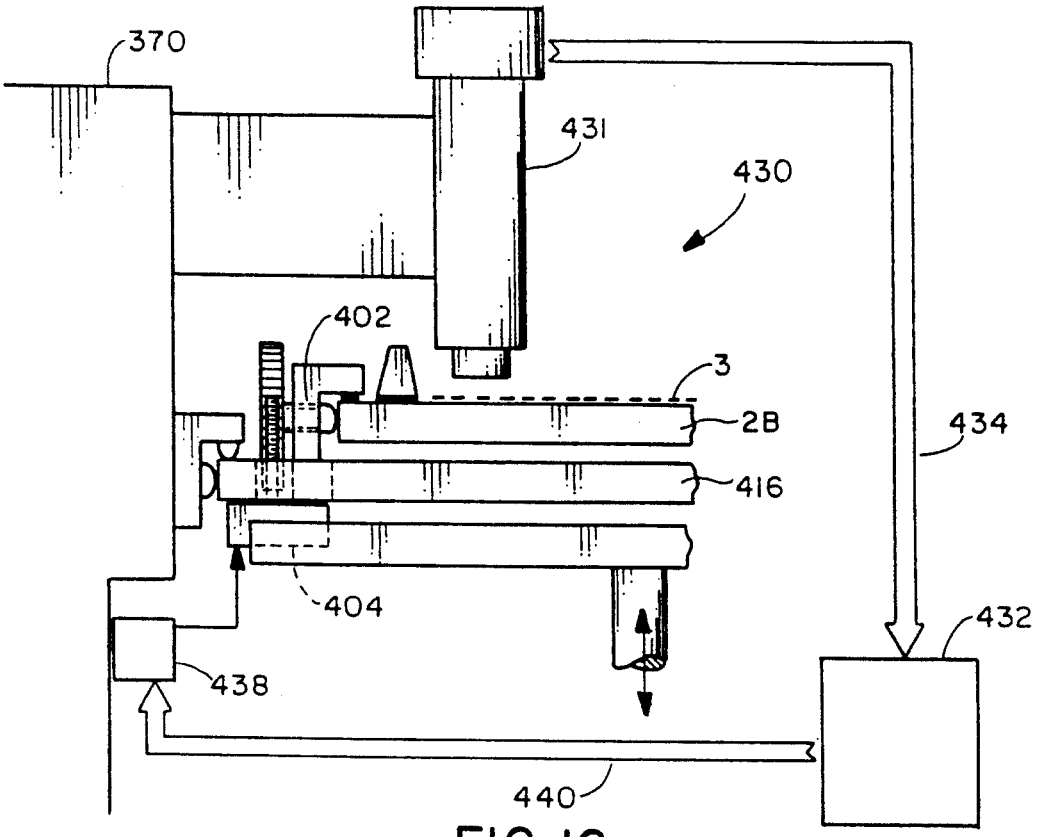
FIG. 16 is a view in elevation of a representative section of a screen inspection machine designed to receive the adjustable fixture depicted in FIG. 15, and of a feedback loop for adjusting that fixture.

In operation, a faceplate is loaded into fixture 400, locked in place by rotating leaf springs 410 to the position shown, and the fixture is inserted into screen inspection machine 430 depicted in FIG. 16. Grille position errors dx and dy are measured at a number of points. From the measured data, required adjustments of the three micrometer screws 402 are computed, and appropriate pulses transmitted to the three stepper motors 404. Inspection of any residual positioning errors remaining after this first adjustment may call for further adjustments; a feedback or servo loop exists here, permitting very precise adjustment of the faceplate position. This loop is indicated in FIG. 16, which shows schematically a screen inspection machine 430 designed to accept fixture 400 shown by FIG. 15, a computer 432 to convert position error signals 434 from sensor 431 (which may comprise a video camera) to stepper motor pulses 440, a connector 438 to connect the computer output to the three stepper motors 404, and micrometer screws 402 to adjust the position of the faceplate. As previously explained, the adjusted fixture is then mated to a mask in an assembly machine generally constructed as shown in FIG. 13, except that this machine is equipped to handle fixture plate 416 rather than the faceplate.

Figure 17:
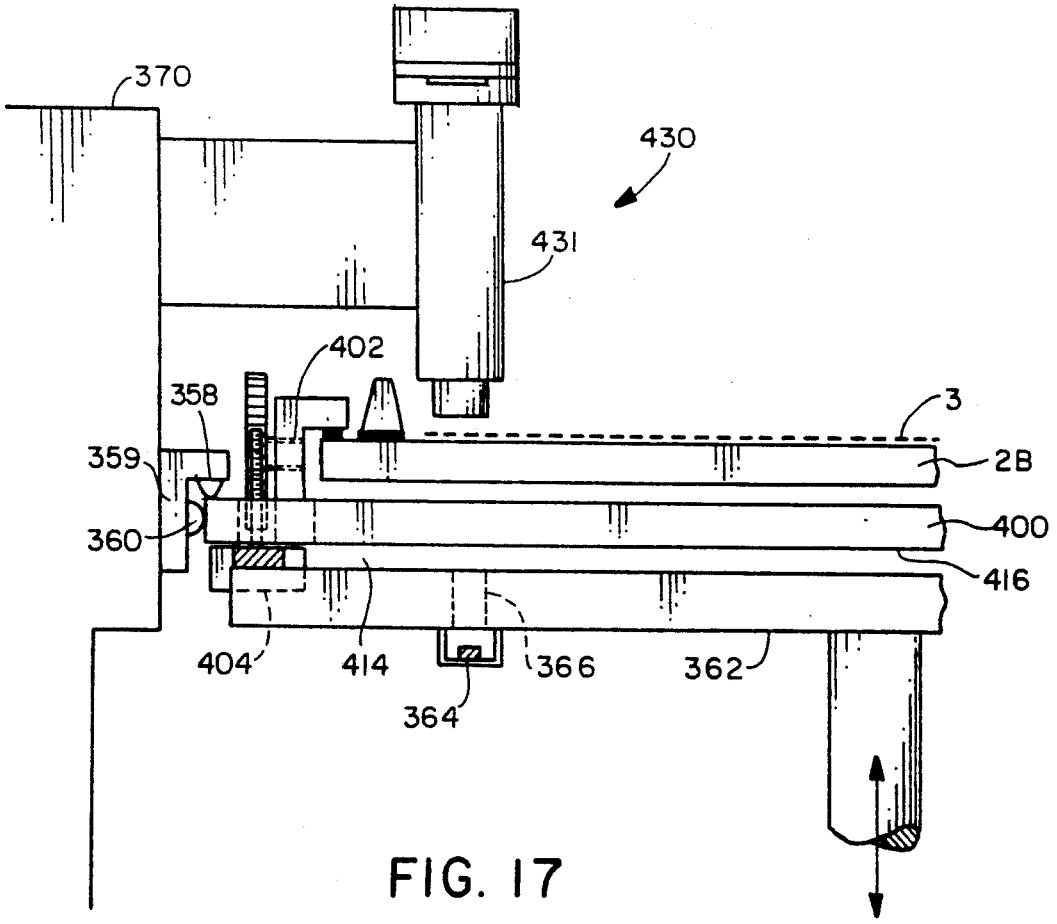
FIG. 17 is a more detailed view in elevation of a representative section of the same screen inspection machine.

FIG. 17 shows one version of a screeninspection machine in detail. This version can be used if, at the time of inspection, no aluminum film has been applied to the screen, or if the points to be measured, typically on the periphery of the viewing area, were masked off during application of the film, so that they remain unobscured. Faceplate 2B carrying grille 3 is locked in holding fixture 400 which in turn is inserted into inspection machine 430, lifted by table 362 and pressed upward against vertical stops 358 as well as laterally against half-balls 360, both mounted on brackets 359 (only one bracket is shown). Light sources 364 mounted on the lower face of table 362 illuminate small selected regions at the periphery of the grille through holes 366 in the table 362 and rectangular opening 414 in fixture plate 416. Video-camera-equipped microscopes 431, firmly attached to the frame 370 of machine 430, develop patterns corresponding to the grille configuration in the small selected region.

FIG. 18*a* shows, greatly magnified, the pattern representing one corner of the grille as seen by the video camera. In FIG. 18*a*, one horizontal scanning line 367 is marked; the corresponding output signal is shown in FIG. 18*b*. Other horizontal scanning lines will produce wider or narrower pulses, depending on where they cross the grille apertures. From the start and stop time of each pulse, the horizontal coordinates x of the hole centers can be calculated, and by using many scanning lines, readings can be averaged to reduce error. Similarly, the vertical scan produces the sharp-edged pulses shown in FIG. 18*c*, thus providing information regarding the vertical coordinates y of the grille holes.

Computer 432 (FIG. 16) accepts this information, calculates the required adjustments of the three micrometer screws 402, and generates the appropriate pulses to stepper motors 404, as previously explained. This cycle may be related until residual errors are reduced below a predetermined tolerance level.

A different version of the screen inspection machine 430 shown by FIG. 17 must be used if the screen is fully aluminized at the time of inspection, so that even the peripheral portions of the grille are obsured. It then becomes necessary to inspect the grille from the outside, i.e., through the faceplate. For this purpose, fixture 400 shown by FIG. 15 may be inverted before insertion into machine 430; light sources 364, shown in FIG. 17, are replaced by light sources placed near video cameras 431. Video cameras 431 observe the grille through the full thickness of the faceplate 416. Faceplate thickness may vary, and the focus of the video cameras 431 must be adjusted to compensate for such variations. This may be done by a conventional automatic focusing system, or by a mechanism designed to sense the screen surface and arranged to respond to an increment S in faceplate thickness by retracting the cameras 431 by $S(n-1)/n$, where n is the refractive index of the faceplate glass.

Another method for correcting screen pattern position errors avoids the use of a special holding fixture; the faceplate is directly inserted into the screen inspection machine depicted in FIG. 19. It will be noted that most of the important features of this machine 530, i.e. vertical stops 558 and half-balls 560, table 562, light sources 564, hole 566, and video camera 531, have their counterparts in FIG. 17. The significant difference is the absence of holding fixture 400 and the adjustable stops with their micrometer screws 402 and stepper motors 404. In addition, stops 558 and half-balls 560 are designed to accept the faceplate rather than the larger fixture plate 416.

Screen positioning errors are measured in machine 530 just as previously described in connection with machine 430 (FIG. 17), and micrometer adjustments required to correct for these errors are computed. However, in this case, no feedback loop exists; instead, the correction information is stored in the computer for later transfer to the assembly machine.

The assembly machine is a modified form of the machine shown by FIG. 13. The modification consists in the fact that half-balls 222 have been made adjustable, as shown in the detail view, FIG. 20 (this figure should be compared with FIG. 13*f*). Half-balls 380 (only one is shown), are mounted on micrometer screws 382 which may be adjusted by stepper motor 384 through gears 386 and 388.

Figure 20:
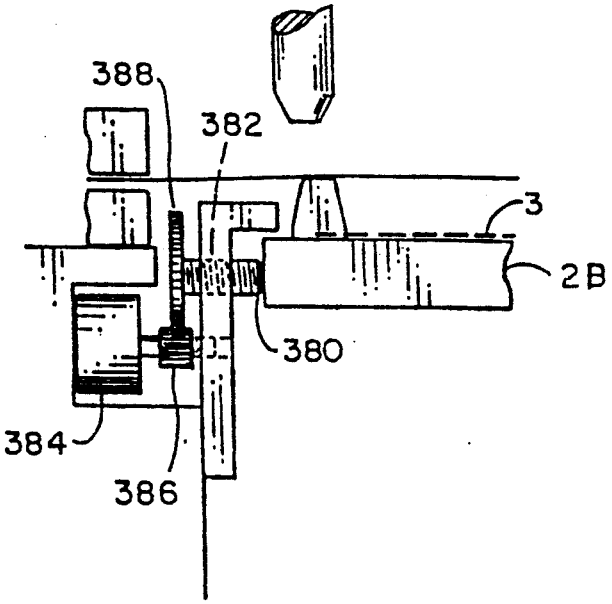
FIG. 20 is a detail view in elevation of a modified form of the assembly machine depicted in FIG. 13.

Before inserting a faceplate into the modified assembly machine indicated in FIG. 13, as modified in FIG. 20, the stored correction data for the faceplate is transmitted to stepper motors 384. Thus, when the faceplate is inserted into the assembly machine, the screen is in the correct position. A mask positioned and stretched to conform to a standard position and geometry is therefor joined to this faceplate without any further measurement, and registry of apertures and screen patterns result.

The use of a separate machine dedicated to screen inspection makes it possible to attach the position sensor—for example, video cameras 431 or 531—rigidly to frame 370 or 570 of that machine (see respective FIGS. 17 and 19), thus ensuring good reproducibility of the measurements. The faceplate or holding fixture can be inserted and removed without having to move the sensors out of the way.

It is, however, also possible to inspect the screen in an assembly machine. This alternative eliminates the need for a separate screen inspection machine and the associated extra handling of the faceplate, at the price of greater complexity and a slower working cycle for the assembly machine, brought about by the additional operations which must now be performed in that machine.

An example of such a machine is illustrated in FIG. 21. This figure shows an assembly machine which comprises the basic features of the machine depicted in FIG. 13, modified to include adjustable half-balls 380 as shown in FIG. 21 for adjusting the position of the faceplate, and further modified to include optical sensors for observing not only the mask but also the grille.

FIG. 21*a* depicts two similar gate-like structures 320*a* and 320*b* mounted above and below baseplate 321 (shown by FIG. 21*b*) of assembly machine 318, which, as noted, is generally analogous to the machine depicted in FIG. 13. Structures 320*a* and 320*b* consist of crossbars 322*a* and 322*b* which are supported by columns 324*a* and 324*b* fastened to baseplate 321. A faceplate 330 with support structure 332 is shown inserted into the machine, and a mask 333 is under tension by virtue of the forces exerted by pull-rods 334 upon clamps 356.

Cross bars 322*a* and 322*b* are equipped with extensions 336 which carry precision bearings 338. A cylindrical shaft 340 is free to rotate within these bearings. Two optical devices 342 and 344 are firmly mounted on this shaft by means of bars 346 and 348 and outriggers 350 and 352. They can be swung out of the way for the purpose of mask and faceplate insertion, welding and removal, or they may be moved into the position illustrated, where bar 348 contacts half-ball 354 which is attached to one of the columns 324*b*.

Each of the optical devices 342 and 344 comprise a high source and an optical sensor. For example, device 342 may contain means for projecting a convergent hollow cone of light through the mask toward the aluminized inside surface of the screen so as to form a brightly illuminated spot on the inside of the mask after reflection by the film. The optical sensor in device 342 may be composed of a combination of focusing lens and quadrant detectors similar to elements 149 and 89 of FIG. 13*d*, for the purpose of measuring position errors in x and y of a predetermined mask aperture, and for developing error signals related to such position errors.

Optical device 344, on the other hand, has the task of measuring position errors in x and y of the grille at a predetermined location. It is assumed here that the grille at this location is obscured by the aluminum film, hence back-lighting may not be practical. Device 344, therefore, may contain means for illuminating a portion of the screen from the front, as well as a sensor, which may be a quadrant detector equipped with a focusing lens, but which preferably is a microscope with a video camera. As previously explained, the optical sensor in device 344 must be designed to compensate for variations in faceplate thickness, either by being equipped with an automatic focusing system, or by means of a mechanism designed to sense the screen surface.

The operation of assembly machine 318 is analogous to the procedure described previously in connection with the separate screen inspection machine (FIGS. 17 and 19): grille position information from the sensors of optical devices 344 (equivalent to sensor 431 in FIG. 16) is fed to a computer (equivalent to sensor 432 in FIG. 16) which calculates the required corrections of the three half-balls (380 in FIG. 21) and supplies appropriate pulses to stepper motors 384 so as to adjust micrometer screws 382 through gears 386 and 388. This is a closed feedback loop, analogous to the one shown in FIG. 16; repeating the cycle causes the error in screen position to be reduced below a predetermined tolerance level.

Quite independently of the adjustment of the faceplate position just described, mask 333 is monitored by the sensors of optical device 342 and stretched, as well as positioned, by clamps 356 driven by servo motors (not shown) through pull rods 334, in the manner previously explained, until the mask conforms to an established standard position and geometry. As soon as faceplate and mask adjustments have been completed, optical devices 342 and 344 are swung out of the way; the mask is then welded support structure 332, the excess material cut, and the assembly removed from the machine in the manner described in connection with FIG. 13.

Adjusting Mask Position To Correct For Translation And/Or Rotation Of The Screen Pattern In the preceding part of this specification, methods were outlined for determining the departure of the grille (screen) from its nominal position, and for using this information to move the faceplate so that before the mask is welded to its support structure in the assembly machine, the grille is in its nominal position. There exists, however, an alternative way of using that same information. It is best illustrated by an example.

Let it be assumed that the screen is inspected in the machine shown in FIG. 19, and that the sensors find the grille displaced to the right by three mils, and upward by one mil, with 0.2 milliradians of clockwise rotational error. Following the procedures previously described, the micrometer screws in fixture 400 (FIG. 15), or in the assembly machine (FIGS. 20 or 21) would have been adjusted to move the faceplate three mils to the left and one mil down and rotate it counter-clockwise by 0.2 milliradians in order to bring the grille into its nominal position. But the same final result would have been obtained without making any mechanical adjustments to the faceplate, by moving the properly stretched mask three mils to the right and one mil up from its nominal position and rotate it clockwise by 0.2 milliradians. This can be done, for example, by first permitting the mask-stretching servo motors to position and stretch the mask to conform to the predetermined standard position and geometry, then disabling the servo loops and supplying appropriate input signals to the motors to displace the mask in an open-loop mode as required, without changing its size, shape or tension, i.e., while maintaining its geometry.

Another possibility lies in mounting all servo motors on a rigid carrier which is capable of being displaced as a whole, and applying the position correction to that carrier. This is illustrated in FIG. 25 which shows an assembly machine 600 including a frame 602, three half-balls 604 (only one of which is shown), and three vertical stops 606 (only two of which are shown) for locating faceplate 608, and a vertically movable table 609 for pressing the faceplate against the vertical stops. Frame 602 has plane top surfaces 610 which support frameshaped carrier 612 through steel balls 614. Stepper motors 616 for stretching mask 618 through pull rods 620 and clamps 622 are all supported on the top surface of carrier 612.

The height of carrier 612 above the plane top surfaces 610 of frame 602 is precisely controlled by the steel balls. Its horizontal position may be adjusted by three micrometer screws 624 (only one is shown) which are controlled by stepper motors 626 through reduction gears 627 and 628. Only one stepper motor is shown, but three are required to uniquely define the horizontal position of the carrier; a compressed spring 630, shown schematically, ensures continuous contact between the tips of the three micrometer screws 624 and carrier 612.

To simplify the drawing, FIG. 25 shows no optical devices. Also, the horizontal dimension of the mask is shown reduced so that both sides of carrier 612 can be illustrated.

Figure 22:
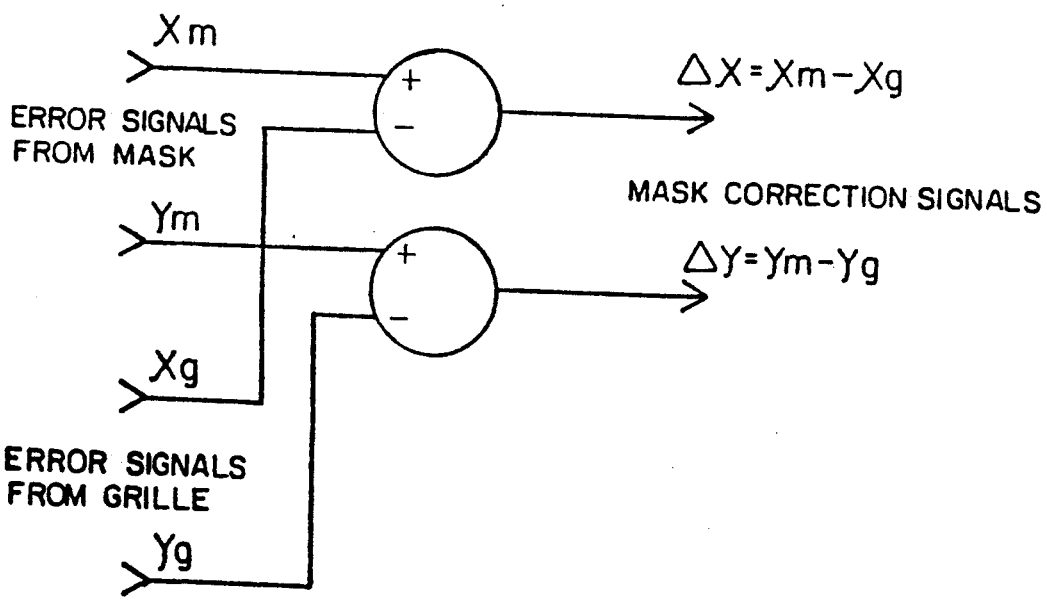
FIG. 22 is a schematic diagram of a difference-forming circuit for controlling servo motors.

It is also possible to use the information from the screen inspection machine to bias the feedback loops which control the mask servo motors. This approach is illustrated in FIG. 22 for the case of analog signals. It is essential that both error signals are linear functions of the positioning errors, and that a given voltage corresponds to the same error for both sources (mask and grille). It will be obvious that a digital version of this circuit is also possible. In any case, the servo motors will move until the difference signal $Xm-Xg$, or $Ym-Yg$, is reduced to zero.

The three approaches just outlined have in common the principle that the mask is moved from its standard position to make up a displacement of the grille. In all three cases, the mask is stretched to conform to a standard position and geometry and is also displaced. In the first and second approach, these two operations are carried out separately; in the third approach, they are merged. In all three cases, the instructions for the additional displacement come from a separate screen inspection machine, and there is no need for moving or looking at the faceplate in the assembly machine. Therefore, the assembly machine can take the simple form illustrated in FIG. 13, except for the addition of a laterally movable carrier for mounting the servo motors in the case of the second approach.

The methods described up to this point are all based on the assumption that the grille (screen) may be displaced from its nominal position, but that it has the correct size and shape, so that a mask stretched to conform to the standard geometry will always fit the grille, provided only that any relative displacements are corrected.

Adjusting Mask Shape To A Particular Screen

The possibility of screen patterns being too large or too small, or having distortions such as indicated in FIG. **14*b***, cannot be ruled out. It is in the nature of the stretchable mask that it can compensate for small departures from the correct size and shape of the grille pattern. But to take advantage of this characteristic, the principle of stretching the mask to conform to a predetermined standard position and geometry must be replaced by the idea of stretching it to conform to an individual grille. When a screen inspection machine measures more than two points (for example, the four corners) on a displaced but undistorted grille, certain geometrical relationships exist between the measured data. For example, the horizontal displacements of the two upper corners are the same. Three independent measurements (for example, the vertical displacement of each upper corner and their common horizontal displacement) suffice to specify translation of the upper edge in x and y, as well as rotation. Measuring x and y displacements of all four corners provides welcomed redundancy, which permits more accurate computation of the translational components of a chosen point (e.g., the center of the rectangle) as well as the rotation, using simple algorithms.

If the screen is not only displaced but also distorted, these algorithms can still be used to compute the translational and rational components for the purpose of moving the faceplate or the mask to achieve compensation; but of course, such compensation will not be perfect because the distortion component is still present.

On the other hand, the last approach outlined in the preceding section, where the feedback loops are biased in accordance with grille position error signals derived from the screen inspection machine, will automatically cause the mask to depart from the standard geometry and to be stretched so as to at least partly compensate for screen distortion. Suppose, for example, that the grille is distorted as indicated in FIG. 14*b*, i.e., too long in the horizontal direction; then the horizontal displacements of the two upper corners will not be alike, the right top corner yielding a larger positive (or smaller negative) value of Xg than the left top corner. The two bias voltages (or digital bias signals) supplied to the left and right servo motors will therefore be different, causing the motors to come to rest in positions which stretch the mask more than the usual amount to compensate for the excess length of the grille.

The procedure just described represents an intermediate step between stretching the mask to conform to a standard position and geometry, and stretching it to conform to an individual grille.

The mask is stretched to conform to the standard, but grille information is fed into the feedback loops to correct for the particular grille. This seems a roundabout approach, and it raises the question to what extent a standard is really needed in this embodiment.

FIG. 23 shows an assembly machine which is a simplified version of the machine shown in FIG. 21.

The adjustable half-balls 321 included in FIG. 21 are replaced by fixed half-balls. In the design of the upper sensors of optical device 342, which measure mask position errors with reference to a mask standard, and lower sensors of optical device 344, which measure grille position errors with reference to a grille standard, care is taken to make sure that equal position errors produce equal error voltages (or equal digital signals) from both sets of sensors. The sensor outputs are then connected into the difference-forming circuit of FIG. 22, and the outputs from this circuit are used to control the mask servo motors. When the servos come to rest, the mask fits the grille—distorted or undistorted—as well as is possible with the mechanical limitations of the system.

The common mounting of a pair of sensors(342 and 344) on a rigid shaft 340 is advantageous because the output signal from the difference-forming circuit(FIG. 22) is not sensitive to simultaneous displacement of both sensors by equal amounts.

FIG. 24 indicates a more direct approach to developing error signals which indicate differences between mask and grille, by measuring the positions of selected points in the mask directly with reference to corresponding points on an individual grille. The arrangement of FIG. 24 modifies the assembly machine of FIG. 13. No mask or grille standard is used. Specifically, FIG. 24 indicates a point-like light source 302, preferably a gallium arsenide diode laser, illuminating two round apertures 304 (shown greatly magnified in FIG. 24*c*) in the peripheral region of the mask near support structure 3*a* outside the viewing area. Light passing through the two apertures strikes the black grille 306. The grille has a rectangular window 308 so positioned that when screen and mask are properly aligned, one-half the light passing through each of the two mask apertures 304 will also pass through the window. FIG. 24*c* illustrates the case where the screen, and thus window 308, is displaced to the left; as a consequence, more light from the left aperture than from the right now passes through the window. A balanced photodetector 310, consisting of two separate photodetectors connected in push-pull, is placed below the faceplate to develop an electrical output indicative of the unbalance, thus producing a position error signal. No difference-forming circuit of the type shown in FIG. 22 is needed here, since a difference signal is produced directly by the optical arrangement shown in FIG. 24.

The size of apertures 304 of window 308 depends on the magnitude of the expected initial screen-positioning errors of the mask relative to the grille. Space along the edge of the viewing area is a premium; therefore, the apertures and window should not be made larger than necessary. A lower limit for the aperture size is set by the appearance of diffraction effects which tend to blur the shadow of the aperture edge on the grille.

If there is not enought space available between the viewing area and support structure 3A, apertures 304 and window 308 may be placed outside support structure, as shown in FIG. 24*b*. The mode of operation is the same as that discussed in connection with FIG. 24*a*.

FIGS. 24*a* and 24*b* show the beam of light from source 302 striking apertures 304 under angle $\alpha$. It is preferred to make this angle, or at least its projection on a plane which contains the light source as well as the centers of apertures 304, substanially equal to the corresponding angle formed by the incident electron beams in the completed tube. This has the advantage that errors in the height of support structure 3A are compensated for; for example, if the support structure is too low, the shadow of apertures 304 will move to the right as shown in FIG. 24*c* and produce an error signal which calls for additional stretching of the mask.

The assembly procedure is analogous to that described in connection with FIG. 13, with the following changes:

In the step depicted in FIG. 13*c*, a bottom plate is substituted for the optics-equipped plate 91, simply to support the mask before it is clamped. After clamping, the bottom plate is withdrawn, a faceplate is inserted as in FIG. 13*f*; the optical components (which had to be moved out of the way to insert mask and faceplate) are put in their proper positions and the servo circuits are turned on. All mask positioning and stretching is done with reference to the grille; the clamp motors are controlled by the signals derived from balanced photodetectors 310, either individually (one motor—one photodetector), or preferably, collectively through the matrixing process described in connection with FIG. 12.

It was mentioned earlier that simple algorithms exist for extracting the translational and rotational components from measured displacements at selected points. This applies whether the displacements refer to mask vs. standard, grille vs. standard, or mask vs. grille. In all cases, the translational and rotational components may be compensated for by displacing the mask, the grille, or both. More specifically, the mask may be moved entirely by activating the clamping motors, or by mounting these motors on a carrier capable of translation and rotation in the x-y plane for mask position adjustments. The grille may be moved by the micrometer screws illustrated in several embodiments, or by other means capable of translating and rotating the faceplate in the x-y plane. These operations may be carried out in a closed-loop or open-loop mode. Selection of a particular combination is a matter of design choice.

In the foregoing, it has been shown how a mask may be positioned and stretched so that its pattern attains a desired relation to a screen. The above discussion includes:

I. Stretching and positioning the mask, and positioning the screen, to conform to a common standard A. If the screen is known to be undistorted (that is, to have a "standard" geometry) and correctly positioned on the panel, by positioning and stretching the mask to conform to the predetermined standard mask position and geometry;

B. If the screen is known to be undistorted but not necessarily correctly positioned on the panel, by 1. providing an adjustable fixture (FIG. 15) for handling the panel which is independent of the assembly machine, inspecting screen position in a separate screen inspection machine (FIG. 17) and, through feedback (FIG. 16), adjusting the fixture, or 2. providing adjustment capability in the assembly machine (FIG. 20), with the information required to make the adjustment derived a. from a separate screen inspection machine (FIG. 19), or b. from screen inspection performed in the assembly machine itself (FIG. 21).

In all these cases, the panel is moved to correct for screen position errors, and the mask is positioned and stretched to conform to a standard position and geometry.

II. Conforming the mask to the screen

Another class of solutions shares the common feature that the mask is positioned and stretched—not to conform to a standard, but rather so as to reduce the differences between corresponding points on a particular mask and screen to a minimum (FIG. 22). This may be done by A. Inspecting the screen in a separate machine (FIG. 19) to measure screen departures (Xg) from a standard position and geometry; in the assembly machine, measure mask departures (Xm) from the standard position and geometry; move and stretch mask to minimize Xm−Xg (FIG. 22).

B. Inspecting mask and screen simultaneously in an assembly machine; reduce difference between corresponding points to the minimum. This may be accomplished:

1. Separate optical systems may be employed to measure mask and screen position (FIG. 23), with the difference formed electronically (FIG. 22), or 2. A single optical system joining mask and screen may be used, with the deference formed optically (FIG. 24). No standard reference is used.

FIGS. 26 to 49 Interchangeable Mask System Embodiments

Sequence of Events

Referring to the drawings and particularly FIGS. 26 to 31, an interchangeable mask production system 710 is illustrated in sequence. This is the system described in the beginning of this detailed description, namely pages 12 to 22, and is seen to generally include a front panel assembly station 711 having a stretching platform assembly 712 independently movable from the assembly station module registration features described below, and an overhead laser welding assembly 714; a reciprocal loading and unloading shuttle 716 having a mask module support 718 at one end releasably supporting a mask module 719 and a panel module support 720 at its other end releasably holding a panel module 722; and a lift assembly 724 beneath the assembly station 711 for lifting the mask and panel modules 719 and 722 into the assembly station 711.

Figure 26:
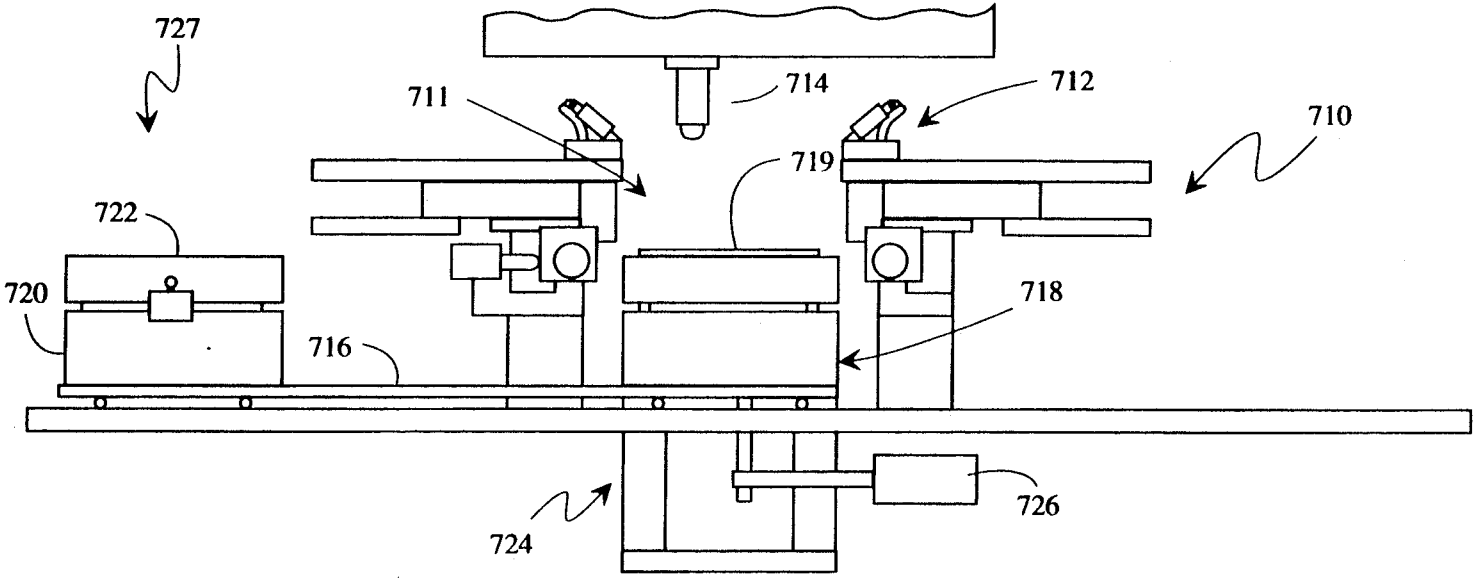
FIG. 26 is an automated assembly system according to the present invention with a transport shuttle illustrated in its panel loading position.
Figure 27:
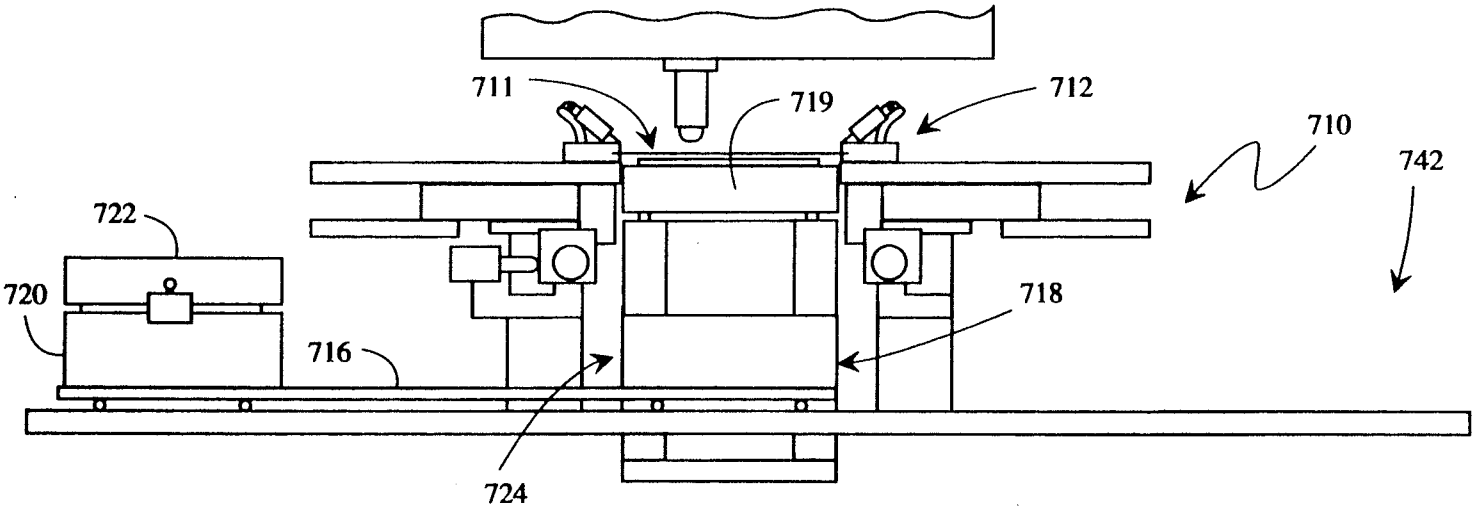
FIG. 27 is the automated assembly system illustrated in FIG. 26 with a lift assembly elevating a mask module into the assembly station.
Figure 29:
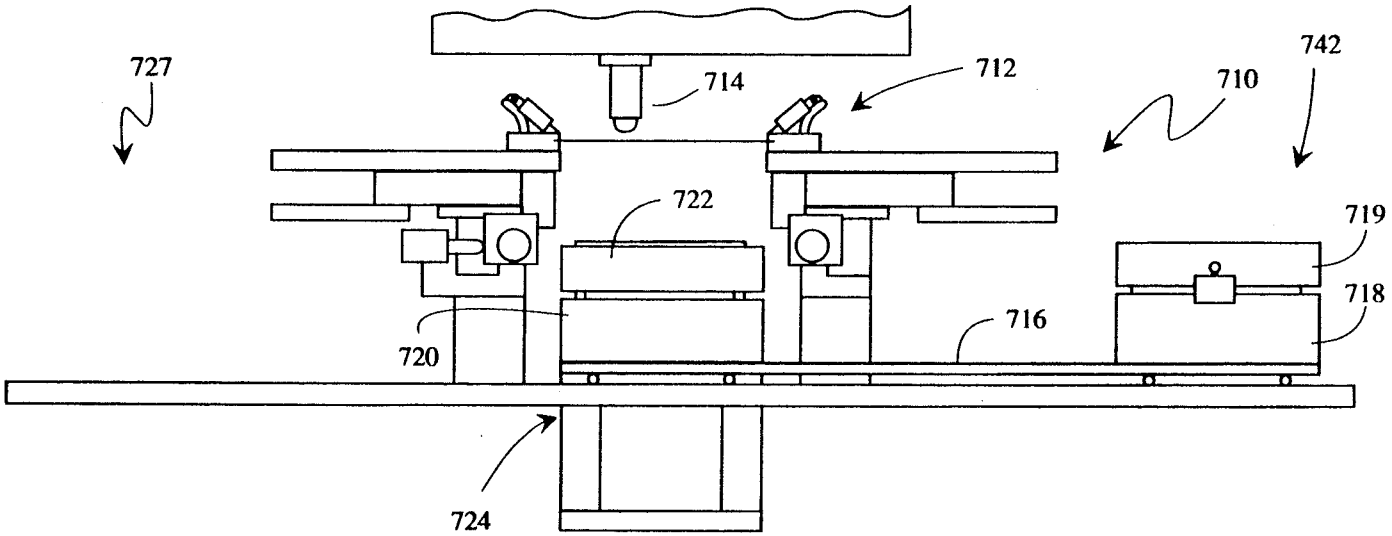
FIG. 29 is the automated assembly system illustrated in FIG. 26 with the shuttle shown in its mask loading and panel module lift position.

It should be understood that a suitable actuator 726 (shown only schematically) is provided for reciprocating shuttle 716 from its left position illustrated in FIG. 26 to its right position illustrated in FIG. 29.

In the FIG. 26 position, shuttle 716 positions panel module 722 at a panel loading station 727 and the mask module 719 under the assembly station 711. The mask module 719 at this point in the sequence carries a mask and the panel module 722 has just returned a completed front panel assembly to station 727 which is also the front panel assembly unloading station.

Continuing the sequence of operation of system 710, lift assembly 724 engages the underside of mask module 719 and raises it upwardly into the module registration features in the assembly station 711. During this time the assembled mask-panel is removed from the panel module 722 and a new panel is loaded into the panel module 722. The mask is then clamped by the clamping platform assembly 712 and may be stretched to a reference dictated by an optical system carried by the mask module 719, which will be described in more detail with respect to FIGS. 34, 35 and 36.

The optical system carried by the panel module 722 begins interrogating fiducial marks on the just loaded panel to identify the location of the screen and transfers this information to a microprocessor control for the system 710 described in connection with FIG. 36 below, where that information is digested along with previously stored information relating the position of the screen on the panel to the same fiducial marks on the viewer side of the screen. These fiducial marks are designated A and B in FIG. 48 and as noted are positioned on the viewer side of faceplate 730.

Figure 36:
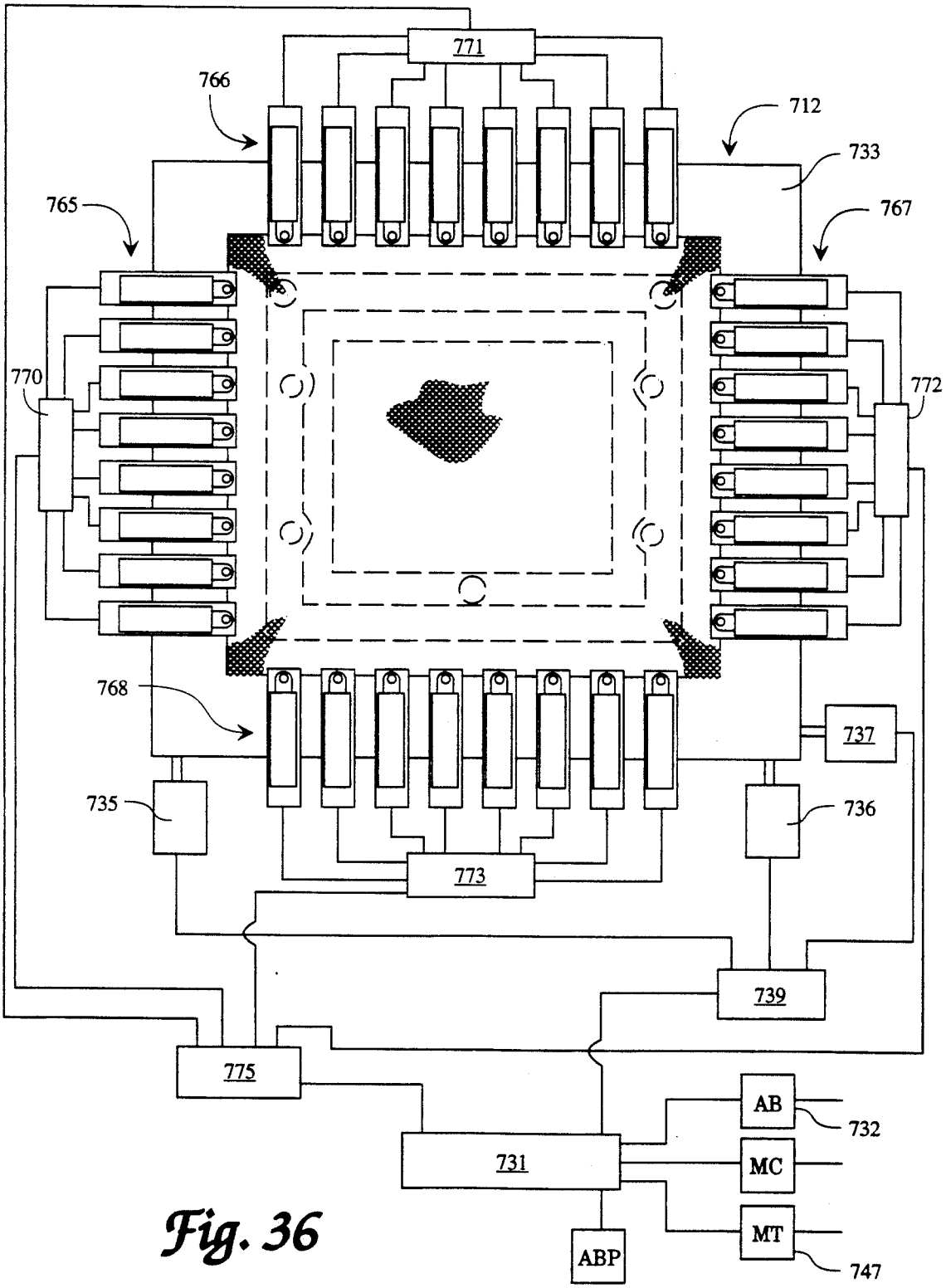
FIG. 36 is a simplified top view of the assembly station illustrated in FIG. 34 along with a control system for the entire assembly system illustrated in FIGS. 26 to 35.

The position and location of screen 729 (FIG. 47) on the opposite side of faceplate 730 has been previously interrogated in another instrument outside of system 710 and that information is provided to system microprocessor 731 illustrated in FIG. 36 by data transfer component ABP shown in the same Fig.

Figure 37:
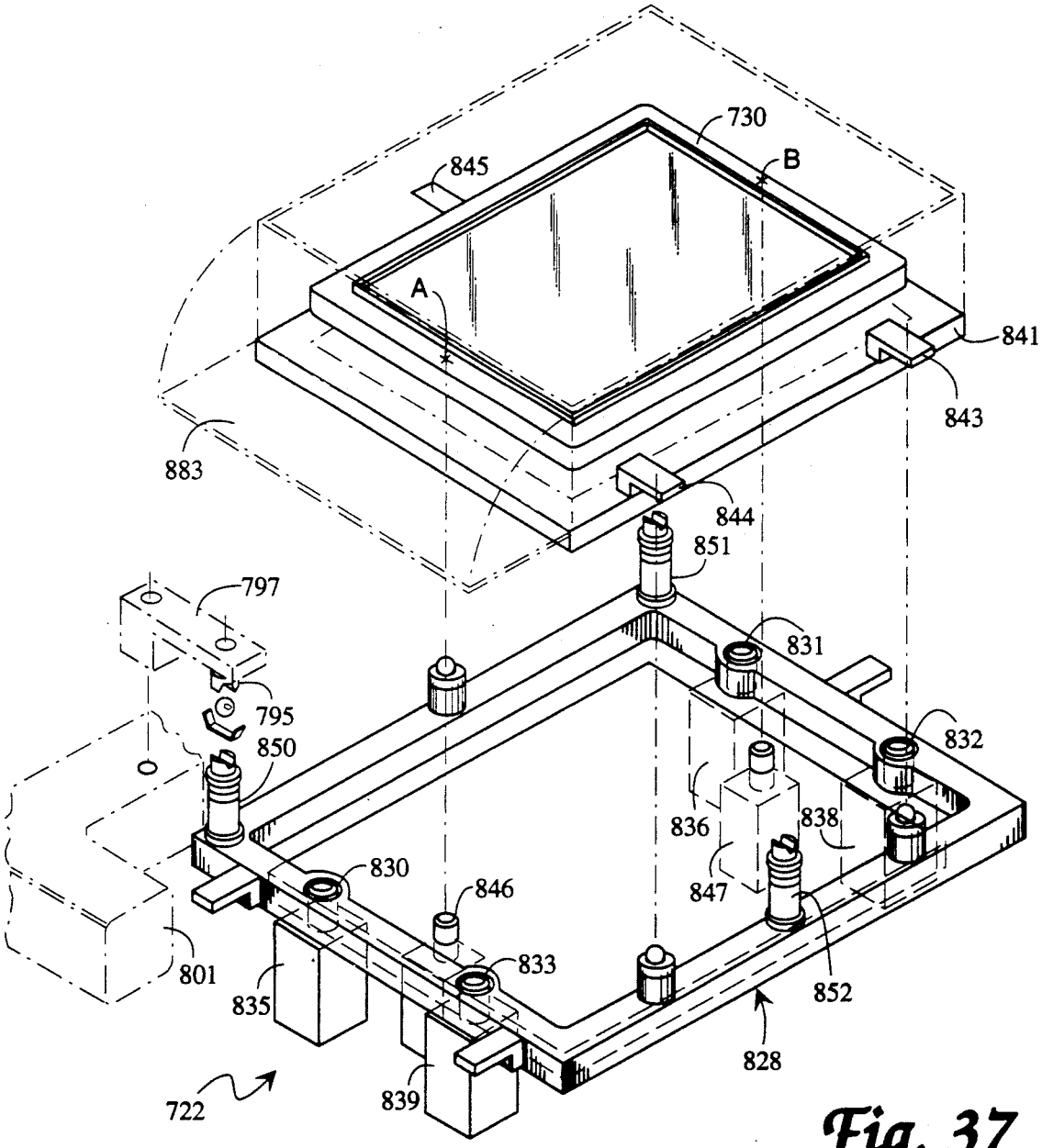
FIG. 37 is an exploded perspective view of the face panel module illustrated diagrammatically in FIGS. 26 to 31.
Figure 38:
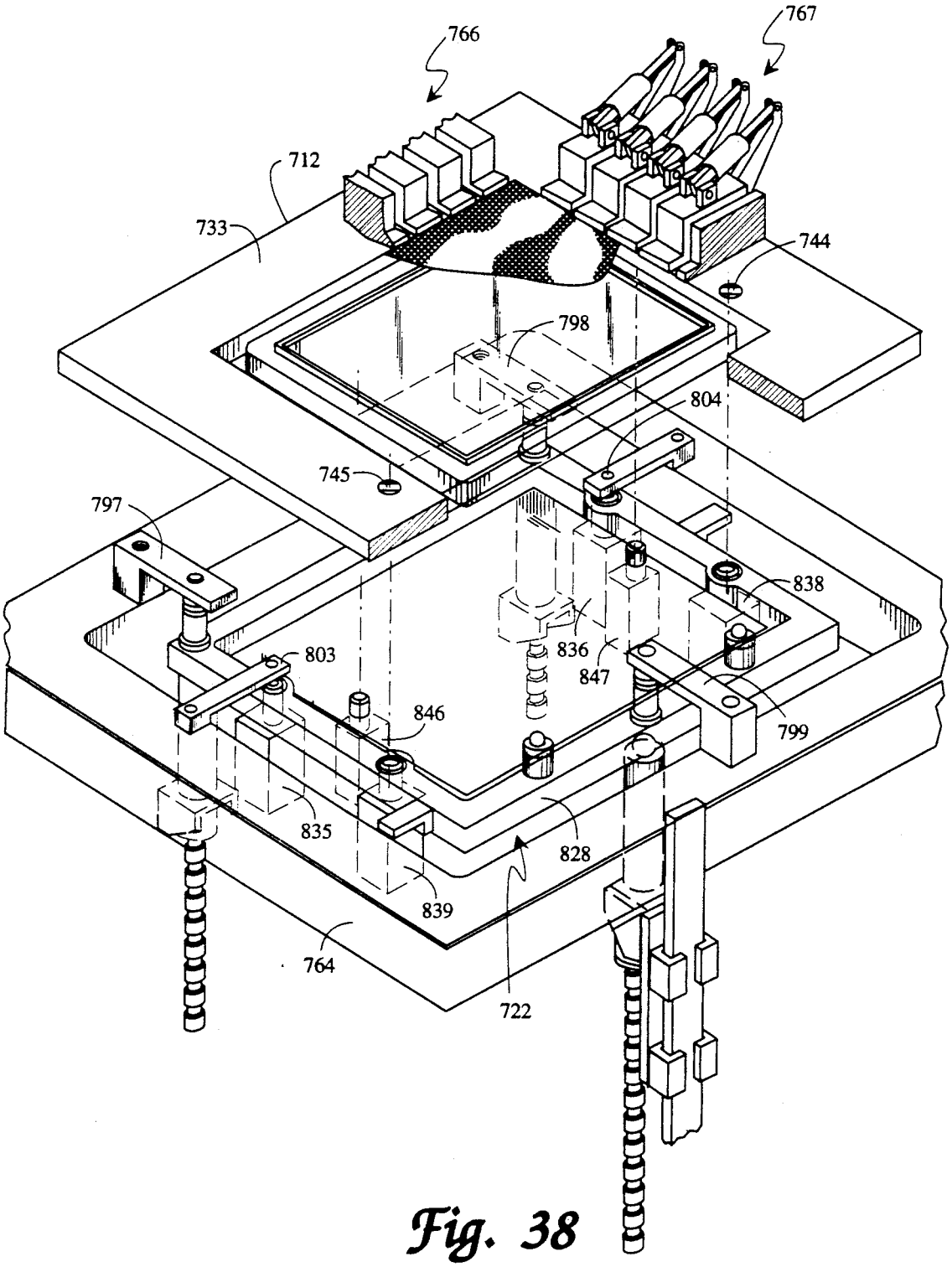
FIG. 38 is a fragmentary exploded perspective of the top part of the assembly station illustrated in FIGS. 34 and 35 with the face panel module located therein.
Figure 39:
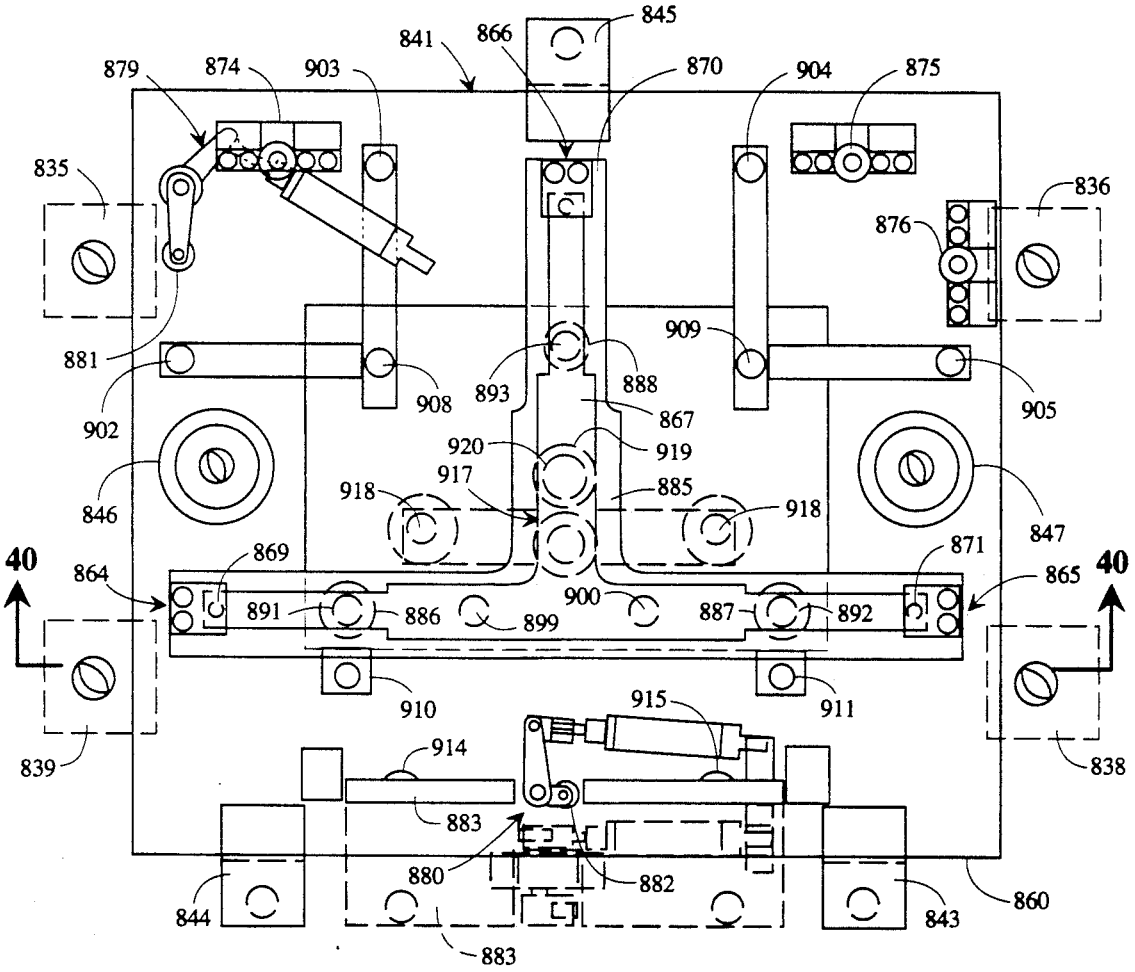
FIG. 39 is a top view of the face panel loading fixture in the face panel module.

The A B fiducial optical sensors on panel module 722, described in more detail with respect to FIGS. 37 to 39, transfer the AB mark locations information to microprocessor 731 in FIG. 36 through A B transfer component 732 shown therein.

Microprocessor 731 utilizes the information from the A B optical sensors in panel module 722 and the previously stored location of the screen with respect to the fiducial A B points to provide the system 710 with an initial location of the screen with respect to the mask. The mask has already now been registered to a stretched mask reference determined by the optical devices in mask module 719, and microprocessor 731. While the panel module 722 is still at the loading station or in transit to the assembly station 711, stretching platform assembly 712 begins the in-toto movement to align the mask with the screen by shifting stretching platform 733 (FIG. 36) in the stretching assembly 712 with servo motors 735, 736 and 737 controlled by a servo driver 739 under the control of microprocessor 731.

This preliminary interrogation of screen location and in toto mask movement to actual screen position constitutes the registration movements prior to positioning the panel module 722 in the assembly station.

It should be understood that the microprocessor 731 also controls the shuttle actuator 726 and the lift assembly 724.

Figure 28:
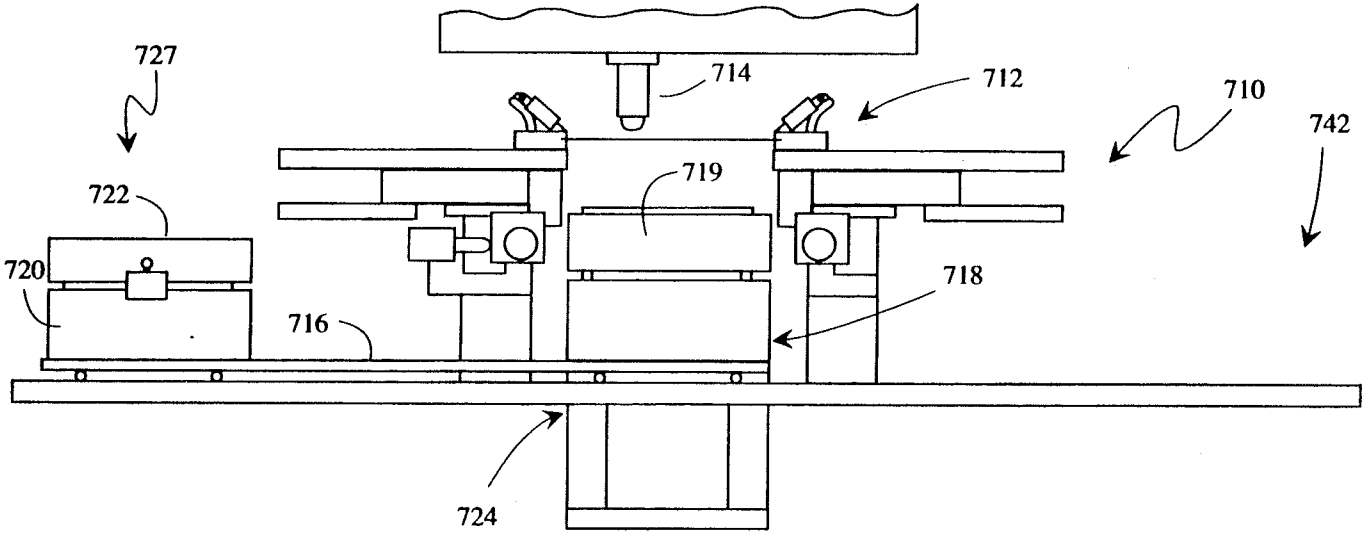
FIG. 28 is the automated assembly system illustrated in FIG. 26 with the lift assembly lowering the mask module back to the shuttle.

FIG. 28 depicts the lift assembly 724 returning the mask module, without the mask, to the shuttle mask module support 718.

Figure 30:
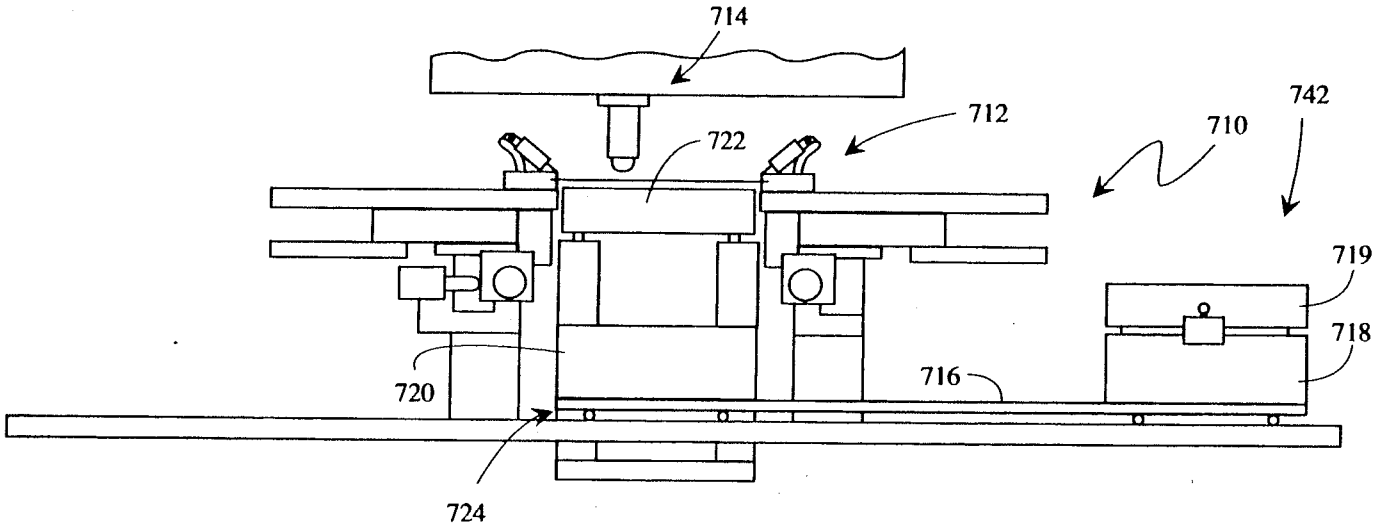
FIG. 30 is the automated assembly system illustrated in FIG. 26 with the lift assembly raising the panel module into the assembly station.

As Illustrated in FIG. 30, shuttle 716 then shifts to its right position illustrated in FIG. 29, positioning the mask module 719 at mask loading station 742 and the panel module 722 underneath the assembly station where it is then lifted by lift assembly 724 into the module registration features at the station 711. Panel module mounted gauging cameras 834, 835 (FIG. 38) interrogate the assembly station registration features to ascertain the quality of module registration within the assembly station. At the same time a new mask is loaded onto the mask module 719.

After registration of the panel module at the assembly station, fiducial mask cameras interrogate the panel to determine if the screen position has shifted in relation to the registered panel module. If the screen has shifted, the mask platform will need adjusting. An optical system, described further in connection with FIGS. 37 and 38, carried by the panel module 722 interrogates, and/or verifies final adjustment of the stretching platform 733 with respect to the registered panel module by viewing targets 744,745 (FIG. 38) on the underside of the mask platform 733. This interrogation of the mask platform by the panel module mounted optical system is referred to herein as "moment of truth" interrogation because it represents the final verification function of registration between mask array and screen location at the assembly station before welding the mask to the panel.

This final mask platform target information is transferred through a data transfer component 747 in FIG. 36 to microprocessor 731 which then controls platform servos 735, 736 and 737 in closed loop fashion to effect final positioning of the mask with respect to screen.

Figure 31:
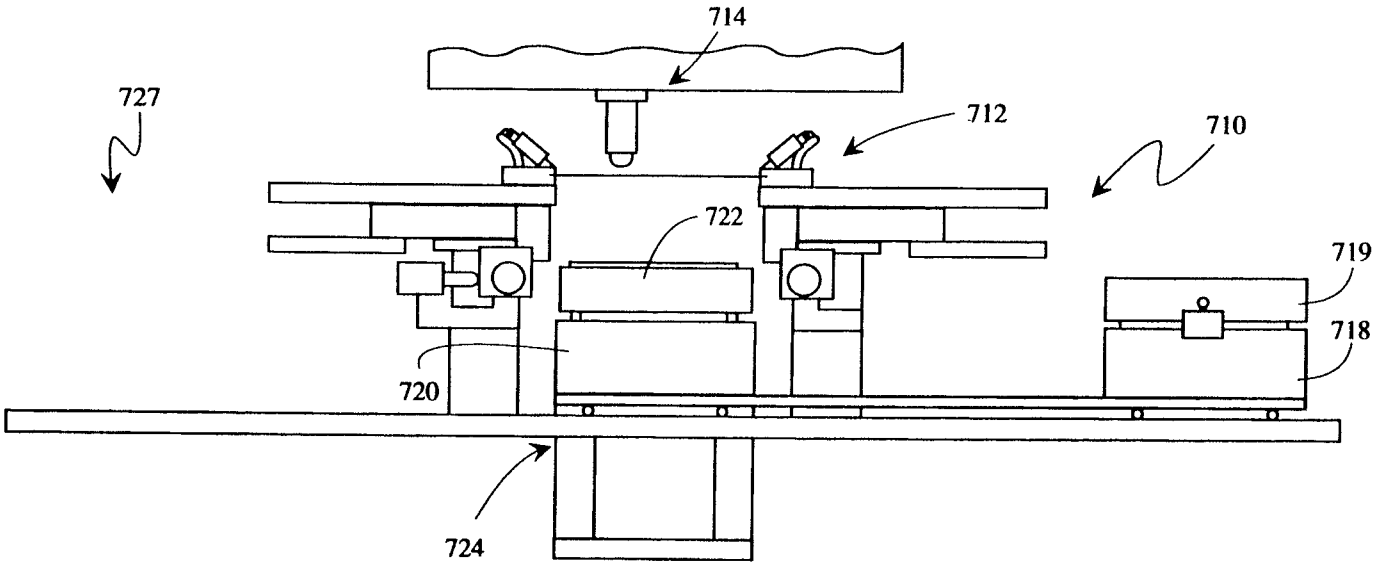
FIG. 31 is the automated assembly system illustrated in FIG. 26 with the lift assembly returning the panel module carrying the assembled mask-panel to the shuttle.

As illustrated in FIG. 31, welding assembly 714 then welds the mask to the panel rails, and trims the mask. Lift assembly 724 lowers panel module 722 back to the shuttle panel support 720. To complete the system cycle the shuttle actuator 726 is then actuated to shift the shuttle 716 to its left position (FIG. 26), thereby positioning mask module 719 with a new mask under the assembly station 711 and the panel module 722 at the panel loading station 727 where the assembled panel-mask is removed from the panel module and a new sequence of operation begins.

While there was originally some apprehension in mounting the cameras directly on the modules where they are almost continually in transport motion and experiencing some vibration, this apprehension has been an acceptable trade-off to the advantages in locating these cameras on the modules. Regardless of where the cameras of optical devices are mounted, it is essential that they be shifted out of their active positions. For example, if the mask array sensing optical system is positioned above the mask, it must be moved out of the way to accommodate the welder, and if it is mounted below the mask, it must be shifted away to permit insertion of the panel module. By mounting the interrogation cameras on the module the interrogation array, the cameras only need to be positioned once during initial system set up. The alternative is to register the camera arrays with respect to the panel and mask during each system cycle, which may result in increased wear on the registration system components involved.

The Assembly Station

Figure 32:
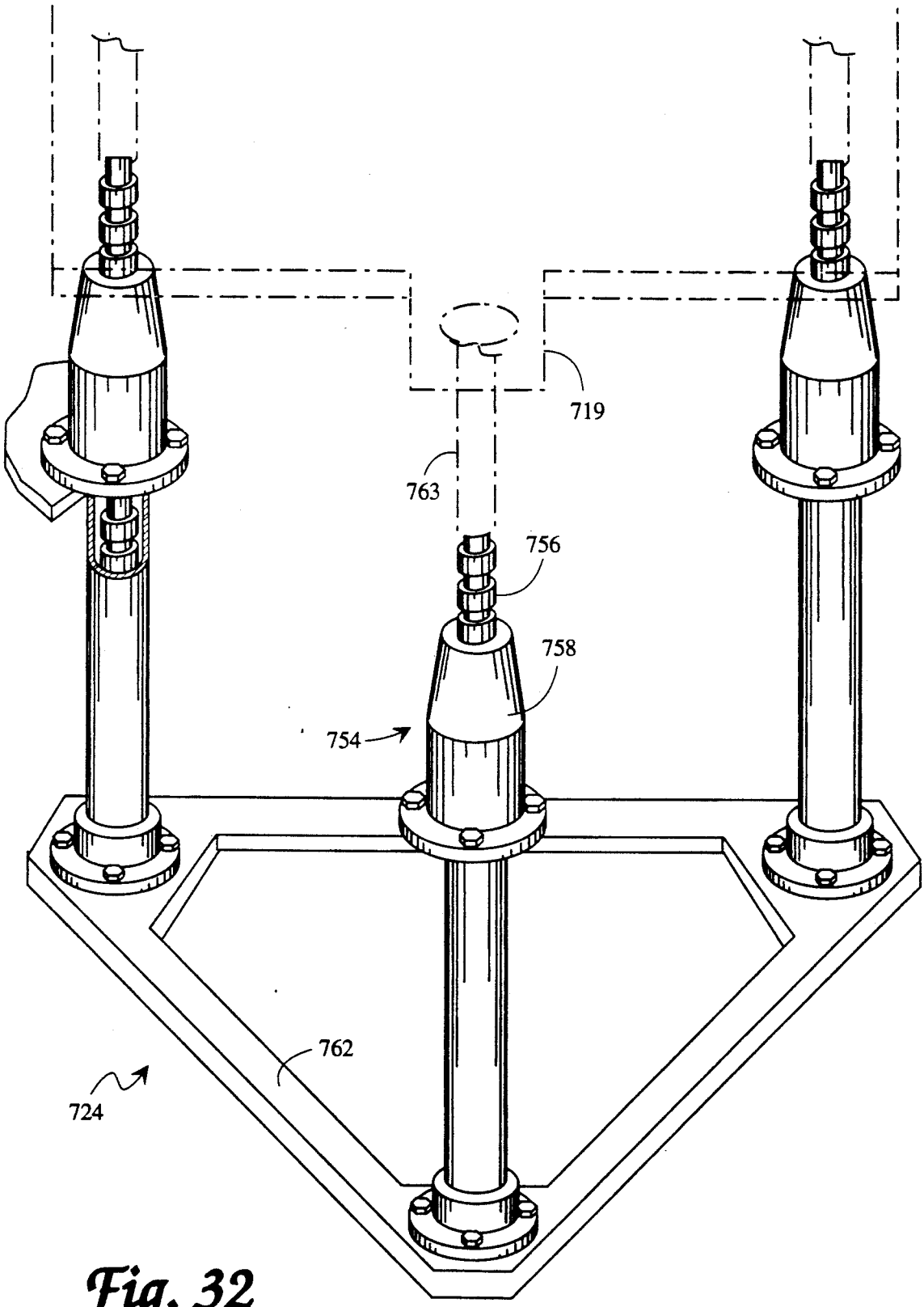
FIG. 32 is a detailed perspective view of the lower part of the lift assembly illustrated in FIGS. 26 to 31.
Figure 33:
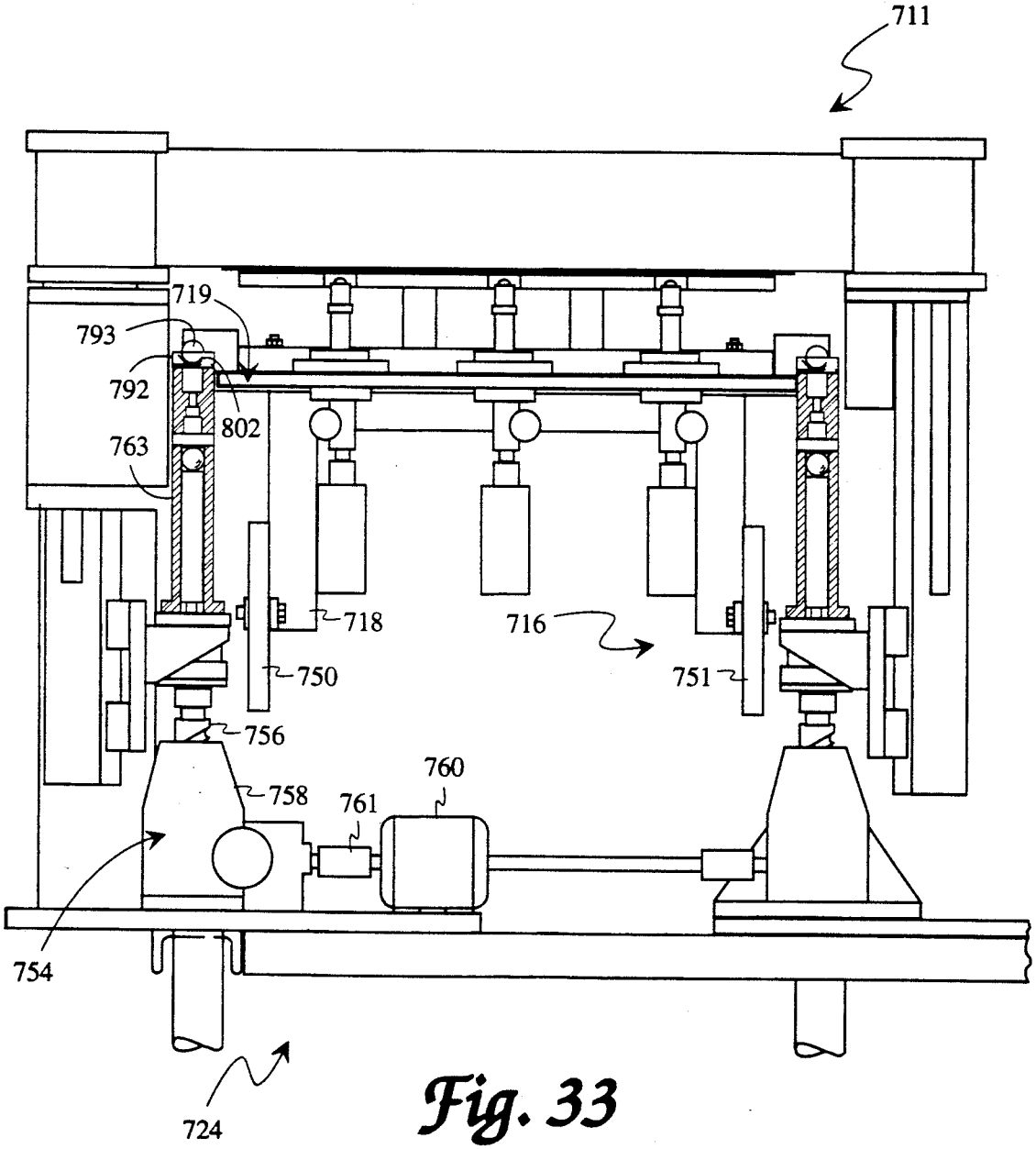
FIG. 33 is a side view of the lower part of the assembly station illustrated in FIGS. 26–31 with the lift assembly in its lowered portion.
Figure 34:
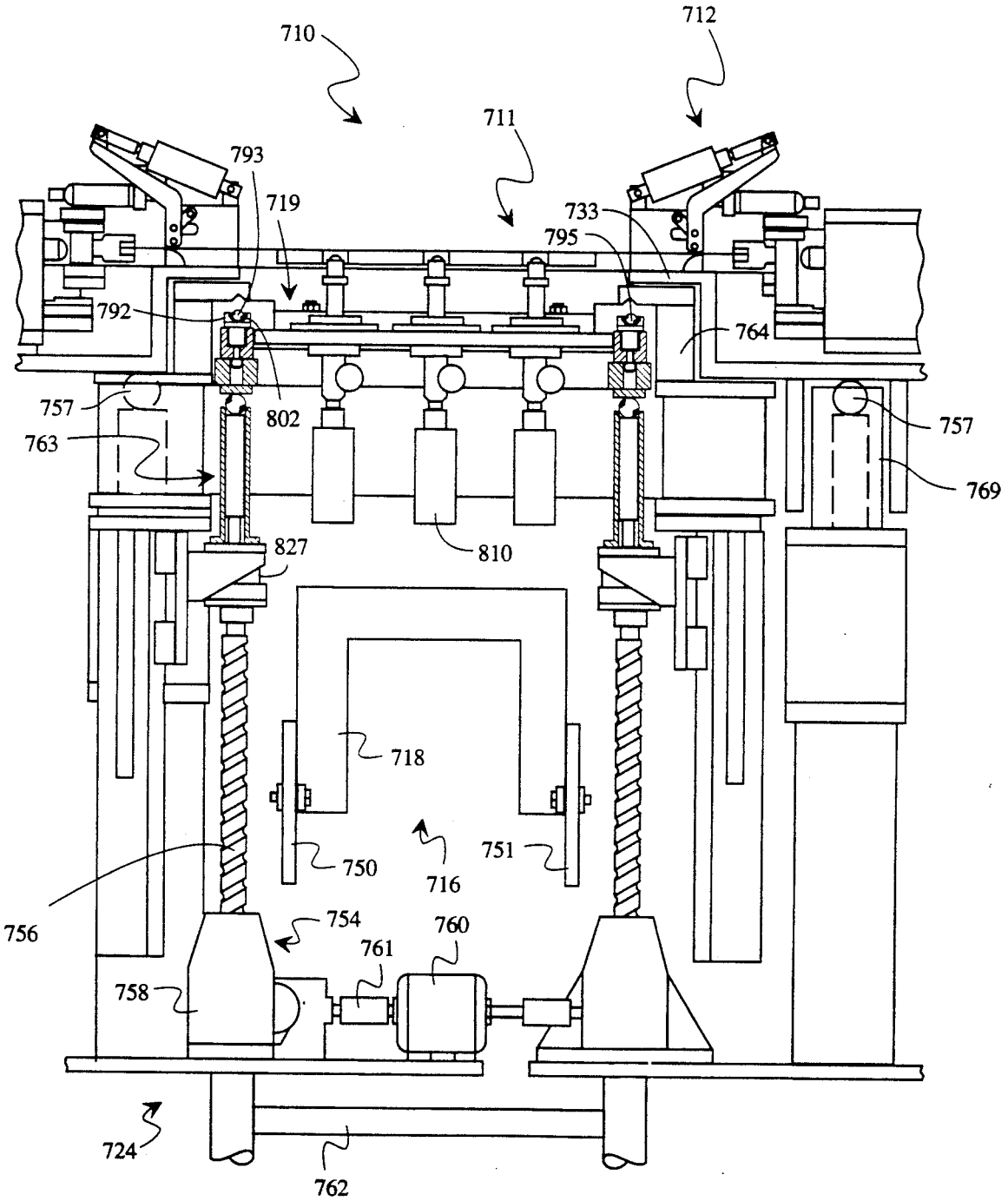
FIG. 34 is a side view of the assembly station illustrated in FIGS. 26 to 33, including a stretching assembly with the lift assembly in its raised position, positioning the mask module in the assembly station.

FIGS. 32, 33 and 34 illustrate the assembly station and particularly the lift assembly and a portion of the shuttle 716 in somewhat more detail although portions of the assembly station are eliminated from FIGS. 32 and 33 to show other parts.

Spaced shuttle side frames 750 and 751 ride on tracks (not shown in these views) to which is fixed the inverted "U" shaped mask module support 718 shown in FIGS. 33 and 34.

The lift assembly 724 is seen in FIG. 32 to include three equiangularly positioned screw drive assemblies 754. Two of the screw drive assemblies 754 are shown in the plane of FIGS. 33 and 34 when actually they are in staggered planes as seen in FIG. 32. Each of the screw drives 754 includes an elongated screw 756 threadedly received on a rotationally mounted nut in nut assemblies 758 which are in turn driven by a motor 760 through drive shafts 761. The lower ends of the screws 756 are connected together by cross members 762(see FIG. 32) that prevent the screws 756 from rotating. Note that cross members 762 are mounted below the shuttle so that the shuttle and its module supports can freely pass through the upper portions of the lift assembly.

The upper ends of each of the screws 756 carry a ball and sleeve post assembly 763 that engages the underside of the modules 719 and 722 to raise them into registration at the assembly station 711, bearing in mind that the mask module 719 is illustrated in FIGS. 33 and 34.

Mask Stretching Assembly

The stretching assembly 712, illustrated in FIGS. 26 to 31, and in somewhat more detail in FIGS. 34, 36 and 38, does not appear in FIGS. 32 and 33 simply to show other parts.

The stretching assembly 712 includes the stretching platform 733 which is roller mounted as by ball bearings 757 on a horizontal surface of the assembly station frame 769 illustrated in FIG. 34. Platform 733 slidably receives four sets of clamping assemblies 765, 766, 767 and 768 shown in FIGS. 36 and 38 with the understanding that some clamps have been eliminated for clarity in FIG. 38. Clamping sets 765, 766, 767 and 768 are controlled by actuation systems 770, 771, 772 and 773 similar to those described in detail above with respect to the embodiments illustrated in the parent application, U.S. Ser. No. 223,475. Actuation systems 770, 771, 772 and 773 are operated by a controller 775 under the control of an appropriate program in microprocessor 731.

The Mask Module

The mask module 719 shown in FIG. 33 is on the shuttle 716 below the assembly station 711 and in FIG. 34 is illustrated after being lifted into the assembly station registration module 764 features 795 by the lift assembly 724. It is also shown in perspective view and partly broken away in FIG. 35. As seen somewhat more clearly in FIG. 35, the mask module 719 includes a generally rectangular outer ring 780 that is identical for both mask and panel modules and it remains the same size for different sized panels and masks. Opposed sides of the ring 780 have pairs of through bores 781, 782, 783 and 784 therein that are camera lens receiving apertures. Apertures 781 and 782 receive the lenses for gauging cameras 786 and 787 and apertures 783 and 784 are empty in the mask module ring but are utilized in the panel module ring to receive the "moment of truth" camera lenses as will appear in the following discussion of the panel module with respect to FIGS. 37 and 38.

Different Size CRTs

Another important aspect of the present interchangeable panel-mask system is its capability of accommodating different size CRTs. Toward this end the panel and mask modules include the outer rings 780 that are identical in configuration that carry the assembly station registration or gauging cameras in the same locations. These outer rings and cameras are the same regardless of the size of the CRT in process in the system. Different size mask and panel supports "hang" on these rings to accommodate different size masks and faceplates. Of course, the mask array cameras are a part and parcel of this internal hanging support and vary from one aperture array size to another.

Ring 780 has upwardly extending registration posts 788, 789 and 790 each of which has radially extending "V" shaped registration grooves 792(see FIGS. 43 to 46) that can be seen in FIGS. 32, 33 and 34 to carry the registration balls 793. Grooves 792 extend radially with respect to the geometric center of the module ring 780. The registration balls 793 engage in three downwardly depending identical V shaped grooves 795 carried by overhanging brackets 797, 798 and 799 fixed to a stationary assembly station registration module 764 seen in both FIGS. 34 and 35.

Figures 35, 35A:
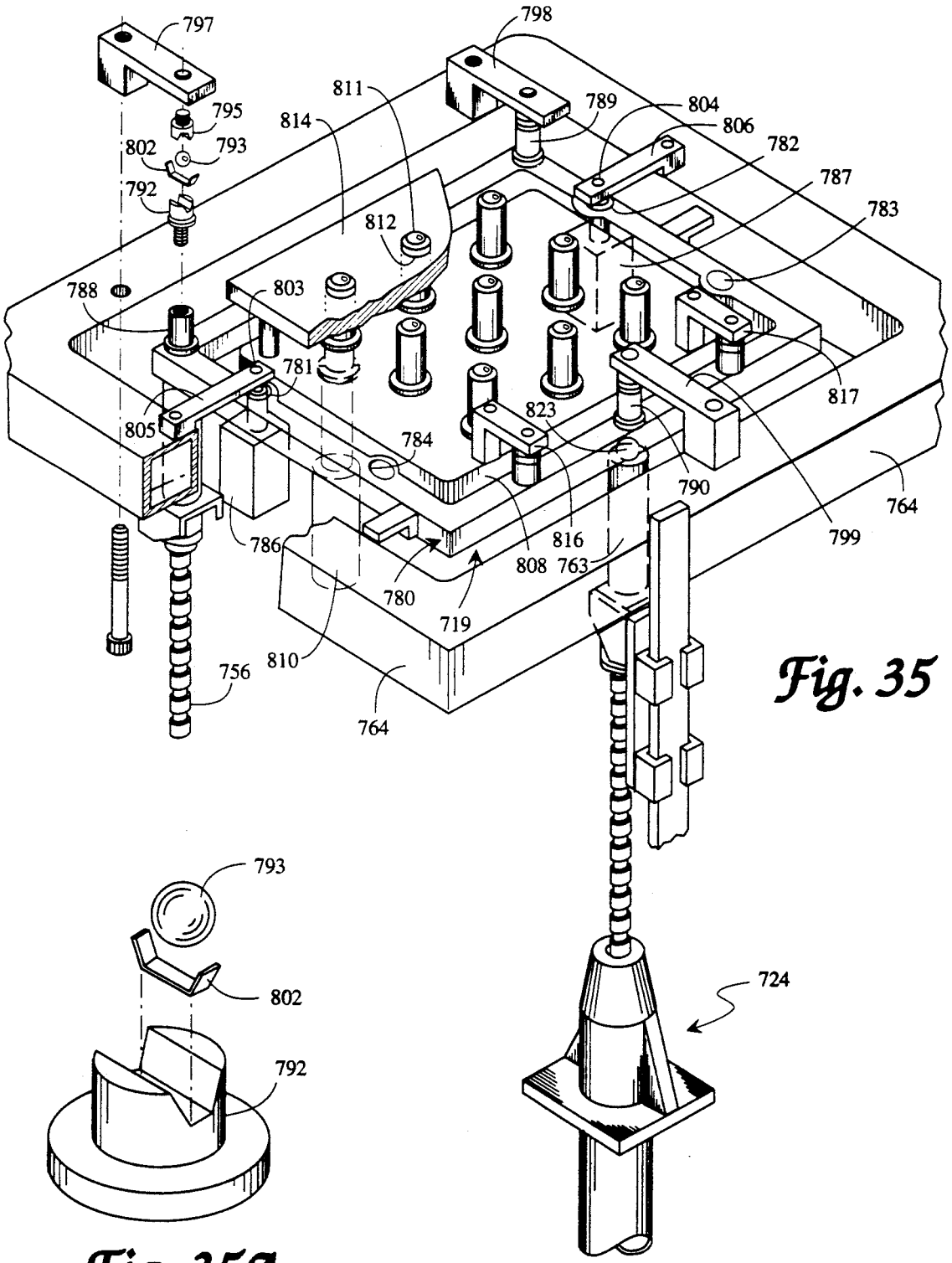
FIG. 35 is a perspective view of the mask module shown in diagrammatic form in FIGS. 26 to 31.
FIG. 35A is an exploded view of one of the assembly station registration features.

As seen in detail in FIG. 35A, the module ring grooves 792 each have a generally "U" shaped leaf spring 802 therein that prevents the registration balls 793 from rolling out of the grooves 792 as the module is shuttled and lifted prior to assembly station registration.

The downwardly depending V shaped grooves 795, referred to herein as the assembly station registration devices or features, cooperate with module mounted balls 793 and V grooves 792 on the mask module 719 to properly register the mask module at the assembly station. Identical V shaped registration grooves and balls are carried by the panel module 722 so that the following description of registration of the mask module at the assembly station should be understood to apply to the panel module as well and it will not be repeated with the below description of the panel module.

Module Registration Maintenance

As seen in FIG. 35, gauging cameras 786 and 787 view targets 803 and 804 on over-hanging brackets 805 and 806 fixed to the registration module 764 to determine the location of the module ring 780 with respect to the assembly station and thus determine whether the module is properly registered. This sensing will identify any wear or problem in the registration features 792, 793, 802 either on the module 719 or the registration features 795 on the assembly station 711. While the outputs from gauging cameras 786 and 787 are utilized herein as a monitoring function, it is also possible that they could be utilized in a control function as well in the mask-panel registration process.

Mask Aperture Array Interrogation

The mask module ring 780 carries a rectangular camera platform 808 that supports an array of nine micro cameras 810 having lenses 811 that project upwardly and extend through apertures 812 in a mask support platform 814. Mask platform 814 is supported on camera platform 808 and has suitable retractable pins (not shown) for locating the mask on the mask platform 814 at the mask loading station that are retracted after engagement of the clamp sets 765, 766, 767 and 768 shown in FIG. 36 at the assembly station 711.

The corner ones of the cameras 810 view the corner apertures of the aperture array in the mask. The intermediate cameras look at the mid-border apertures and the central camera the center aperture in the array.

The optical axes of the cameras 810 are aligned with the corresponding apertures in the reference or "master" mask that represents the model to which all of the masks are stretched in accordance with the present system. Thus, if any given mask has corner apertures and mid apertures and a central aperture that register, after stretching and shifting, exactly with the optical axes of the cameras 810—conformance of the production mask to the master model is achieved. Of course, as a practical matter, there is some acceptable deviation from that model in production.

A master gauging device while not shown in the drawings is provided for "morning" or reference gauging the mask aperture cameras 810 as well as the gauging cameras 786 and 787, all with respect to module ring 780.

The mask aperture camera platform 808 is suspended in the mask module ring 780 by three brackets only two of which are shown at 816 and 817 in FIG. 35 with the understanding one is provided under the broken away mask platform 814 in FIG. 35 that cannot be seen in this view.

An important aspect of the present invention is the camera platform 808 can be removed from the module ring 780 and replaced with another camera platform for a different size mask. The mask module ring 780 and gauging cameras 786 and 787 can remain and be used for a range of panel-mask assembly sizes.

The lift assembly vertical screws 756 are shown in FIG. 35 lifting the lift ball and sleeve post assemblies 763 to engage the underside of the far corners of the mask module ring 780 and the underside of the center front of the mask module ring.

Lift Assembly

In FIGS. 43 to 46 the sequence of operation of one of the lift ball and sleeve assemblies 763 is illustrated to show more clearly the process of registering the mask and panel modules to the registration features 795 at the assembly station 711. Of course all three of the assemblies 763 operate simultaneously in the same fashion.

Figure 43:
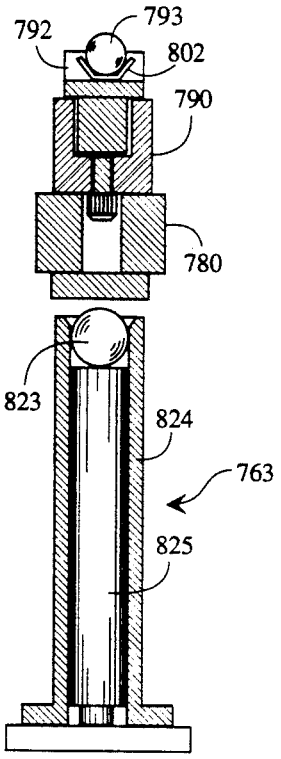
FIGS. 43 to 46 are sequential fragmented sectional views of one of the module lift assembly posts raising a module to the assembly station.

In FIG. 43, the mask module outter ring 780 is supported on the shuttle in the same position illustrated in FIG. 33. As nut assemblies 754 (FIG. 33) rotate, screws 756 move simultaneously upwardly and balls 823, partly within sleeves 824 supported on pistons 825, engage pads 821 mounted on the underside of the mask module outter ring 780. Note in the retracted or "captured" position of balls 823 illustrated in FIG. 44, balls 823 slightly project from sleeves 824. At the same time, pistons 825, which are reciprocably mounted in sleeves 824, are in their lowermost positions with respect to the sleeves 824. The screws 756 continue their upward movement until module 719 arrives at a point just prior to engagement of balls 793 with the registration feature grooves 795. At this time air motors 827 mounted atop the screws 756 (FIG. 34) are actuated to bias pistons 825 upwardly. At the same time, screws 756 are retracted by nut assemblies 758 downwardly which lower sleeves 824 to the position illustrated in FIG. 46 where balls 823 are free from their captive positions (illustrated in FIGS. 43 to 45) in sleeve 824. The balls 823 are thus free to roll on the flat upper end of pistons 825, as seen in FIG. 34.

This action drives the mask module registration balls 793 to their engaged positions with registration feature station V grooves 795, and at the same time frees the mask module 719 for lateral motion on balls 823, and this freedom permits all three of the balls 793 to properly engage and register with the V grooves 792 and 795 and provide consistent repeatable precise registration of the modules in the assembly station.

Figure 44:
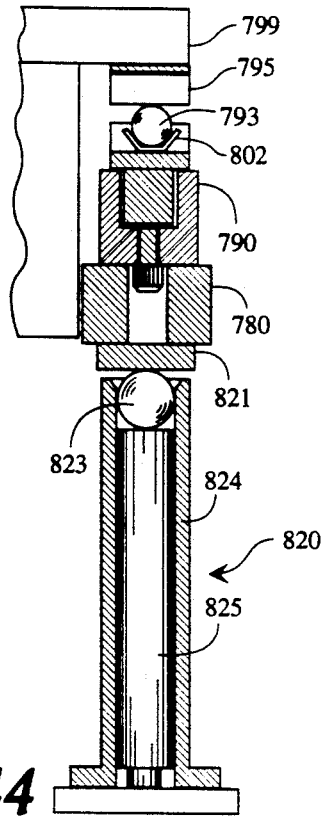
Figure 45:
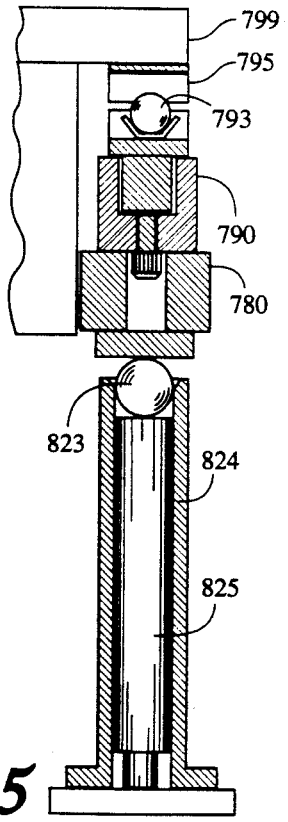
Figure 46:
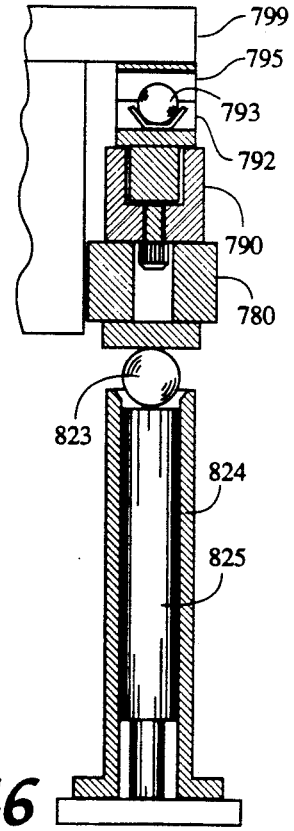

When the lift assembly 724 begins returning the modules to the shuttle support 718 or 720, the screws 756 are intially raised while air motors 827 are depressurized to retract the pistons 825 as the sleeves 824 move upwardly to recapture balls 823 restoring the relative position of the members illustrated in FIG. 44. Thereafter, screws 756 are lowered until the module is reseated on the module support 718 or 720.

Panel Module

Faceplate loading at the faceplate loading station has been a vexing problem because it is not practically possible to devise a positive clamping system that can achieve the requisite reliability and consistency. For this reason we have devised a loading fixture in the faceplate module in which the faceplate is biased against horizontal registration elements but is free to float with vertical registration elements. The vertical registration elements are part of a skate assembly that is free to float horizontally in the panel fixture, as further explained below.

In FIG. 37 panel module 722 is exploded for clarity and in FIG. 38 the panel module is shown mounted at the assembly station in a manner similar to FIG. 35 but with the stretching platform assembly 712 exploded above it so panel module camera operation can be viewed.

As seen in FIG. 37 panel module 722 includes a panel module outter ring 828 that is identical to the mask module ring 780 illustrated in FIG. 35 including camera lens holes 830, 831, 832 and 833 with holes 830 and 831 receiving the lenses of gauging cameras 835 and 836, and holes 832 and 833 receiving the lenses of "moment of truth cameras" 838 and 839. All of these cameras are mounted on the underside of the ring 828. Thus it can be seen the panel module ring 828 has two additional cameras compared to the mask module ring, these of course being the moment of truth cameras 838 and 839.

The panel module 722 includes a panel loading and holding fixture 841 that is described in more detail below with respect to FIGS. 39 to 42. This panel holding fixture 841 is supported on the ring 828 by three outwardly extending brackets 843, 844 and 845. The loading and holding fixture 841 carries spaced panel interrogating cameras 846 and 847 that are positioned to view the A-B points on the viewer side of the panel 730 shown in FIG. 47. Cameras 846 and 847 locate the position of the A-B fiducial marks on the panel and thereby the location of the screen on the panel and provide the data input A-B 732 to the microprocessor 731 illustrated in FIG. 36.

The on-board interrogation of the panel fiducial marks by the panel interrogation cameras 846,847 has advantages over alternative screen interrogation choices. Firstly, if the screen itself is "pre-interrogated" in relation to the fiducial marks prior to insertion in the assembly station, and preferrably at a station separate from the system 710, no optical sensing devices need to be registered with the faceplate during the system production cycle. Also, moment of truth verification of screen to mask registry is made possible.

Thus, the mounting of the A and B panel module cameras below the panel becomes an attractive location even though it suggests that the fiducial marks be on the viewer side of the panel. It should be noted, that the fiducial marks according to the present embodiment are outside the perimeter of the screen and outside the perimeter of mask mounting rails, so that the fiducial marks can be conveniently back lit from illumination sources carried by the welding frame that project light through the mask and through the uncoated area of the faceplate on the opposite, or interior, side from the viewer-side placed fiducial marks.

The mask is usually provided with spaced apertures, or location holes, in its border area outside the aperture array that receive locating pins to locate the mask on its module in the assembly. Since these pins are retracted just prior to mask clamping and leave the assembly station with the mask module prior to panel module insertion, these location holes provide a convenient path for back lighting the A and B fiducial marks on the viewer side of the panel, and thus according to the present embodiment, the fiducial marks are positioned in vertical alignment with the mask location holes.

Alternatively, it is also possible to front, or below, light the A and B fiducial marks on the viewer side of the panel.

Panel module ring 828 also has registration posts 850, 851 and 852 each having V blocks and balls identical to posts 788, 789 and 790 on the mask module shown in FIG. 35. Thus, as seen in FIG. 38 the panel ring 828 registers to the assembly station registration module 764 in exactly the same way as the panel ring 780.

Also, the panel module 722 is positioned in the assembly station by the lift assembly 724 in the same manner as the mask module 719. Gauging cameras 835 and 836 view the registration module gauging targets 803 and 804 to determine and monitor proper registration at the station while moment of truth cameras 838 and 839 view the moment of truth targets 744 and 745 on stretcher platform 733 to provide the final verification of screen location with respect to mask location described above, with this data being input at 747 in FIG. 36 to microprocessor 731.

Panel Loading Fixture

Figure 40:
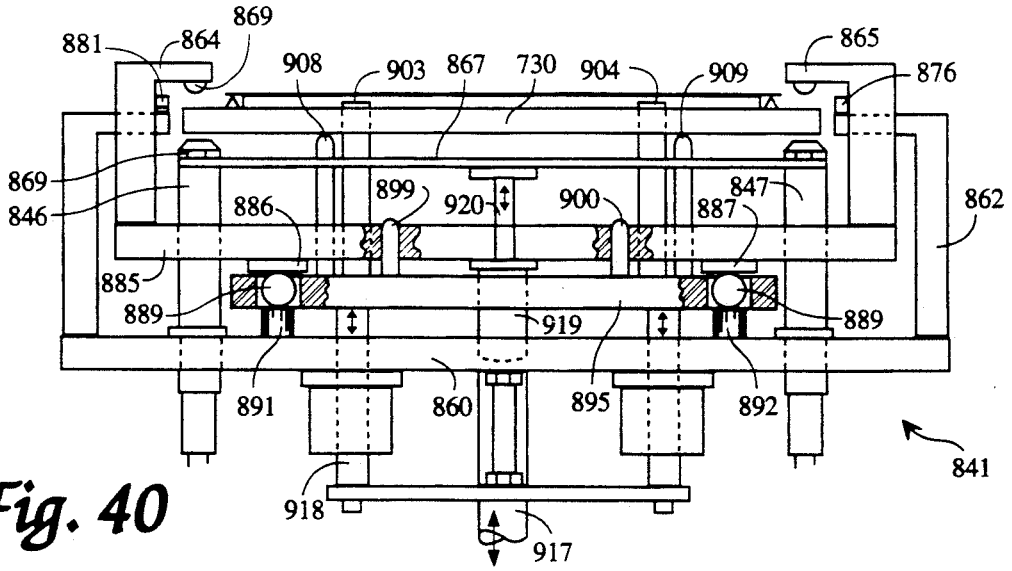
FIGS. 40 to 42 are somewhat simplified sequential longitudinal sections through the face panel fixture carried by the panel module illustrated in FIG. 39.
Figure 41:
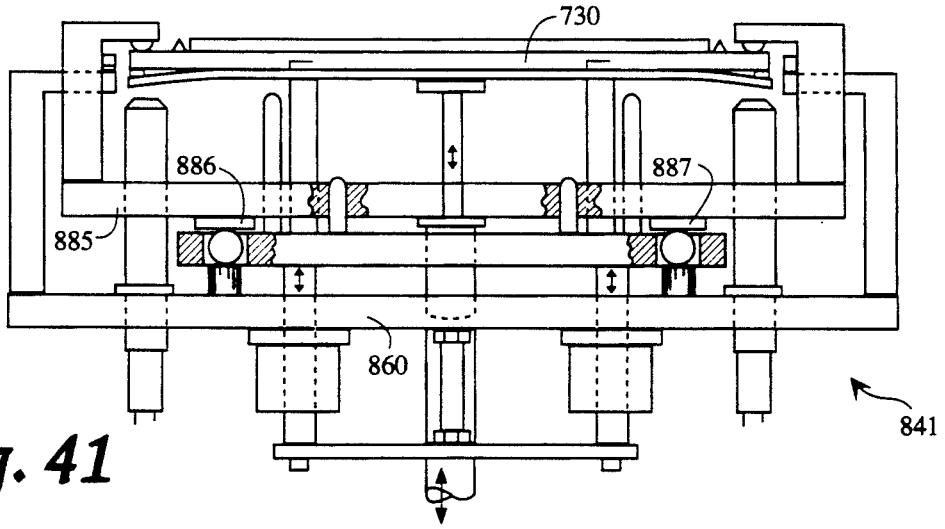
Figure 42:
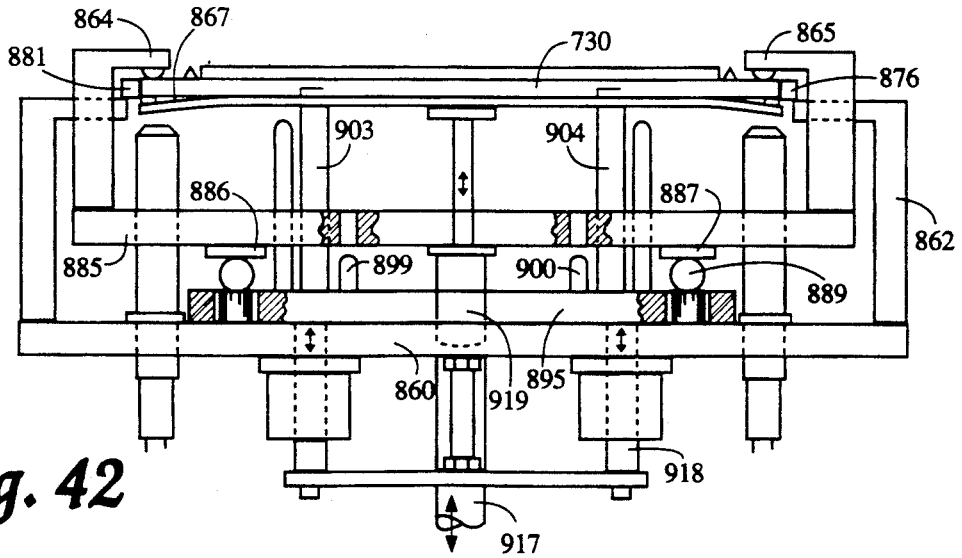

In FIG. 39, the panel loading and holding fixture 841 is shown in somewhat more detail and its loading sequence is illustrated in FIGS. 40 to 42.

The panel, or faceplate, loading and holding fixture 841 is supported in the panel module ring 828 (not shown) by brackets 843–845 similar to hanging brackets 816 and 817 on the mask module camera platform 808 (FIG. 35). It should be understood that different size panel fixtures 841 can be utilized with panel ring 828 to accommodate the manufacture of different size CRTs.

As seen in FIG. 40, panel module camera platform 860 carries the A-B cameras 846 and 847 and has peripheral, upwardly extending frame 862 supported thereon for carrying the panel horizontal registration features, as explained below.

As seen in FIGS. 39–42, the panel 730 is biased upwardly into engagement with three vertical registration stops 864, 865, and 866 by a large "T"-shaped leaf spring 867 having nylon bumpers 869, 870 and 871 at its three ends. Horizontal registration is effected by biasing the panel 730 into engagement with rollers 874, 875 and 876 providing the three point horizontal registration desired. The panel is biased against these registration rollers 874–876 by horizontally acting pneumatically biased roller assemblies 879 and 880 having rollers 881 and 882 that directly engage the side edges of the panel 730 (shown only in FIGS. 40–42). The biasing asembly roller 879 is mounted on the peripheral frame 862. The biasing assembly 880 is positioned on a door 883 that pivots downwardly to permit the insertion of the panel 730 into the fixture 841. The door panel 883 is shown in dotted lines in FIG. 39 in its open position and in solid lines in its closed position.

The vertical alignment stops 864, 865, and 866 described above float horizontally in the fixture 841 to minimize friction between these elements and the panel 730 and to permit the biasing roller assemblies 879 and 880 to accurately register the panel to the rollers 874, 875 and 876.

Toward that end, the vertical alignment stops 864, 865, 866 are carried by a "T" shaped skate member 885 having three bearing pads 886, 887, and 888 (See FIGS. 39 to 42) on its underside. The pads 886, 887, 898 are supported on three balls 889 that in turn rest on three posts 891, 892 and 893 fixed to panel module camera platform 860.

A vertically reciprocal plate 895 is mounted on panel module camera platform 860 for movement on posts 891 892 and 893. Two guide pins such as 899, 900 are mounted on the plate 895 and extend through the skate member 885 to locate the skate member during loading.

This plate 895 also carries four nylon sideposts 902, 903, 904 and 905 that engage the sides of the panel (see FIGS. 39 and 41) during loading and four nylon support posts 908, 909, 910 and 911 that support the underside of the panel 730 during loading as seen in FIGS. 39 and 41.

In FIG. 40, panel fixture 841 is illustrated in its panel loading position which would be at loading station 727 illustrated in FIG. 26 et seq. After door 883 has been opened and the previously joined front panel assembly removed, a new panel 730 is inserted through the door on top of the support posts 908, 909, 910 and 911 and into engagement with the side posts 902, 903, 904 and 905. (FIGS. 40–42 eliminate posts 902 and 905 for clarity). Door 883 is then closed and its stops 914 and 915 as seen in FIG. 39 engage the front of the panel urging the panel towards the back sideposts 903 and 904. The sideposts 902–905 provide an initial loading constraint for positioning the panel, which will later be released therefrom, as further explained below.

In the loading position illustrated in FIG. 40, the platform 895 is in its raised position, positioned there by a vertical actuator assembly 917 secured to the camera platform 860 and having rods 918 engaging the underside of plate 895. In this position plate 895 encapsulates the balls 889, preventing their horizontal rolling movement.

As seen in FIG. 42, after the panel is loaded, an air cylinder 919 grounded to skate 885 is activated to drive rod 920 lifting the leaf spring 867 into the panel 730. The panel moves away from the support posts 908, 909, 910 and 911 into engagement with the vertical stops 864, 865, and 866 above the skate member 885.

As seen in FIG. 42, the plate 895 is then lowered by the actuator rods 918 thus lowering the side posts 902, 903, 904 and 905 away from the sides of panel 730 and permitting the biasing assemblies 879 and 880 to bias the panel into the horizontal rollers 874, 875 and 876 which are vertically aligned on the upper peripheral frame 862 with the panel position illustrated in FIGS. 41 and 42.

With the plate 895 in its lower position illustrated in FIG. 42, skate member 885 is free to shift horizontally on balls 889. Note that in the FIG. 42 position, the guide pins 899 and 900 are free of the skate 885.

The panel fixture 841 permits the panels to be loaded without requiring any accurate clamping at the loading station and without the use of tooling balls attached to the panel, such as seen in the embodiment of FIGS. 49–57. The panel itself is permitted to float horizontally with the skate 885 with a minimum of friction to the extent permitted by the biasing assemblies 879 and 880. If there is a slight shifting of the panel 730 during transit the biasing assemblies 879 and 880 will always return the panel against the registration rollers 874, 875 and 876. The same is true for panel movement in the vertical direction to the extent permitted by leaf spring 867 but the spring will always return the panel to the vertical registration features 864, 865 and 866.

Figure 47:
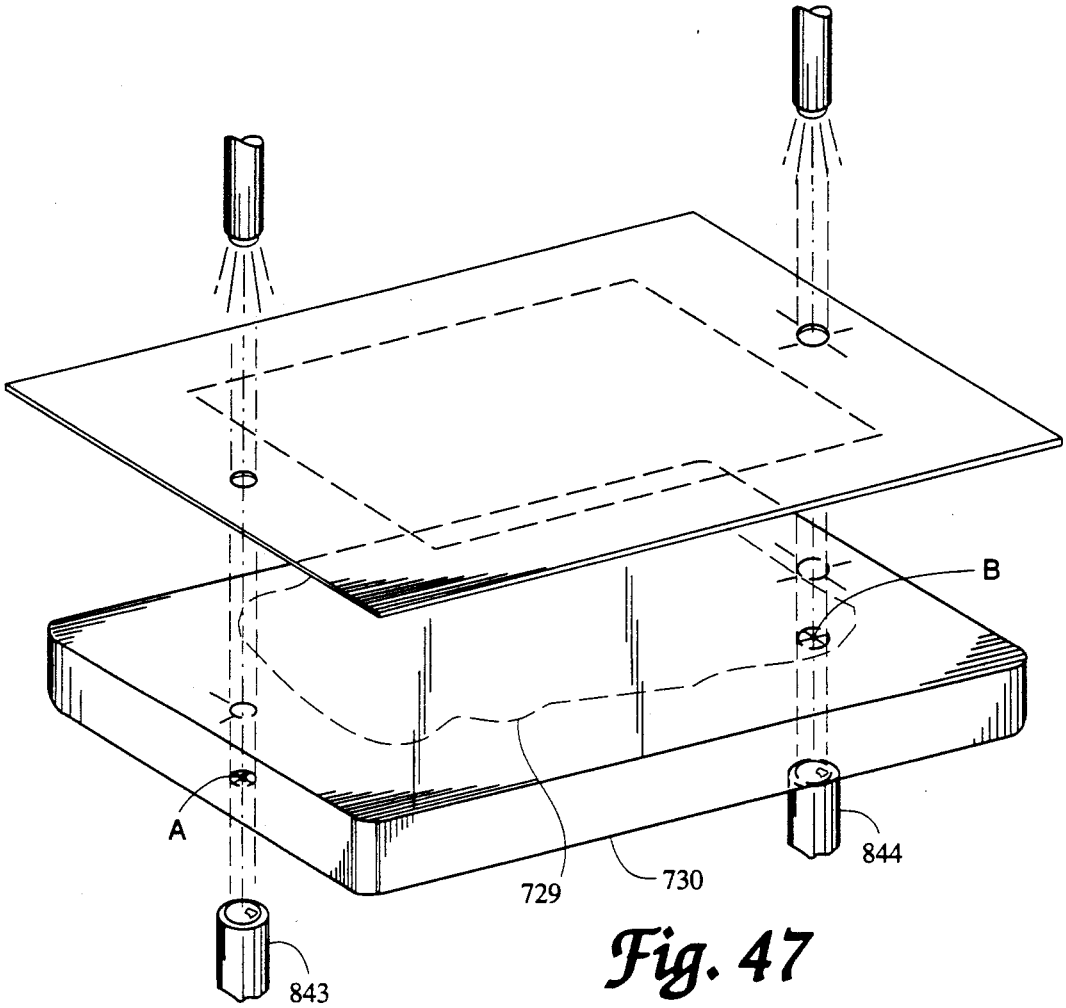
FIG. 47 illustrates in perspective form an apparatus for back lighting fiducial screen locating marks on the viewer side of the face panel.
Figure 48:
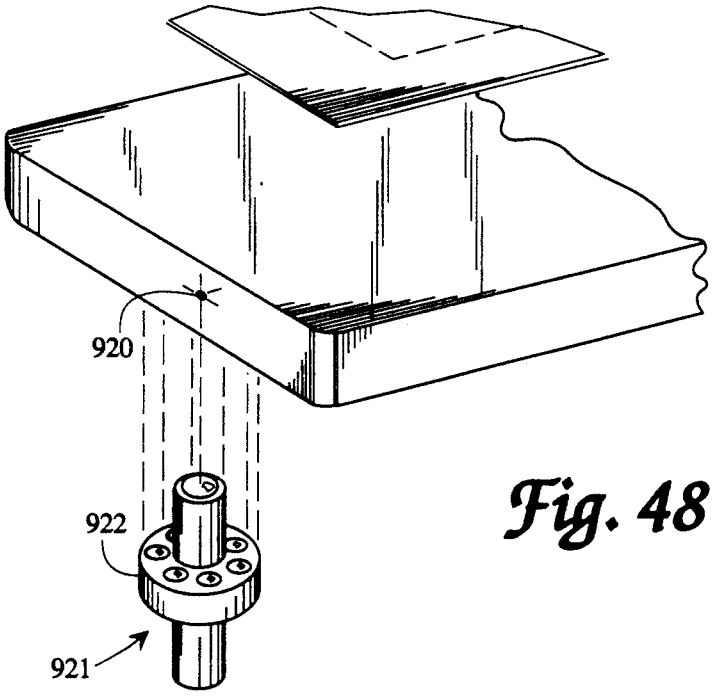
FIG. 48 is perspective fragmentary view similar to FIG. 47 illustrating an apparatus for front lighting viewer side fiducial marks on the face panel.

In FIG. 48, an alternate arrangement is shown for viewing the panel fiducial marks. Here viewer side fiducial marks 920 are viewed by cameras 921 each having a surrounding light ring 922 that provides front lighting of the marks, eliminating the necessity for back lighting shown in FIG. 47. It will be appreciated that the panel, as shown in FIGS. 47–48, will have the appropriate mask support rails affixed thereto at this time.

Alternative Embodiment FIGS. 49–57

Figure 49:
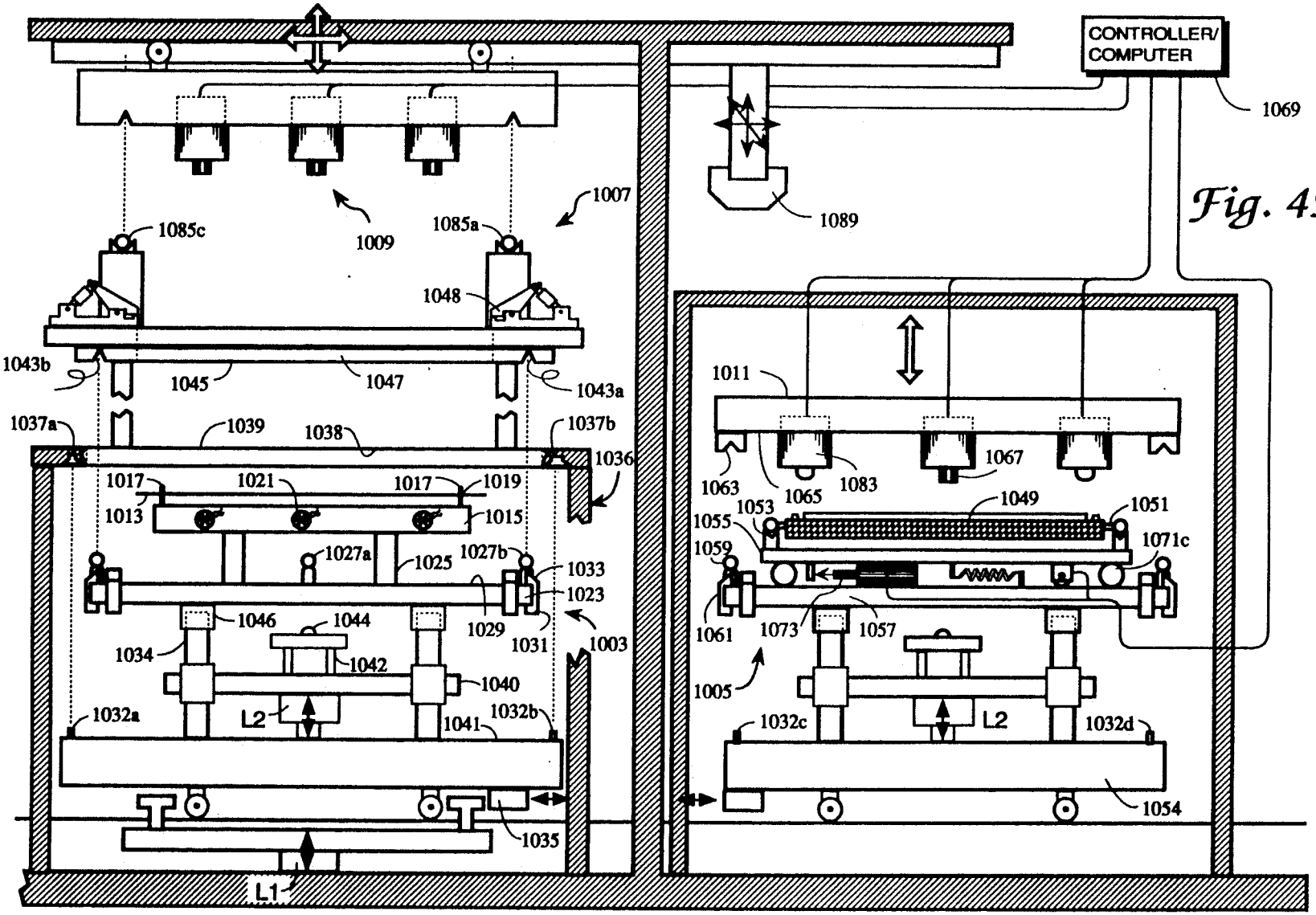
FIG. 49 is a front elevation of an alternative embodiment of the present invention.
Figure 51:
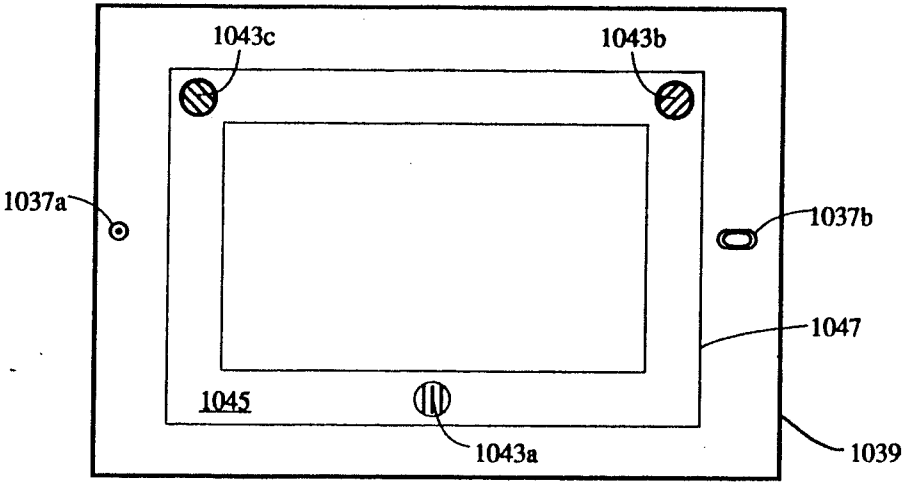
FIG. 51 is a bottom view of the assembly station registration features of the embodiment of FIG. 49.
Figure 53:
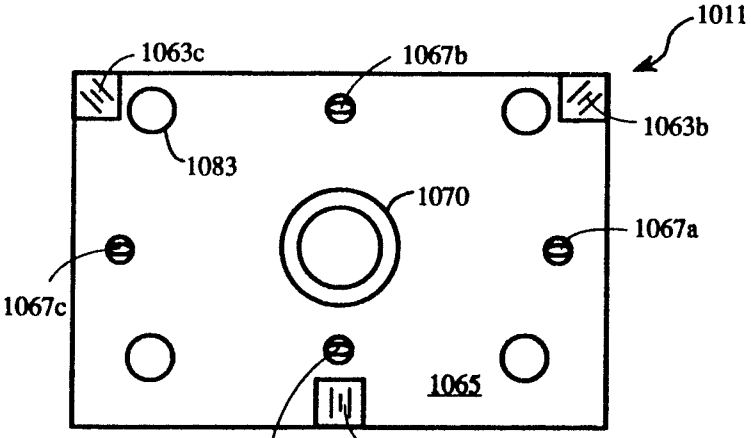
FIG. 53 is a bottom view of the panel interrogation camera array of the embodiment of FIG. 49.

As seen schematically in FIG. 49, an alternative embodiment of the present invention largely uses mechanical features or fixturing, to ensure reproducible, constant, positioning of the mask module 1003 and panel module 1005 with the assembly station 1007 and the mask interrogation and panel interrogation camera arrays 1009, 1011, respectively.

Optical Interrogation

The preferred method of optical interrogater is disclosed and claimed in co-pending application Ser. No. 07/799,590; filed Nov. 27, 1991, commonly owned herewith.

Optical interrogation of the mask and panel with microscope video cameras allows the actual location of the fiducial marks and mask apertures to be determined. More processing information is thereby attained than with a simple nulling of an aperture and indicator resulting in a greater degree of control over the mask-to-screen registration process. Digital processing of the visual information will also allow for higher operating speeds.

In setting up an optical interrogation system several considerations need to be addressed. For example, the field of view of each camera should be large enough to encompass any expected deviation in the location of the targeted aperture, i.e., screen fiducial marks or mask apertures. Also a calibration system must be in place to determine magnification errors and positional reference points to provide a baseline for system operation. A calibration plate having known dimensions and geometry of the targeted calibration apertures may be suitably employed.

Figure 57:
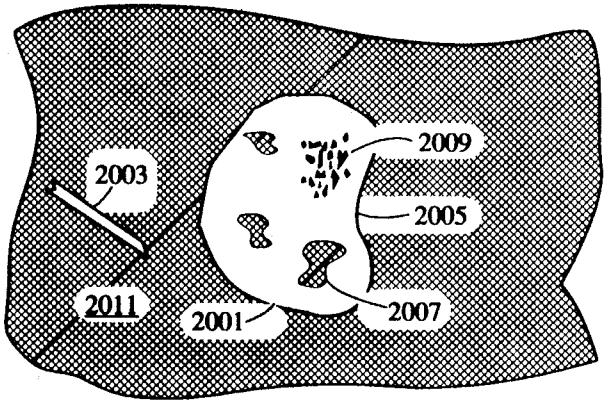
FIG. 57 is a representation of a panel fiducial mask and surrounding area as might be seen by the panel interrogation camera array.

Referencing FIG. 57, filtering of the visual information obtained by the cameras is required to select the targeted apertures 2001 over extraneous scratches 2003 or the like and to obtain a good centroid computation for the aperture. The centroid computation allows for precise measurement of aperture location independent of camera focus and even though the aperture itself may have an irregular outline 2005 and/or contain visual artifacts 2007 or noise 2009 within the aperture outline. This is especially true in the case of the screen fiducial mark apertures which are commonly formed in the black surround, or grille, material 2011 outside the phosphor deposition area. Thus, the fiducial marks may commonly have artifacts of unremoved grille material within the aperture. Also, noise may be present due to the uneven specular reflection of incident inspection light off of the uneven internal antiglare surface of the panel upon which the screen is placed. Mask apertures are not nearly as problematic in filtering since they are regularly shaped and present no transmission barrier to the inspection lighting.

Processing speed may be increased, and hardware requirements decreased, by utilizing a parallel processing system which retains only the light/dark transition data in a camera frame. This processing system utilizes a frame grabber interface to a microcomputer processor. The frame grabber has a memory storage for each camera in an interrogation array for mapping the field of view, or frame, of that camera. In the preferred embodiment a frame from the camera is grabbed, or stored, in a 256×256 pixel matrix, with each pixel being assigned either a light or a dark, i.e., no light, value, e.g. 1 or 0, respectively. The frame grabber then outputs in parallel each camera's frame to the microcomputer for the corresponding pixel location evaluation of whether a dark/light transition has occurred in a horizontal scan line of the matrix by performing a logical exclusive or for each pixel value with the previous pixel value on the same line. The transition occurrence locations are then stored in the computer memory as a "transition table". Information relating to pixels where no transition occurred is discarded. Transition direction, i.e., dark-to-light or light-to-dark is determined by a logical AND between the pixel value and transition value. The transition direction is stored in a separate table.

Filtering of the transition data then takes place in the computer to select the necessary apertures, hereinafter: "objects", on the panel and mask to be used for registration of the screen and mask. Noise, or artifact, filtering may be based on minimum light/dark transition intervals on the horizontal video scan line and by assuming that the aperture will be reasonably close to it's ideal, or intended, shape so that the light/dark transition interval lengths of the aperture will conform to the known shape. Processing of the outline of the object by seeking dark-to-light transitions from the "outside in" will confirm the object shape. A centroid is concurrently calculated during the outline seek by known formulae. If an aperture conforms to the predetermined shape and is identified as having a center of gravity closest to the target location it is selected as an object, coded, and its location and center of gravity are stored.

Registration Elements

Figure 50:
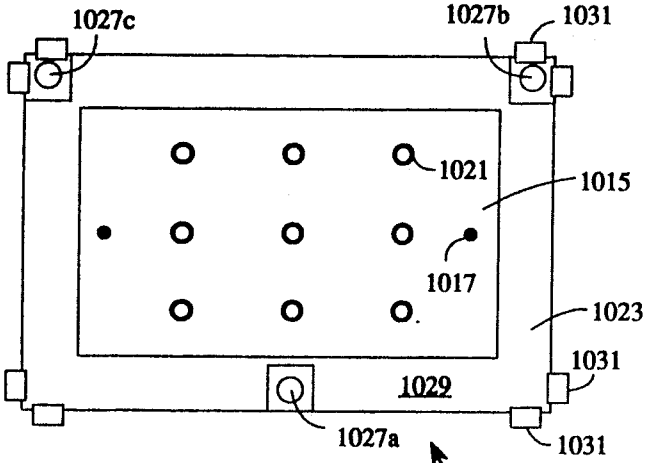
FIG. 50 is a top view of the mask module first stage of the embodiment of FIG. 49.
Figure 52:
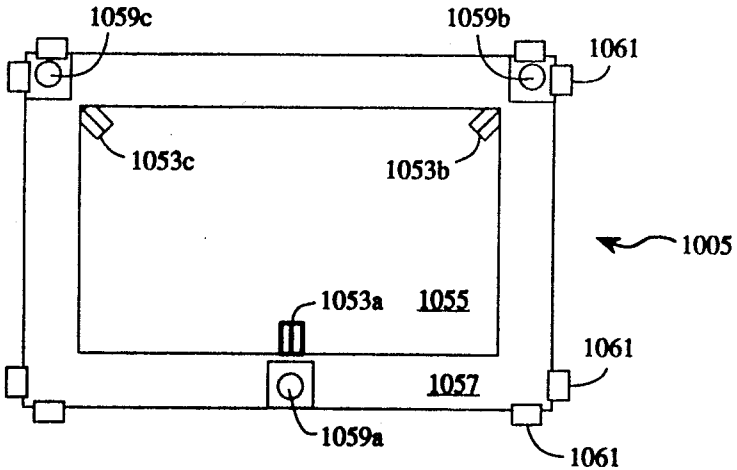
FIG. 52 is a top view of the first and second panel module stages of the embodiment of FIG. 49.

Referring now to the mask module 1003 of FIG. 49, also seen in top view in FIG. 50, the mask 1013 is positioned on the mask module first stage 1015 by the mask positioning pins 1017 which extend through mask position holes 1019 in the mask 1013. The mask 1013 is lit for interrogation purposes by LED's 1021 carried in the mask module first stage 1015. The mask module first stage 1015 is fixedly positioned to, and above, the mask module second stage 1023 by means of columns 1025. The mask module second stage 1023 has three registry balls 1027*a, b, c* secured to its upper surface 1029 and spaced approximately 120° apart.

Two corner positioning units 1031 are fastened on adjacent edges of each corner the mask module second stage 1023 and present inclined faces 1033 upwardly to aid in gross module positioning in the assembly station 1007, as further explained below.

In operation, the mask 1013 is loaded on the mask module 1003 when the mask module is positioned outside the assembly station 1007. A transport system 1035, such as the previously described shuttle, brings the mask module 1003 into alignment underneath the assembly station 1007 and over the primary, or gross, lifter L1.

The primary lifter L1 elevates the entire module. Should the module 1003 be mispositioned, corner positioners 1033 will contact the edges of the assembly station frame 1036 at lower assembly station plate aperture 1038 thus shifting the module 1003 on the primary lifter L1 to a centered position within the assembly station 1007.

The mask module base platform 1041 is provided with a pair of opposed registration pins 1032*a, b* on its upper surface which respectively mate with a hole 1037*a* and slot 1037*b* formed in the lower assembly station plate 1039. Through mating of these elements 1037*a, b* and 1032*a, b* initial registration of the mask module 1003 in the assembly station 1007 is achieved which is very close to the ultimate registration desired.

In order to ultimately register the mask module 1003 in the assembly station 1007 to the tolerances required, a fine positioning lifter is employed. The secondary, or fine, lifter L2 carried on the module base platform 1041 elevates the third module stage 1040, which in turn contacts the second stage 1023 through a platform 1042 mounted on the third stage 1040. The platform 1042 carries a spring-loaded ball bearing 1044.

Cups 1046 are attached to the second stage underside and overlay posts 1034 running between the base platform 1041 and the third and second module stages, 1040, 1023, respectively. As the spring-loaded ball bearing 1044 contacts the second stage 1023, the second stage floats horizontally, to the extent of the spacing between the cups 1046 and the posts 1034. The first and second mask module stages 1015 and 1023, respectively, are thus raised to the operating height of the assembly station 1007; bringing the mask module registration balls 1027*a,b,c* into a constant position determined by three V-grooves 1043*a,b,c* (FIG. 51) located on the underside 1045 of the assembly station platform 1047.

The mask 1013 can then be grasped and supported by tensioning clamps 1048 in the predetermined position as determined by the registry of the assembly station V-grooves 1043*a,b,c* and the mask module registry balls 1027*a,b,c*, and the mask positioning pins 1017. The mask module 1003 can then be withdrawn from the assembly station.

Concurrently with the above-described mask-loading procedure, the screened panel 1049 is loaded into the panel module 1005. The panel 1049 has previously described fiducial marks (not shown) which relate directly to the phosphor screen configuration, i.e., placement, size, shape, thereon.

As seen in FIG. 49, the panel 1049 has panel positioner balls 1051 glued thereon which mate with V-grooves 1053*a,b,c* (FIG. 52) located on the first stage 1055 of the panel module 1005, for predetermined positioning of panels, as is known in the art.

The panel module first stage 1055 is movably supported on the panel module second stage 1057, as further explained below, to affect in-gross movements of the panel.

The panel module second stage 1057 has located thereon registry balls 1059*a,b,c* and corner positioning units 1061 identical in form and placement to the registry balls 1027*a,b,c* and corner positioners 1031 of the mask module second stage 1029. Thus, the first and second panel modules stages 1055, 1057 define a panel registration system. The panel module base platform 1054 has base platform positioning pins 1032*c,d* identical in form and function to those on the mask module 1003.

The panel interrogation camera array 1011 has three V-grooves 1063*a,b,c* (FIG. 53) located on the underside 1065 thereof for meeting with the panel module registry balls 1059*a,b,c*,.

After the panel 1049 is positioned on the panel module first stage 1055, the panel interrogation camera array 1011 is lowered into predetermined position on the panel module 1005. Four fiducial mark cameras 1067*a,b,c,d* carried on the array 1011 are thereby aimed at the four fiducial marks (not shown) whose configuration relate directly to the configuration of the screen on the panel. Such direct relation may be achieved by forming the fiducial marks with the same method and apparatus used to apply the screen. The fiducial marks may be illuminated as by light 1070 or beneath the panel with LEDs (not shown) as desired. The fiducial marks will be read and entered into a computer/controller 1069 which determines the screen configuration corresponding to the fiducial mark reading in order to determine the type of stretching for the mask in the assembly station and/or any displacement of the panel required to bring the screen axes and mask axes into alignment.

Figure 56:
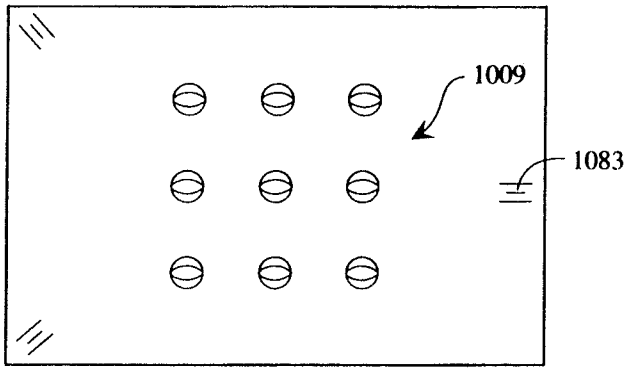
FIG. 56 is a bottom view of the mask interrogation camera array of the embodiment of FIG. 49.
Figure 55:
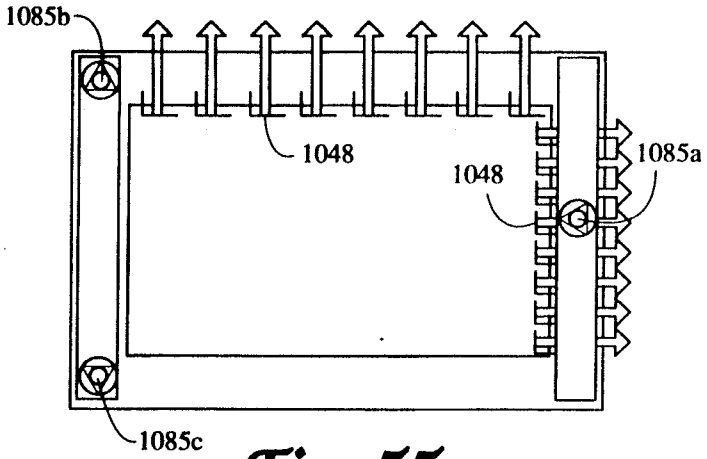
FIG. 55 is a top view of the assembly station of the embodiment of FIG. 49, showing mask interrogation camera array registration features and schematically indicating one half the clamping elements.

The mask is then stretched and interrogated by mask camera array 1009 for adequacy of the resultant aperture array pattern, and adjusted if necessary. Positional accuracy of the mask camera array 1009 is assured through a three point ball and groove registry system as seen in FIGS. 55 and 56 with grooves 1083 located on the camera array and balls 1085 located on the assembly station 1007 over the stretch clamps 1048, only half of which are shown in FIG. 55.

Figure 54:
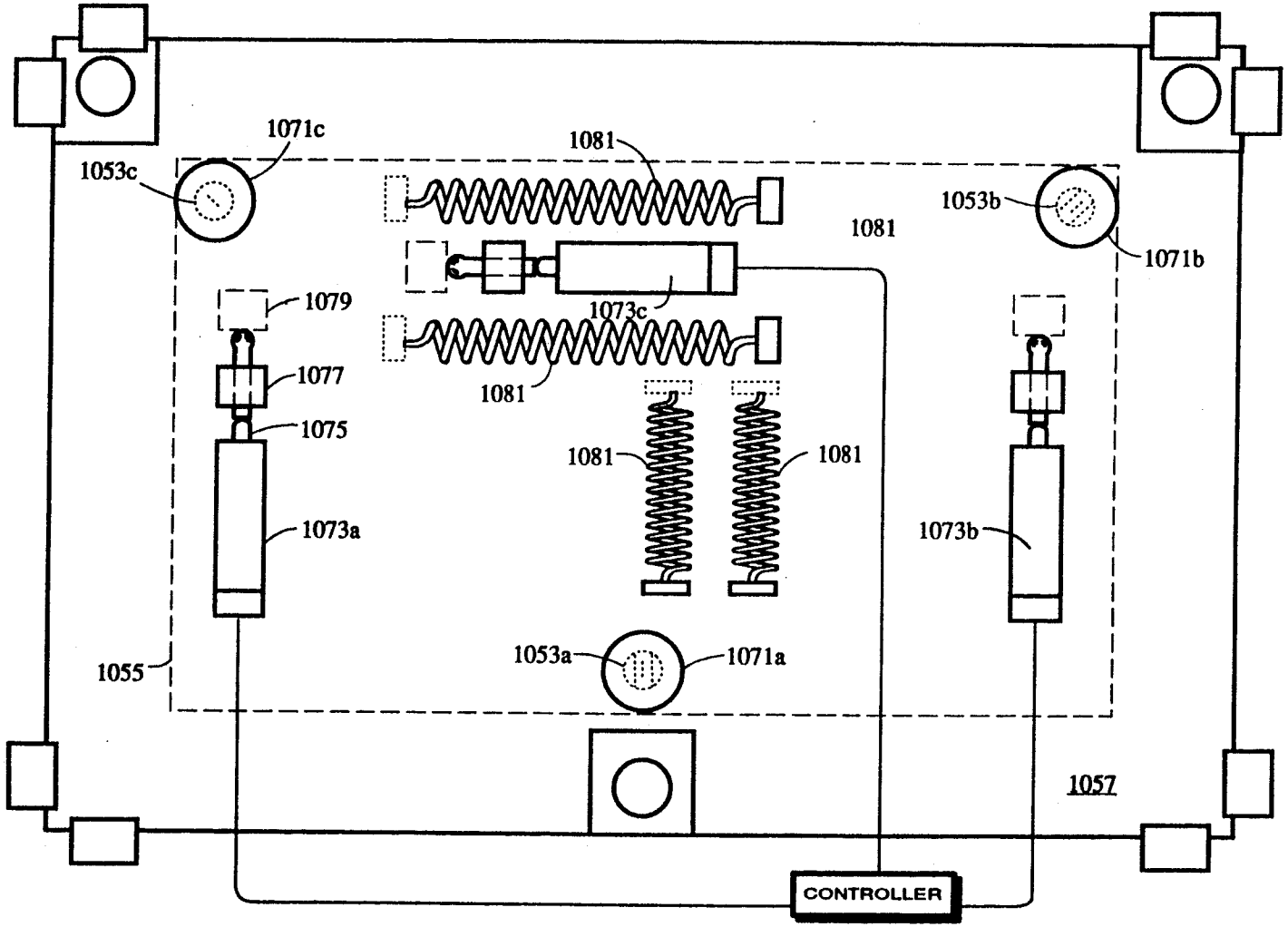
FIG. 54 is a top view of the first and second panel module stages of FIG. 52 with the first stage shown in phantom to present details of the panel positioning elements.

As shown schematically in FIG. 49 and in more detail in FIG. 54, displacement of the panel 1049 is accomplished by shifting the panel module first stage 1055 in relation to the panel module second stage 1057, which bears the registry balls 1059*a,b,c* necessary for positioning the panel module 1005 in the assembly station 1007. The panel module first stage 1055 (in phantom) is movably mounted on ball bearings 1071*a,b,c* resting on the panel module second stage 1057.

Stepping motors 1073*a,b,c* are mounted on the second stage 1057 and have shafts 1075 which contact decoupler pins 1076 supported in bearing blocks 1077 also mounted on the second stage 1057. The decoupler pins 1076 then contact blocks 1079 (in phantom) attached to the underside of the first stage 1055. Controlled activation of the stepper motors 1073*a,b,c* will thus exert the motive force required to shift the panel-bearing first stage 1055 in relation to the second stage 1057. The decoupler pins 1076 move only axially within their bearing blocks 1077 in order to provide accurate lateral movement by isolating the movement of the first panel stage 1055 from any distortional side thrust induced by the rotation of stepper motor shafts 1075. Biasing springs 1081 are suitably attached between the first and second stages to maintain the desired position of the first stage 1055.

Thus, the panel interrogation camera array 1011, fixedly positioned on the panel module second stage 1057, can monitor the movements of the panel 1049, feeding position data to the controller 1069, which in turn, directs the movement of the panel module first stage 1055 by controlling the stepper motors 1073*a,b,c*.

It will be noted here that positioning of the panel first stage 1055 is also used to account for any rotation or offset between the registration component positions of the assembly station and of the panel module. Such offset information may be obtained by placing a calibration plate in the panel module and interrogating the calibration plate position with both the panel camera and mask camera arrays in their respective operating locations and comparing results.

Once the panel 1049 is positioned to align with the mask axes in the assembly station 1007, the transport system 1035 transports the panel module 1005 to the assembly station 1007. The panel module 1005 contains fine lifting apparatus identical to the mask module 1003. The gross and fine lifters place the panel rails into contact with the tensed masked. Welding of the mask to the rails is performed by a laser 1089 guided through the controller 1069 by rail information obtained from rail inspection cameras 1083 located in the panel camera array 1011.

While particular embodiments of the invention have been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

What is claimed is:

1. A system for registering undedicated flat tension comprising:

(a) an assembly station where the mask and panel are joined together, (b) registration movement means for producing relative registration movement between the mask and the screen, (c) a mask loading station apart from the assembly station, (d) a panel loading station apart from the assembly station, (e) transport means for carrying the masks and panels from the mask and panel loading stations to the assembly station, (f) screen sensing means for sensing the configuration of the screen on the panel at or near the panel loading station, and (g) control means for controlling the registration movement means and responsive to the screen sensing means to achieve at least preliminary registration, whereby the assembly station is freed of at least this preliminary registration when both panel and mask are in the assembly station.

2. The system defined in claim 1, wherein:

(a) the control means includes a computer containing previously stored information for relating the configuration of the screen to the indicia on the face panel, and (b) the screen sensing means senses the indicia on the panel and inputs that information to the computer.

3. The system defined in claim 1 including:

(a) registration interrogation means for determining the location of the screen relative to the mask, and, (b) wherein the control means is further responsive to the registration interrogation means to control the registration movement means.

4. The system defined in claim 3 wherein the registration interrogation means has sensors located in the assembly station.

5. The system defined in claim 3 where the registration interrogation means has sensors located at the panel loading station.

6. The system of claim 1 further comprising:

(a) a holder for the panel and a holder for the mask, and, (b) screen sensing means for sensing the configuration of the screen relative to the holder before the panel arrives at the assembly station, whereby the location and or shape of the screen relative to the panel holder may be determined before the panel arrives at the assembly station.

7. The system of claim 1, further comprising:

(a) said means for producing registration movement of the mask relative to the screen having:

(1) mask stretching means for stretching the mask to a predetermined reference or to the screen, and (2) means for moving the mask, or screen relative to the screen or mask, respectively, and (b) control means for the registration movement means, including:

(1) stretch control means for stretching the mask to a predetermined reference or to the screen in the assembly station before the transport means moves the panel to the assembly station.

8. The system defined in claim 7 wherein:

the stretch control means includes (1) a plurality of optical devices fixed with respect to one another for simultaneously determining the locations of a plurality of the apertures in the mask.

9. The system defined in claim 8, wherein:

the mask has a generally rectangular four quandrant array of apertures therein, the optical devices including at least four optical devices with one device positioned to examine one of the apertures in one of the quandrant of the aperture array.

10. The system as defined in claim 1, wherein:

the face panel has indicia thereon indicating the configuration of the screen relative to the panel; and the screen sensing means further includes spaced cameras for viewing the indicia.

11. A system for registering undedicated flat tension masks to face panel mounted screens for CRTs, comprising:

(a) an assembly station where the mask and panel are joined together, (b) registration movement means for producing relative registration movement between the mask and the screen, (c) a mask loading station apart from the assembly station, (d) a panel loading station apart from the assembly station, (e) transport means for carrying the masks and panels from the mask and panel loading stations to the assembly station, (f) a mask module for supporting the mask for transport from the mask loading station to the assembly station, (g) a panel module for supporting the panel for transport from the panel loading station to the assembly station, and (h) common registration means at the assembly station for constant positioning of the mask module and the panel module therein.

12. The system as defined in claim 11, wherein the common registration means includes:

(a) a stationary frame for the assembly station; and, (b) location determining means on the modules and the assembly station frame for determining the position of the modules in the assembly station.

13. The system defined in claim 12 wherein:

the location determining means includes position sensing optical devices carried by the mask module and the panel module that, together with target means on the assembly frame, define the location determining means to monitor the position of the modules in the assembly station.

14. The system defined in claim 12 wherein:

the location determining means includes: mechanical devices on the mask module mounted at the same location thereon as corresponding substantially identical devices on the panel module so both can register to a common mechanical device on the assembly station frame.

15. The system of claim 11 further comprising:

optical interrogation means for sensing the mask and panel positions, the optical interrogation means being carried on the mask and panel modules.

16. The system defined in claim 11, wherein:

the panel module includes:

(a) a panel loading stage upon which the panel is initially placed in a plurality of panel registration elements mounted on the loading stage, and (b) a panel module second stage upon which the loading stage is movably mounted, the second stage having:

(1) means for registering the panel module at the assembly station, and (2) means for moving the panel loading stage to change the orientation of the screen with respect to the panel module registering means.

17. A system for registering undedicated flat tension masks to face panel mounted screens in the manufacture of CRTs, comprising:

(a) an assembly station for joining the mask to the panel, (b) a stretching system for tensioning the mask to a predetermined reference or to the screen at the assembly station, (c) a registration system for positioning the panel at the assembly station adjacent the mask, (d) screen location means for determining the location of the screen relative to the registration system for the panel, (e) mask location means to determine the location of the mask with respect to the panel registration system, (f) control means, responsive to the screen location means and responsive to the mask location means, for producing relative movement between the mask aperture array and the screen to bring the two into registry prior to assembly, (g) a mask loading station apart from the assembly station, (h) a panel loading station apart from the assembly station, and, (i) transport means for bringing the panel and mask from their respective loading stations to the assembly station.

18. A system for registering undedicated flat tension masks to face panel mounted screens in the manufacture of CRTs, comprising:

(a) an assembly station for joining the mask to the panel, (b) a stretching system for tensioning the mask to a predetermined reference or to the screen at the assembly station, (c) a registration system for positioning the panel at the assembly station adjacent the mask, (d) screen location means for determining the location of the screen relative to the registration system for the panel, (e) mask location means to determine the location of the mask with respect to the panel registration system, and (f) control means, responsive to the screen location means and responsive to the mask location means, for producing relative movement between the mask aperture array and the screen to bring the two into registry prior to assembly, wherein the means for determining the location of the screen includes a first optical device located to view at least one fiducial mark on the panel, and, wherein the means for determining the location of the mask includes a second optical device mounted to view the mask at the assembly station, and wherein said stretching system includes:

(1) a platform, (2) a plurality of clamps slidably mounted on the platform, (3) means for moving the stretching platform in at least two orthogonal directions, and (4) target means carried by the platform, said second optical device sensing the target means on the stretching platform to locate the mask relative to the panel registration system.

19. A system for registering undedicated flat tension masks to face panel mounted screens in the manufacture of CRTs, comprising:

(a) an assembly station where the mask and panel are joined together, (b) registration movement means for producing registration movement of the mask relative to the screen in the assembly station, (c) a mask loading station apart from the assembly station, (d) a panel loading station apart from the assembly station, (e) transport means for carrying the masks and panels from the mask and panel loading station to the assembly station, (f) a mask module for supporting the mask for transport from the mask loading station to the assembly station, (g) a panel module for supporting the panel for transport from the panel loading station to the assembly station, and (h) common registration means at the assembly station for the mask module and the panel module.

20. A system for registering undedicated flat tension masks to face panel mounted screens in claim 19, wherein:

the common registration means at the assembly station includes means for determining the location of both the panel module and the mask module with respect to the assembly station.

21. A system for registering undedicated flat tension masks to face panel mounted screens in the manufacture of CRTs as defined in claim 20, wherein the means for determining the location of the mask module and panel module includes optical devices on each of the mask and panel modules that sense a common target in the assembly station.

22. A system for registering undedicated flat tension masks to face panel mounted screens in the manufacture of CRTs as defined in claim 20, wherein the means for determining the location of both the panel module and the mask module includes optical means at the assembly station.

23. A system for registering undedicated flat tension masks to face panel mounted screens in the manufacture of CRTs, comprising:

(a) an assembly station where the mask and panel are joined together, (b) a mask module for supporting the mask for transport to the assembly station, (c) a panel module for supporting the panel for transport to the assembly station, (d) module registration means at the assembly station for locating serially the mask module and the panel module, and (e) a lift assembly for alternatively lifting the mask module and panel modules against the registration means at the assembly station.

24. The system defined in claim 23, wherein the lift assembly includes means for allowing the modules to move freely in a horizontal plane.

25. The system defined in claim 23 wherein said panel module includes:

(1) registration means for directly engaging the sides of the panel to accurately locate the panel horizontally in the module, (2) means biasing the panel horizontally against the registration means, (3) vertical registration means for the panel in the panel module for directly engaging the panel to accurately locate the panel vertically in the module, (4) means biasing the panel upwardly into engagement with the vertical registration means, and (5) means for selectively releasing an initial loading constraint on the panel to provide for horizontal movement of the panel, whereby the faceplate is held in the module without any positive clamping and with a minimum of friction.

26. The system defined in claim 23, wherein the lift assembly is mounted directly underneath the assembly station in vertical alignment with the registration means.

* * * * *